US005391467A

United States Patent [19]

Yoshida et al.

[11] Patent Number: 5,391,467

[45] Date of Patent: Feb. 21, 1995

[54] METHOD FOR CONTINUOUSLY PROCESSING SILVER HALIDE COLOR PHOTOSENSITIVE MATERIAL

[75] Inventors: Kazuaki Yoshida; Akira Abe, both of Minami-ashigara, Japan

[73] Assignee: Fuji Photo Film Co., Ltd., Minami-Ashigara, Japan

[21] Appl. No.: 257,031

[22] Filed: Jun. 8, 1994

[30] Foreign Application Priority Data

Jun. 11, 1993 [JP] Japan ..... 5-164998

[51] Int. Cl.[6] ..... G03C 7/407

[52] U.S. Cl. ..... 430/434; 430/467; 430/486; 430/490

[58] Field of Search ..... 430/467, 486, 490, 434

[56] References Cited

U.S. PATENT DOCUMENTS

| | | | |
|---|---|---|---|
| 4,965,175 | 10/1990 | Fujimoto et al. | 430/490 |
| 5,077,180 | 12/1991 | Yoshida et al. | 430/380 |
| 5,110,713 | 5/1992 | Yoshida et al. | 430/372 |
| 5,246,819 | 9/1993 | Yoshida et al. | 430/382 |

FOREIGN PATENT DOCUMENTS 47-20743 6/1972 Japan .

1-310351 12/1989 Japan .

*Primary Examiner*—Hoa Van Le

*Attorney, Agent, or Firm*—Burns, Doane, Swecker & Mathis

[57] ABSTRACT

A method for continuously processing a silver halide color photographic photosensitive material by treating this material with a color developer containing at least one aromatic primary amine color developing agent, comprises the steps of covering the surface of a color developer replenisher in a color developer replenisher tank with a layer of a floating fluid and replenishing 20 to 100 ml of the color developer replenisher per $m^2$ of the photosensitive material to a color developing tank. This method makes it possible to inhibit the formation of the precipitate in the color developer replenisher caused when the amount of the replenisher is considerably reduced and also to inhibit the change of the photographic characteristics by change of the amount of the processed photosensitive material so that the amount of the color developer replenisher can be remarkably reduced to the range of 20 to 100 ml per square meter of the photosensitive material and that of the waste water can be also remarkably reduced.

21 Claims, 2 Drawing Sheets

METHOD FOR CONTINUOUSLY PROCESSING SILVER HALIDE COLOR PHOTOSENSITIVE MATERIAL

BACKGROUND OF THE INVENTION

The present invention relates to a method for continuously processing a silver halide color photographic photosensitive material. In particular, the present invention relates to a continuous processing method wherein the color developer replenisher to be used is remarkably reduced in amount.

In recent years, it is demanded to reduce the amount of a replenisher and also to reduce the amount of a waste water by regeneration of the waste water in order to prevent the environmental pollution. The reduction of the amount of a waste water, in particular, a color developer replenisher having a high BOD or COD is eargerly demanded.

In order to reduce the amount of the color developer to be replenished, some problems must be solved.

The replenisher acts to replenish components consumed in the development such as a developing agent and an alkali, thereby keeping the concentration of them in the color developer constant. In order to keep the concentration of the components in the color developer while reducing the amount of the replenisher, the concentration of the components in the replenisher must be increased as a matter of course.

One of problems caused in the reduction of the amount of the replenisher in the color development is that when the concentration of the color developing agent in the replenisher is increased, a precipitation is formed in a replenisher tank to cause troubles in the replenishing step and also to seriously vary the photographic characteristics.

Various techniques of preventing the color developing agent from precipitation were proposed. For example, Japanese Patent Publication for Opposition Purpose (hereinafter referred to as "J.P. KOKOKU") No. Sho 47-20743 discloses a technique wherein polyvinyl alcohol or polyvinyl pyrrolidone (homopolymer or copolymer) is used. However, the effect thereof is yet insufficient for attaining the object of the present invention.

Another object of the present invention is to solve a problem that when the replenisher is reduced in amount, the photographic characteristics are varied or, in particular, the sensitivity and the maximum density vary seriously depending on the difference in the processing scale.

No technique for solving these problems has been developed and, under these circumstances, it has been eagerly demanded to develop a technique of obtaining stable photographic characteristics even when the quantity of the color developer to be replenished is remarkably reduced.

SUMMARY OF THE INVENTION

The primary object of the present invention is to provide a method for remarkably reducing the amount of the color developing replenisher while preventing the color developing replenisher from precipitation.

Another object of the present invention is to provide a method for remarkably reducing the amount of the color developing replenisher by reducing the variation of the photographic characteristics due to a difference in the amount of the photosensitive material to be processed.

These and other objects of the present invention will be apparent from the following description and Examples.

After investigations made for the purpose of solving the above-described problems, the inventors have found that the objects can be attained by the method for continuously processing a silver halide color photographic photosensitive material by treating this material with a color developer containing at least one aromatic primary amine color developing agent, which comprises the steps of covering the surface of a color developer replenisher in a color developer replenisher tank with a layer of a floating fluid and replenishing 20 to 100 ml of the color developer replenisher per $m^2$ of the photosensitive material to a color developing tank.

After investigations made for the purpose of remarkably reducing the amount of the color developing replenisher, the inventors have found that problems do not occur when the replenisher is used in an ordinary amount (for example, 161 ml/$m^2$ of RA-4 or 360 ml/$m^2$ of EP-2 of Eastman Kodak Co.), but the problems occur when the amount is reduced to the range of 20 to 120 ml/$m^2$. In particular, the problems thus caused are peculiar to the reduction in amount of the replenisher, i.e. the developing agent is precipitated in the developer and the photographic characteristics are seriously varied by difference in the amount of the processed photosensitive material.

The inventors have found that the above-described problems peculiar to the reduction in amount of the replenisher are caused by increase in the concentration of the replenisher and that when the surface of the replenisher is covered with a floating fluid layer, the precipitation can be prevented and the variation of the photographic characteristics due to the variation of the amount of the processed photosensitive material can be remarkably reduced.

It has been unknown at all that the precipitation can be prevented by covering the replenisher surface with the fluid. This phenomenon is very surprising.

The present invention has been completed also on the basis of a finding that the change in the photographic characteristics by the change in amount of the processed photosensitive material is due to deterioration of the replenisher in the replenisher tank. The inventors have also found that the above-described problems cannot be solved by the conventional preservation techniques or by reduction of the area of the replenisher surface to be brought into contact with air by means of a floating lid or floating ball. Namely, the inventors have found that the above-described problems cannot be solved without covering the replenisher surface with a fluid.

Japanese Patent Unexamined Published Application (hereinafter referred to as "J.P. KOKAI") No. Hei 1-310351 discloses a technique of preventing the evaporation of the processing solution, lowering the solution temperature and prevention thereof from oxidation with air by covering the surface of the processing solution in a processing vessel with a layer of a floating fluid.

In this technique, the fluid is added to the solution in the processing vessel. According to the present inventors' investigations, this technique is practically unusable because of uneven processing, and the problems of the replenisher of the present invention cannot be solved by this technique.

The specification of this J.P. KOKAI No. Hei 1-310351 is silent with the problems caused by reduction of the amount of the replenisher and to be solved by the present invention and also on processes for solving the problems. Thus, the present invention cannot be inferred from the invention of J.P. KOKAI No. Hei 1-310351.

Figure 1:
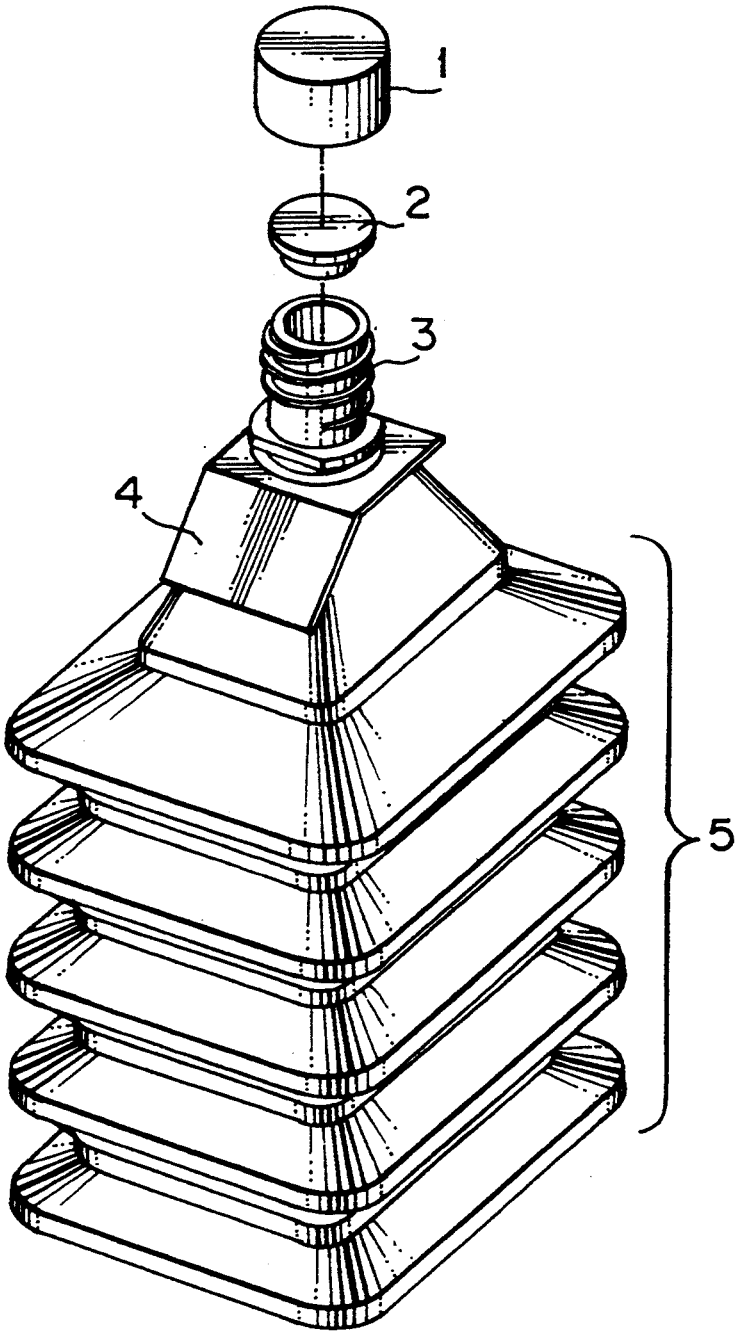
FIG. 1 is a front view of the flexible, roughly square vessel having the bellows part, which is to be used for the processing solution.

In the FIGS., the symbols 1, 2, 3 and 4 represent cap, inside plug, mouthpiece, and bellows part, respectively.

DESCRIPTION OF THE PREFERRED EMBODIMENTS OF THE INVENTION

The description will be made on the fluid floating on the color developer replenisher.

The color developer replenisher has a specific gravity of usually in the range of 1.030 to 1.100. The fluid to be floated on the replenisher must have a specific gravity lower than that of the replenisher. The specific gravity of the floating fluid is desirably not higher than 1.030, more desirably not higher than 1.000 and partcularly not higher than 0.950.

The floating fluid must be capable of forming the fluid layer and incompatible or immiscible with the replenisher. The fluid has a water content of preferably not higher than 10% by weight, more preferably not higher than 1% by weight and most preferably not higher than 0.2% by weight.

The floating fluid is preferably unvaporizable. Its boiling point is preferably not lower than 100° C., more preferably not lower than 150° C. and most preferably not lower than 200° C.

The floating fluid is preferably such a substance which does not react with the color developer replenisher and, therefore, does not exert a bad influence on the processability of the photosensitive material. It has preferably a relatively low permittivity (a relative permittivity of about 2 to 20).

Examples of the floating fluids include liquid saturated hydrocarbons such as paraffins and cycloparaffins; synthetic oils such as phosphoric esters, phthalic esters, benzoic esters, substituted benzoic esters, lactic esters, fatty acid esters, benzyl alcohol esters and carbonic esters; ethers, active methylene compounds and alcohol compounds.

Examples of these compounds will be given below, which by no

| | Specific gravity | Boiling point |
|---|---|---|
| (1) Liquid paraffin | 0.881 | 300° C. or higher |
| (2) Nonane | 0.718 | 150° C. |
| (3) Decane | 0.730 | 174° C. |
| (4) Undecane | 0.740 | 196° C. |
| (5) Dodecane | 0.749 | 216° C. |
| (6) Tridecane | 0.757 | 234° C. |
| (7) Tetradecane | 0.764 | 251° C. |
| (8) Pentadecane | 0.769 | 268° C. |
| (9) $(C_4H_9O)_3P{=}O$ | 0.973 | 289° C. |
| (10) $(C_8H_{17}O)_3P{=}O$ (EH) | 0.920 | 185 |
| (11) $(\text{iso-}C_9H_{19}O)_3P{=}O$ | 0.909 | 220 |
| (12) 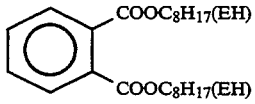 | 0.986 | 229 |
| (13) 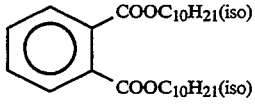 | 0.966 | 248 |
| (14) 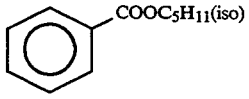 | 0.984 | 260 |
| (15) 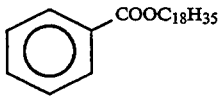 | 0.923 | 230 |
| (16) 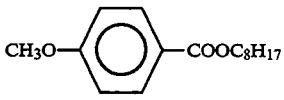 | 0.999 | 162 |

-continued

| | Specific gravity | Boiling point |
|---|---|---|
| (17) $CH_3CH(OCO-C_6H_5)-COOC_{18}H_{37}$(iso) | 0.958 | 195 |
| (18) $CH_3COO-C(CH_2COOC_8H_{17}(EH))_3$ | 0.980 | 225 |
| (19) $(CH_2CH_2-COOC_8H_{17}(EH))_2$ | 0.927 | 214 |
| (20) $CH_3-CH(CH_3)-CH(CO-CH(CH_3)-CH_3)-C(CH_3)_2-CH_2OCOCH(CH_3)-CH_3$ | 0.945 | 280° C. |
| (21) $C_6H_5-CH_2OCOC_{15}H_{31}$ | 0.937 | 190 |
| (22) $C_{12}H_{25}O-O(=O)-C_{12}H_{25}$ | 0.875 | 235 |
| (23) $C_{11}H_{23}CON(C_2H_5)_2$ | 0.862 | 175 |
| (24) $C_{17}H_{33}COOCH_2-$ 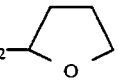 | 0.923 | 220 |
| (25) $CH_3COCH_2COOC_{12}H_{25}$ | 0.909 | 155 |
| (26) $HO-C(CH_3)_2-CH_2-C(H)-OH$ | 0.924 | 198 |
| (27) 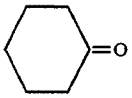 | 0.948 | 156 |
| (28) $[CH_3(CH_2)_3O]_3B$ | 0.853 | 230 |

In the above-described compounds, particularly compounds (1) to (8) are preferred. Among them, liquid paraffin (1) is preferred, since it has a high boiling point and low water content, it is incompatible or immiscible with the replenisher, it is unreactive with the components of the replenisher, oil-soluble components in the replenisher are insoluble in it, and it has only a low oxygen absorption and carbon dioxide absorption.

The thickness of the fluid layer is preferably about 0.1 to 20 mm, most preferably about 1 to 10 mm. It is also preferred to use the fluid layer in combination with a floating substance disclosed in J.P. KOKAI No. Sho 61-258245.

The description will be made on the amount of the color developer replenisher of the present invention to be fed into the color development vessel.

The replenishing amount must be 20 to 100 ml per $m^2$ of the photosensitive material in the present invention. When the replenishing amount is below 20 ml, the amount of the developer taken out by the photosensitive material is larger than the replenishing amount fed thereinto and, therefore, the surface level in the development vessel lowers as the development process is continued to finally make the development process impossible. On the contrary, when the replenishing amount is above 100 ml, the effect of the present invention cannot be obtained, since the problems to be solved by the present invention, i.e. the precipitation formed in the replenisher and the change of the photographic characteristics due to the change in amount of the treated photosensitive material, are not caused irrespective of the covering of the replenisher with the fluid of the present invention.

The replenishing amount is preferably 30 to 90 ml, more preferably 35 to 80 ml, per $m^2$ of the photosensitive material.

The description will be made on the color developer replenisher and the color developer used in the present invention.

The color developer replenisher and the color developer used in the present invention contains a well-known aromatic primary amine color developing agent. Preferred examples of such developing agents include p-phenylenediamine derivatives. Typical examples of them include N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline, 2-methyl-4-[N-ethyl-N-(β-hydroxyethyl-)amino]aniline, 2-methyl-4-[N-ethyl-N-(β-hydroxybutyl)amino]aniline, 4-amino-3-methyl-N-ethyl-N-[β-(methanesulfonamido)ethyl]aniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline. Particularly preferred are 4-amino-3-methyl-N-ethyl-N-[β-(methanesulfonamido)ethyl]aniline and 2-methyl-4-[N-ethyl-N-(β-hydroxybutyl)amino]aniline.

These p-phenylenediamine derivatives may be in the form of their salts such as sulfates, hycrochlorides, sulfites and p-toluenesulfonates. The aromatic primary amine developing agent is used in an amount of usually about 4 mmol to 50 mmol per liter of the color developer. The color developer replenisher is used in an amount of preferably about 21 mmol to 65 mmol, more preferably about 28 mmol to 55 mmol, per liter of the replenisher.

In conducting the method of the present invention, it is preferred to use a substantially benzyl alcohol-free color developer replenisher and color developer in order to prevent the formation of the precipitate in the replenisher and the change of the photographic characteristics due to the change of the amount of the processed photosensitive material. The term "substantitally benzyl alcohol-free" indicates that benzyl alcohol content is not higher than 2 ml/l, preferably not higher than 0.5 ml/l and that most preferably benzyl alcohol is not contained at all.

It is preferred in the present invention that the color developer replenisher and the color developer are substantially free from sulfites and hydroxylamines so as to prevent the formation of the precipitate in the replenisher and the change of the photographic characteristics due to the change in amount of the processed material.

Particularly when the replenisher is free from sulfites and hydroxylamines, the formation of the precipitate in the replenisher is substantially not observed. The term "substantially free from sulfites and hydroxylamines" indicates that the color developer replenisher or color developer contains not more than 4 mmol, preferably not more than 2 mmol, of them and most preferably it is completely free from them.

It is preferred that the replenisher and the developer contain a compound of the following formula (I) in order to inhibit the formation of the precipitate in the replenisher and change of the photographic characteristics due to the change of the amount of the processed material. In particular, the formation of the precipitate in the replenisher can be remarkably inhibited in the presence of the compound of the following formula (I):

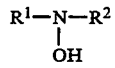

wherein $R^1$ and $R^2$ each represent a hydrogen atom, unsubstituted or substituted alkyl group, unsubstituted or substituted alkenyl group, unsubstituted or substituted aryl group or heteroaromatic group, with the proviso that both $R^1$ and $R^2$ cannot be hydrogen atom at the same time and they may be combined together to form a heterocycle together with the nitrogen atom, the heterocycle having such a ring structure that it comprises 5 or 6 members including carbon, hydrogen, halogen, oxygen, nitrogen, sulfur atoms and the like and the heterocycle being saturated or unsaturated.

Each of $R^1$ and $R^2$ is preferably an alkyl or alkenyl group, more preferably the group having 1 to 10 carbon atoms, most preferably 1 to 5 carbon atoms. The heterocyclic groups formed by combination of $R^1$ and $R^2$ together include, for example, piperidyl group, pyrrolidinyl group, an N-alkylpiperazyl group, morpholinyl group, indolinyl group and benzotriazole group.

Examples of the compounds of the formula (I) used in the present invention will be given below, which by no means limit the invention.

It is desirable that the amount of such a compound to be added to the color developer and color developer replenisher is 0.005 to 0.5 mol/l, preferably 0.03 to 0.1 mol/l.

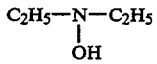

I-1

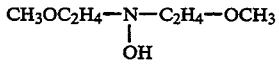

I-2

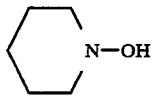

I-3

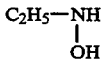

I-4

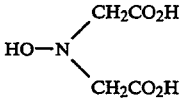

I-5

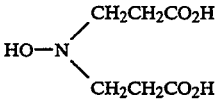

I-6

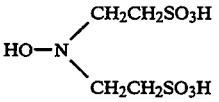

I-7

-continued

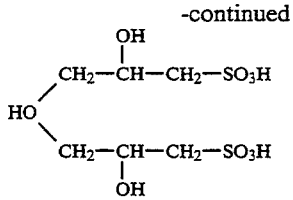

I-8

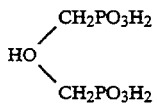

I-9

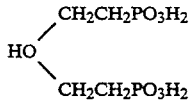

I-10

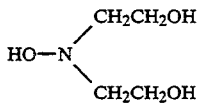

I-11

$HO-NH-CH_2CO_2H$ I-12

$HO-NH-CH_2CH_2SO_3H$ I-13

$HO-NH-CH_2PO_3H$ I-14

$HO-NH-CH_2CH_2OH$ I-15

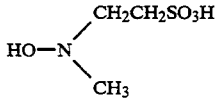

I-16

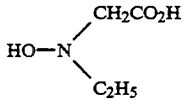

I-17

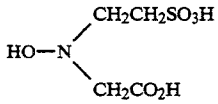

I-18

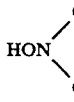

I-19

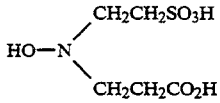

I-20

The compounds of the formula (I) can be synthesized by an alkylation reaction (nucleophilic replacement reaction, addition reaction or Mannich reaction) of commercially available hydroxylamines. In particular, they can be synthesized by processes disclosed in West German Patent No. 1,159,634, "Inorganica Chimica Acta", 93, (1984), 101 to 108 and the like. Examples of the synthesis will be given below.

Synthesis Examples

Synthesis of compound (17):

11.5 g of sodium hydroxide and 96 g of sodium chloro ethanesulfonate were added to 200 ml of an aqueous solution of 20 g of hydroxylamine hydrochloride. Then 40 ml of an aqueous solution of 23 g of sodium hydroxide was slowly added to the resultant mixture for 1 hour while the temperature was kept at 60° C. The mixture was kept at 60° C. for additional 3 hours, and the reaction liquid was concentrated under the reduced pressure. 200 ml of concentrated hydrochloric acid was added to the concentrate, and the resultant mixture was heated at 50° C. An insoluble matter thus formed was removed by filtration, and 500 ml of methanol was added to the filtrate to obtain the intended product [compound (17)] in the form of crystals of monosodium salt thereof.

Yield: 41 g (53%).

Synthesis of compound (21):

32.6 g of formalin was added to an aqueous hydrochloric acid solution containing 7.2 g of hydroxylamine hydrochloride and 18.0 g of phosphorous acid, and the resultant mixture was heated under reflux for 2 hours. Crystals thus formed were recrystallized from water and methanol to obtain 9.2 g (42%) of compound (21).

An organic preservative can be used, if necessary, in addition to the compound of the formula (I) in the present invention.

The organic preservatives include all the organic compounds capable of reducing the deterioration speed of the aromatic primary amine used as the color developing agent upon addition to the processing solution for the color photographic sensitive material. Namely, they are organic compounds having a function of preventing oxidation of the color developing agent by air or the like. Among them, particularly effective are hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds and amines having a condensed ring. They are mentioned in, for example, J.P. KOKOKU No. Sho 48-30496, J.P. KOKAI Nos. Sho 52-143020, 63-4235, 63-30845, 63-21647, 63-44655, 63-53551, 63-43140, 63-56654, 63-58346, 63-43138, 63-146041, 63-44657 and 63-44656, U.S. Pat. Nos. 3,615,503 and 2,494,903, and J.P. KOKAI Nos. Hei 1-97953, 1-186939, 1-186940, 1-187557 and 2-306244. Other preservatives may be used, if necessary, such as metals described in J.P. KOKAI Nos. Sho 57-44148 and 57-53749; salicylic acids described in J.P. KOKAI No. Sho 59-180588; amines described in J.P. KOKAI Nos. Sho 63-239447 and 63-128340 and Hei 1-186939 and 1-187557; alkanolamines described in J.P. KOKAI No. Sho 54-3532; polyethyleneimines described in J.P. KOKAI No. Sho 56-94349 and aromatic polyhydroxy compounds described in, for example, U.S. Pat. No. 3,746,544. Among them, alkanolamines such as triethanolamine are preferred.

In the present invention, it is particularly preferred to add the aromatic polyhydroxy compound in order to improve the stability of the developer.

The aromatic polyhydroxy compounds are generally those having an aromatic ring having at least two hydroxy groups arranged in the o-position to each other. The aromatic polyhydroxy compounds are preferably those having an aromatic ring having at least two hydroxy groups arranged in the o-position to each other and having no unsaturation outside the ring. The aromatic polyhydroxy compounds selected from those in a wide range include compounds represented by the following formula (II) such as benzene and naphthalene compounds in the present invention:

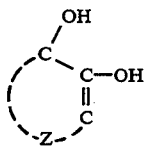

wherein Z together with —C—C=C— represents a group necessitated for completing the aromatic nucleus of benzene or naphthalene.

The above-described compounds may be substituted with a group or atom such a sulfo group, carboxyl group or halogen atom in addition to the hydroxyl group. Examples of the aromatic polyhydroxy compounds preferably used in the present invention include the following compounds:

II-1 Pyrocatechol,
II-2 4,5-Dihydroxy-m-benzene-1,3-disulfonic acid,
II-3 Disodium 4,5-dihydroxy-m-benzene-1,3-disulfonate,
II-4 Tetrabromopyrocatechol,
II-5 Pyrogallol,
II-6 Sodium 5,6-dihydroxy-1,2,4-benzenetrisulfonate,
II-7 Gallic acid,
II-8 Methyl gallate,
II-9 Propyl gallate,
II-10 2,3-Dihydroxynaphthalene-6-sulfonic acid,
II-11 2,3,8-Trihydroxynaphthalene-6-sulfonic acid.

Such a compound as described above is incorporated into the color developer and color developer replenisher in an amount of 0.00005 to 0.1 mol, usually 0.0002 to 0.04 mol, and preferably 0.0002 to 0.004 mol, per liter of the developer.

The color developer used in the present invention has a pH of preferably 9 to 12, more preferably 9 to 11.0. The color developer may contain other compounds known to be components of the developer.

The color developer replenisher used in the present invention has a pH of preferably 11 to 14, more preferably 11.5 to 13.5. From the viewpoint of the inhibition of the precipitate formation in the replenisher and reduction in amount of the replenisher, the pH is particularly preferably 12.0 to 13.0.

To keep the pH in the above-described range, it is preferred to use a buffer. The buffers usable herein include carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. Among them, the carbonates, phosphates, tetraborates and hydroxybenzoates are particularly preferred, since they have the following advantages: they have a high solubility, high buffering capacity at a high pH of 9.0 or above; they exert no bad influence (such as fogging) on the photographic characteristics even when they are added to the color developer; and they are inexpensive.

Examples of the buffers include sodium carbonate, potassium carbonate, sodium hydrogencarbonate, potassium hydrogencarbonate, trisodium phosphate, tripotassium phosphate, disodium hydrogenphosphate, dipotassium hydrogenphosphate, sodium borate, potassium broate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The amount of the buffer to be added to the color developer and color developer replenisher is preferably 0.1 mol/l or more, particularly 0.1 mol/l to 0.4 mol/l.

A chelating agent can be used for inhibiting precipitation of calcium or magnesium in the color developer or for improving the stability of the color developer in the present invention. The chelating agents include, for example, nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid and hydroxyethyliminodiacetic acid. These chelating agents are used either singly or in combination of two or more of them, if necessary.

The chelating agent is used in an amount sufficient for the sequestering in the color developer, such as about 0.1 to 10 g per liter of the developer.

The color developer can contain, if necessary, a development accelerator.

The development accelerators include, for example, thioether compounds described in J.P. KOKOKU Nos. Sho 37-16088, 37-5987, 38-7826, 44-12380 and 45-9015 and U.S. Pat. No. 3,318,247; p-phenylenediamine compounds described in J.P. KOKAI Nos. Sho 52-49829 and 50-15554; quaternary ammonium salts described in J.P. KOKAI No. Sho 50-137726, J.P. KOKOKU No. Sho 44-30074 and J.P. KOKAI Nos. Sho 56-156826 and 52-43429; amine compounds described in U.S. Pat. Nos. 2,494,903, 3,128,182, 4,230,796 and 3,253,919, J.P. KOKOKU No. sho 41-11431 and U.S. Pat. Nos. 2,482,546, 2,596,926 and 3,582,346; polyalkylene oxides described in J.P. KOKOKU Nos. Sho 37-16088 and 42-25201, U.S. Pat. No. 3,128,183, J.P. KOKOKU Nos. Sho 41-11431 and 42-23883 and U.S. Pat. No. 3,532,501; as well as 1-phenyl-3-pyrazolidones and imidazoles. Benzyl alcohols are as described above.

An antifoggant can be used, if necessary, in the present invention. The antifoggants include alkali metal halides such as sodium chloride, potassium bromide and potassium iodide; and organic antifoggants which are typified by nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazol ylmethylbenzimidazole, indazole, hydroxyazaindolizine and adenine.

The chloride ion concentration in the color developer is preferably $5\times10^{-2}$ to $2\times10^{-1}$ mol/l for inhibiting the change of the photograhic characteristics in the present invention. The chloride ion concentration is more preferably $6\times10^{-2}$ to $1.5\times10^{-1}$ mol/l and particularly $8\times10^{-2}$ to $1.3\times10^{-1}$ mol/l.

The bromide ion concentration in the color developer is preferably $1\times10^{-4}$ to $4\times10^{-4}$ mol/l for inhibiting the change of the photograhic characteristics in the present invention. The bromide ion concentration is more preferably $1.2\times10^{-4}$ to $3.8\times10^{-2}$ mol/l and particularly $1.5\times10^{-4}$ to $3.5\times10^{-4}$ mol/l. It is most preferred to use a combination of the chloride ion and bromide ion both in the above-described concentrations.

The color developer and color developer replenisher can contain, if necessary, a fluorescent brightener in the present invention.

The fluorescent brightener is preferably a 4,4'-diamino-2,2'-disulfostilbene compound. It is preferable that the color developer replenisher contain $1\times10^{-3}$ to $1\times10^{-2}$ mol/l. Among them, compounds of the following formula (SR) are particularly preferred from the viewpoints of the solubility in the replenisher, inhibition of the precipitate formation in the replenisher and reduction of stain of the processed photosensitive material.

Formula (SR):

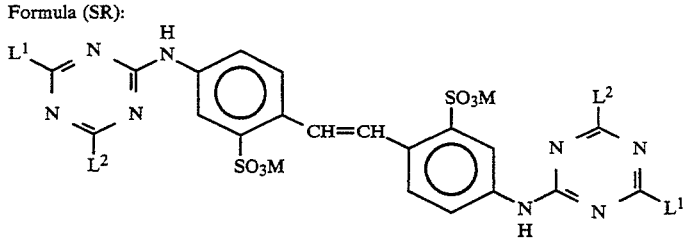

wherein $L^1$ and $L^2$ may be the same or different from each other and each represent $—OR^1$ or $—NR^2R^3$ (each of $R^1$, $R^2$ and $R^3$ being a hydrogen atom or an alkyl group) which satisfies at least one of the following conditions (1) and (2):

(1) four substituents $L^1$ and $L^2$ in the formula [SR] have at least four substituents in total selected from the groups of the formulae [A], and (2) four substituents $L^1$ and $L^2$ in the formula [SR] have two substituents in total selected from the groups of the formulae [A] and at least two substituents in total selected from the groups of the formulae [B].

General formulae A: $—SO_3M$, $—OSO_3M$, —COOM, $—NR_3X$

General formulae B: —OH, $—NH_2$, —CN, $—NHCONH_2$

In the formula [A], X represents a halogen atom and R represents an alkyl group. In the formulae [SR]and [A], M represents a hydrogen atom, alkaline earth metal, ammonium or pyridinium.

The detailed description will be made on the formula [SR].

In the formula [SR], $L^1$ and $L^2$ each represent $—OR^1$ or $—NR^2R^3$, each of $R^1$, $R^2$ and $R^3$ being an alkyl group which can be the same or different from one another. The alkyl group may be either linear or branched, and hydrogen atoms of the alkyl group may be replaced with other substituents. Although the substituents are not particularly limited, they are preferably those selected from the above-mentioned formulae [A] and [B]. The alkyl groups represented by $R^1$, $R^2$ and $R^3$ have preferably 1 to 10 carbon atoms, more preferably 1 to 5 carbon atoms.

The substituents in the formulae [A] and [B] are those generally known as hydrophilic groups. Particularly the substituents in the formulae [A] are those known as strongly hydrophilic groups.

In the present invention, the compounds represented by the above mentioned formula [SR] has $L^1$ and $L^2$ which satisfy at least one of the above-described conditions (1) and (2). The compound of the formula [SR] is symmetric, since the two triazine rings in the molecule have $L^1$ and $L^2$. In particular, it has a two-fold axis of rotation which is perpendicular to the molecular plane at the center of the molecule (center on the double bond). In other words, its symmetric properties belong to so-called $C_{2h}$ point group.

The condition (1) is that four substituents $L^1$ and $L^2$ in the formula [SR] have at least four substituents in total selected from the groups of the formula [A].

When the condition (1) is satisfied, at least six strongly hydrophilic groups are contained in the molecule including the two sulfo groups of the benzene ring constituting stilbene in the compound of the formula [SR].

The number of the substituents selected from the groups of the formula [A] is preferably an even number. It is preferably not larger than 8, particularly not larger than 6.

Thus a too large or too small number of the substituents is undesirable, since it impairs the effect of inhibiting the residual color.

The condition (2) is that four substituents $L^1$ and $L^2$ in the formula [SR] have two substituents in total selected from the groups of the formulae [A] and at least two substituents in total selected from the groups of the formulae [B]. When the condition (2) is satisfied, at least four strongly hydrophilic groups in total and at least two hydrophilic groups in total are contained in the molecule including the two sulfo groups of the benzene ring constituting stilbene in the compound of the formula [SR].

The number of the substituents selected from the groups of the formulae [B] is preferably an even number. It is preferably not larger than 10, particularly not larger than 4.

Thus a too large or too small number of the substituents is undesirable, since it impairs the effect of inhibiting the residual color.

Among the compounds represented by the above-mentioned formula [SR] in the present invention, preferred are those which satisfy the conditions (1) among the conditions (1) and (2).

The compounds represented by the formula [SR] having the strongly hydrophilic groups which satisfy the above-described conditions (1) or (2) are those having a structure well known as that of stilbene fluorescent brighteners. However, the fluorescent brighteners having at least four strongly hydrophilic substituents in the molecular such as compounds (I-30) and (I-31) described in J.P. KOKAI No. Sho 62-257154 and compound (Comparative-1) described in J.P. KOKAI No. Hei 4-249243 are characterized in that the two triazine rings in the molecule each have an anilino group. Further, no compound satisfying either conditions (1) or (2) has been known in the ordinary stilbene fluorescent brighteners in which the triazine ring has no anilino group.

The stilbene fluorescent brighteners of the above-mentioned formula [SR] which satisfy either conditions (1) or (2) of the present invention are characterized in that the triazine rings are free from the anilino group but have the strongly hydrophilic groups as the above-described substituents $L^1$ and $L^2$. Another difference between them and the fluorescent brighteners described in J.P. KOKAI No. Hei 4-249243 is that the former has the symmetrical structure as described above.

The substituents $L^1$ and $L^2$ in the compound of the formula [SR] in the present invention have the above-described characters. Examples of the substituents $L^1$ and $L^2$ include methoxy group, ethoxy group, propoxy group, isopropoxy group, butoxy group, isobutoxy group, pentyloxy group, hexyloxy group, methylamino group, ethylamino group, propylamino group, isopropylamino group, butylamino group, isobutylamino group, 2-hydroxyethoxy group, 3-hydroxypropoxy group, 4-hydroxybutoxy group, 2-hydroxyethylamino group, 3-hydroxypropylamino group, 4-hydroxybutylamino group, 2-hydroxyethylethylamino group, 3-hydroxypropylpropylamino group, 4-hydroxybutylbutylamino group, dimethylamino group, diethylamino group, dipropylamino group, diisopropylamino group, dibutylamino group, diisobutylamino group, di-2-hydroxyethylamino group, di-3-hydroxypropylamino group, dihydroxybutylamino group, 2-sulfoethoxy group, 3-sulfopropoxy group, 4-sulfobutoxy group, 2-sulfoethylamino group, 3-sulfopropylamino group, 4-sulfobutylamino group, di-2-sulfoethylamino group, di-3-sulfopropylamino group, di-4-sulfobutylamino group, 2-sulfoethylmethylamino group, 3-sulfopropylmethylamino group, 4-sulfobutylmethylamino group, 2-sulfoethylethylamino group, 3-sulfopropylethylamino group, 4-sulfobutylethylamino group, 2-carboxyethoxy group, 3-carboxypropoxy group, 4-carboxybutoxy group, 2-carboxyethylamino group, 3-carboxypropylamino group, 4-carboxybutylamino group, di-2-carboxyethylamino group, di-3-carboxypropylamino group, di-4-carboxybutylamino group, 2-carboxyethylmethylamino group, 3-carboxypropylmethylamino group, 4-carboxybutylmethylamino group, 2-carboxyethylethylamino group, 3-carboxypropylethylamino group, 4-carboxybutylethylamino group, 2-sulfoethoxy group, 3-sulfoxypropoxy group, 4-sulfoxybutoxy group, 2-sulfoxyethylamino group, 3-sulfoxypropylamino group, 4-sulfoxybutylamino group, di-2-sulfoxyethylamino group, di-3-sulfoxypropylamino group, di-4-sulfoxybutylamino group, 2-sulfoxyethylmethylamino group, 3-sulfoxypropylmethylamino group, 4-sulfoxybutylmethylamino group, 2-sulfoxyethylethylamino group, 3-sulfoxypropylethylamino group, 4-sulfoxybutylethylamino group, trimethylammoniomethylamino group, trimethylammonioethylamino group, trimethylammoniopropylamino group, triethylammoniomethylamino group, triethylammonioethylamino group and triethylammoniopropylamino group.

Among them, particularly preferred are methoxy group, ethoxy group, 2-hydroxyethoxy group, 2-hydroxyethylamino group, 2-sulfoethylamino group, di-2-sulfoethylamino group, 2-carboxyethylamino group, di-2-carboxyethylamino group and di-2-hydroxyethylamino group. The preferred hydrophilic properties of the compound of the above-mentioned formula [SR] in the present invention are those represented by log P in the range of −30 to −4, particulfarly −18 to −7. The term "log P" herein is defined to be a logarithmic value of the partition ratio P [i.e. (concentration in octanol)/(concentration in water)] of the compound in the octanol/water two-component system. When log P is above −4, the crystallization in the processing solution becomes serious during the storage at a low temperature. When it is below −30, the residual color-improving effect of the brightening agent is only slight unfavorably, though the mechanism has not been fully elucidated.

The compounds of the above-mentioned formula [SR] in the present invention have desirably a high diffusion coefficient in the gelatin membrane under various processing conditions. For example, the diffusion coefficient in an aqueous solution of pH 5 is preferably at least $10\times10^9$ cm$^2$/sec, more preferably at least $20\times10^9$ cm$^2$/sec. In an aqueous solution of pH 10, the diffusion coefficient is preferably at least $20\times10^9$ cm$^2$/sec, more preferably at least $50\times10^9$ cm$^2$/sec. The diffusion coefficient can be determined by monitoring the penetration and diffusion of the molecules of the fluorescent brightening agent in the aqueous solution thereof into the adjacent water through the gelatin membrane with a spectrophotometer. This process is concretely described in Journal of Polymer Science, Vo. 30, 2075 (1985).

As for the concrete structure of the diaminostilbene fluorescent brighteners of the above-mentioned formula [SR] used in the present invention, those wherein $L^1$ and $L^2$ represent groups given in the following Tables are included, which by no means limit the present invention:

TABLE 1

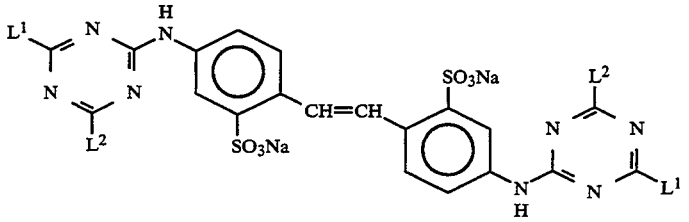

| Compound No. | $L^1$ | $L^2$ |
|---|---|---|
| SR-1 | $-NHCH_2CH(CH_3)SO_3Na$ | $-NHCH_2CH(CH_3)SO_3Na$ |
| SR-2 | $-OC_2H_4OSO_3Na$ | $-OC_2H_4OSO_3Na$ |

TABLE 1-continued

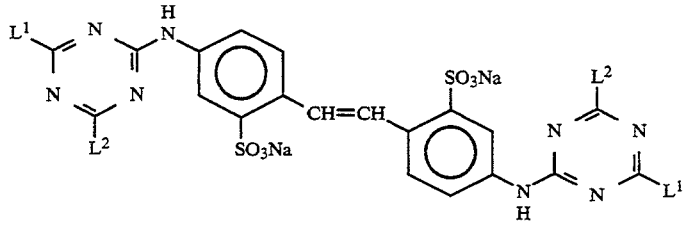

| Compound No. | $L^1$ | $L^2$ |
|---|---|---|
| SR-3 | $-N(C_2H_4OSO_3Na)_2$ | $-N(C_2H_4OSO_3Na)_2$ |
| SR-4 | $-OC_2H_4SO_3H$ | $-OC_2H_4SO_3H$ |
| SR-5 | $-NHC_2H_4SO_3H$ | $-NHC_2H_4SO_3H$ |
| SR-6 | $-NHC_2H_4SO_3(NH_4)$ | $-NHC_2H_4SO_3(NH_4)$ |
| SR-7 | $-NHC_2H_4COOH$ | $-NHC_2H_4COOH$ |
| SR-8 | " | $-NHC_2H_4SO_3Na$ |
| SR-9 | $-NHC_2H_4COONa$ | $-NHC_2H_4COONa$ |
| SR-10 | " | $-NHC_2H_4SO_3Na$ |
| SR-11 | $-N(CH_3)_3Cl$ | $-N(CH_3)_3Cl$ |

TABLE 2

| Compound No. | $L^1$ | $L^2$ |
|---|---|---|
| SR-12 | $-OC_2H_4SO_3Na$ | $-OC_2H_4SO_3Na$ |
| SR-13 | $-NHC_2H_4SO_3Na$ | $-NHC_2H_4SO_3Na$ |
| SR-14 | $-N(CH_3)(C_2H_4SO_3Na)$ | $-N(CH_3)(C_2H_4SO_3Na)$ |
| SR-15 | $-N(C_2H_5)(C_2H_4SO_3Na)$ | $-N(C_2H_5)(C_2H_4SO_3Na)$ |
| SR-16 | $-N(C_2H_4SO_3Na)_2$ | $-N(C_2H_4SO_3Na)_2$ |
| SR-17 | $-N(C_2H_4SO_3Na)_2$ | $-OCH_3$ |
| SR-18 | " | $-OH$ |

TABLE 2-continued

| Compound No. | $L^1$ | $L^2$ |
|---|---|---|
| SR-19 | " | $-OC_2H_4OH$ |
| SR-20 | " | $-NH_2$ |
| SR-21 | " | $-NHC_2H_4OH$ |
| SR-22 | " | $-OC_2H_4NH_2$ |
| SR-23 | " | $-NHC_2H_4N(CH_3)_2$ |
| SR-24 | $-NHC_2H_4SO_3Na$ | $-OC_2H_4SO_3Na$ |
| SR-25 | " | $-N(CH_3)(C_2H_4SO_3Na)$ |
| SR-26 | " | $-N(C_2H_4OSO_3Na)_2$ |
| SR-27 | " | $-NHC_2H_4COONa$ |

TABLE 3

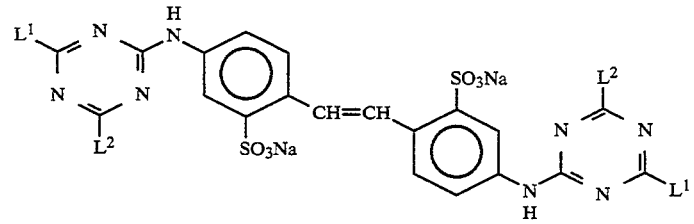

| Compound No. | $L^1$ | $L^2$ |
|---|---|---|
| SR-28 | $-OC_2H_4SO_3Na$ | $-OH$ |
| SR-29 | " | $-OC_2H_4NH_2$ |
| SR-30 | " | $-OCH_2CH(OH)CH_3$ |
| SR-31 | " | $-OC_2H_4OH$ |
| SR-32 | " | $-NH_2$ |

TABLE 3-continued

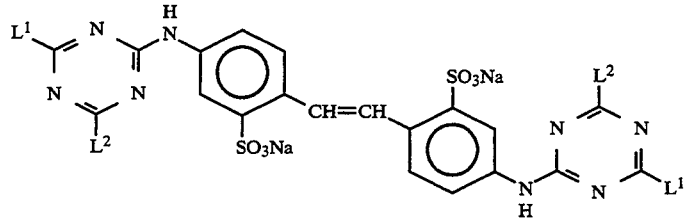

| Compound No. | $L^1$ | $L^2$ |
|---|---|---|
| SR-33 | " | $-N(C_2H_4OH)_2$ |
| SR-34 | " | $-NHC_2H_4OH$ |
| SR-35 | $-NHC_2H_4SO_3Na$ | $-OH$ |
| SR-36 | " | $-OC_2H_4NH_2$ |
| SR-37 | " | $-OCH_2CH(OH)CH_3$ |
| SR-38 | " | $-OC_2H_4OH$ |
| SR-39 | " | $-NH_2$ |
| SR-40 | " | $-N(C_2H_4OH)_2$ |
| SR-41 | " | $-NHC_2H_4OH$ |

TABLE 4

| Compound No. | $L^1$ | $L^2$ |
|---|---|---|
| SR-42 | $-NHC_2H_4SO_3Na$ | $-N(CH_3)(C_2H_4OH)$ |
| SR-43 | " | $-NHC_2H_4NHCONH_2$ |
| SR-44 | " | $-NHCH(CH_3)CH_2OH$ |
| SR-45 | " | $-N(C_2H_4OH)_2$ |
| SR-46 | " | $-NHC_2H_4COONa$ |
| SR-47 | $-NHC_2H_4SO_3H$ | $-OH$ |
| SR-48 | " | $-OC_2H_4NH_2$ |
| SR-49 | " | $-OCH_2CH(OH)CH_3$ |
| SR-50 | " | $-OC_2H_4OH$ |
| SR-51 | " | $-NH_2$ |
| SR-52 | " | $-N(C_2H_4OH)_2$ |
| SR-53 | " | $-NHC_2H_4OH$ |
| SR-54 | " | $-N(C_2H_4OH)_2$ |

TABLE 5

| Compound No. | $L^1$ | $L^2$ |
|---|---|---|
| SR-55 | $-N(CH_3)(C_2H_4SO_3Na)$ | $-OH$ |

TABLE 5-continued

| Compound No. | $L^1$ | $L^2$ |
|---|---|---|
| SR-56 | " | $-OC_2H_4NH_2$ |
| SR-57 | " | $-OC_2H_4OH$ |
| SR-58 | " | $-NHC_2H_4OH$ |
| SR-59 | " | $-N(C_2H_4OH)_2$ |
| SR-60 | $-OC_2H_4OSO_3Na$ | $-OH$ |
| SR-61 | " | $-OC_2H_4NH_2$ |
| SR-62 | " | $-OC_2H_4COOH$ |
| SR-63 | " | $-NH_2$ |
| SR-64 | " | $-NHC_2H_4OH$ |
| SR-65 | " | $-N(C_2H_4OH)_2$ |
| SR-66 | $-NHC_2H_4COONa$ | $-OH$ |
| SR-67 | " | $-OC_2H_4NH_2$ |
| SR-68 | " | $-OC_2H_4OH$ |

TABLE 6

| Compound No. | $L^1$ | $L^2$ |
|---|---|---|
| SR-69 | $-NHC_2H_4COONa$ | $-NH_2$ |
| SR-70 | " | $-N(C_2H_4OH)_2$ |
| SR-71 | " | $-NHC_2H_4OH$ |

The compounds represented by the formula [SR] can be synthesized by a method well known in the art. For example, they can be synthesized by condensing 4,4'- diaminostilbene-2,2'-disulfonic acid with cyanuric chloride to form 4,4'-bistriazinylaminostilbene-2,2'-disulfonic acid and then condensing this product with an alcohol or amine. Concretely, they can be synthesized by methods which will be described below.

Examples of the synthesis of the fluorescent brighteners are given below.

Synthesis of compound (SR-13):

10.2 g of cyanuric chloride was dissolved in 100 ml of acetone. 100 g of 10% aqueous sodium diaminostilbenesulfonate solution was added dropwise to the resultant solution under cooling with ice for 20 min while pH of the reaction solution was kept at 5 to 7 with an aqueous sodium carbonate solution. The mixture was stirred for additional 30 min and then 100 g of 18% aqueous taurine solution was added to thereto. The resultant mixture was heated to distill off acetone, and the reaction mixture was stirred for 3 hours while the inner temperature was kept at 95° C. and the pH of the reaction liquid was kept at 6 or above with an aqueous sodium carbonate solution. After the completion of the reaction followed by cooling and salting out, 12 g of pale yellow crystals were obtained. According to mass spectrum and NMR, the product was identified with compound (SR-13).

$\lambda_{max}$=348 nm($\epsilon$=4.65×10$^4$, $H_2O$).

Synthesis of compound (SR-25):

10.2 g of cyanuric chloride was dissolved in 100 ml of acetone. 100 g of 10% aqueous sodium diaminostilbenesulfonate solution was added dropwise to the resultant solution under cooling with ice for 20 min while the pH of the reaction solution was kept at 5 to 7 with an aqueous sodium carbonate solution. The mixture was stirred for additional 30 min, the inner temperature was elevated to 40° C. and then 35 g of 18% aqueous taurine solution was added to thereto. The resultant mixture was heated for 1 hour and acetone was distilled off. 50 g of 20% aqueous N-methyltaurine solution was added thereto, and the reaction mixture was stirred for 3 hours while the inner temperature was kept at 95° C. and the pH of the reaction liquid was kept at 6 or above with an aqueous sodium carbonate solution. After the completion of the reaction followed by cooling and salting out, 8.3 g of pale yellow crystals were obtained. According to mass spectrum and NMR, the product was identified with compound (SR-25).

$\lambda_{max}$=345 nm($\epsilon$=4.38×10$^4$, $H_2O$).

Other compounds and comparative compounds can be easily synthesized in the same manner as that described above.

A method for the synthesis is described in Kogyo Kagaku Zasshi, Vo. 60, No. 5, 604 (1957).

The compounds of the formula [SR] are usable either singly or in combination with other diaminostilbene compounds. In the latter case, the compounds to be used in combination with them are preferably also the compounds of the formula [SR] or diaminostilbene compounds of the following formula [SR-c]:

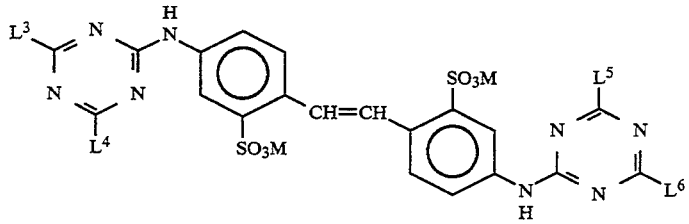

wherein $L^5$, $L^6$, $L^7$ and $L^8$ may be the same or different from each other and each represent —$OR^8$ or —$NR^9R^{10}$, $R^8$, $R^9$ and $R^{10}$ each being a hydrogen atom, alkyl group or substituted alkyl group.

Examples of the compounds represented by the formula [SR-c] include those given in Table 7.

TABLE 7

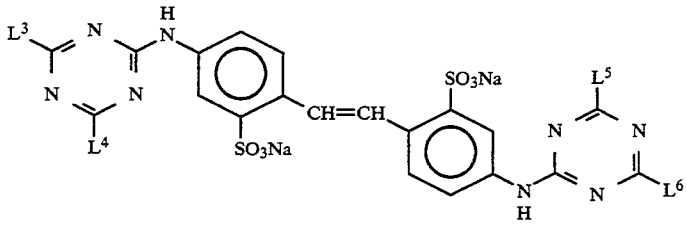

| Compound No. | $L^3$ | $L^4$ | $L^5$ | $L^6$ |
|---|---|---|---|---|
| B-1 | —$NHC_2H_4SO_3Na$ | —$OCH_3$ | —$OCH_3$ | —N(—$C_2H_4OH$)(—$C_2H_4OH$) |
| B-2 | —$NHC_2H_4SO_3Na$ | —$OCH_3$ | —$OCH_3$ | —$NHC_2H_4OH$ |
| B-3 | —$NHC_2H_4SO_3Na$ | —$NHC_2H_5$ | —$NHC_2H_5$ | —$NHC_2H_4OH$ |
| B-4 | —$NHC_2H_4OH$ | —$NHC_2H_4OH$ | —$NHC_2H_4OH$ | —$NHC_2H_4OH$ |
| B-5 | —$OC_2H_4OH$ | —$OC_2H_4OH$ | —$OC_2H_4OH$ | —$OC_2H_4OH$ |
| B-6 | —$OC_2H_4OH$ | —OH | —OH | —$OC_2H_4OH$ |
| B-7 | —$OC_2H_4OH$ | —$NH_2$ | —$NH_2$ | —$OC_2H_4OH$ |
| B-8 | —$OC_2H_4OH$ | —$OCH_3$ | —$OCH_3$ | —$OC_2H_4OH$ |
| B-9 | —$OC_2H_4OH$ | —$OC_2H_4NH_2$ | —$OC_2H_4NH_2$ | —$OC_2H_4OH$ |

TABLE 7-continued

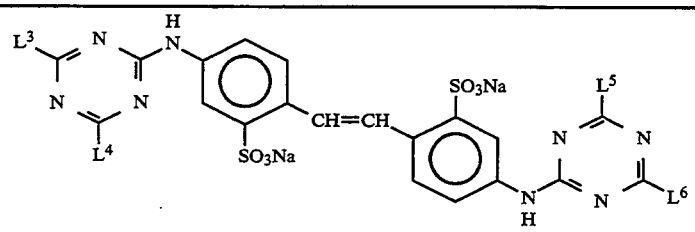

| Compound No. | $L^3$ | $L^4$ | $L^5$ | $L^6$ |
|---|---|---|---|---|
| B-10 | $-NHC_2H_4OH$ | $-OC_2H_5$ | $-OC_2H_5$ | $-NHC_2H_4OH$ |
| B-11 | $-OC_2H_4OH$ | $-NHC_2H_5$ | $-NHC_2H_5$ | $-OC_2H_4OH$ |
| B-12 | $-N(C_2H_5)(C_2H_4OH)$ | $-OH$ | $-OH$ | $-N(C_2H_5)(C_2H_4OH)$ |

The fluorescent brighteners usable in combination with the compounds of the formula [SR] include commercially available diaminostilbene fluorescent brighteners. They are described in, for example, "Senshoku Note (Dyeing Notebook)" (published by Shikisen-sha), pp. 165 to 168. Among the products described therein, preferred are Whitex RP and Whitex BRF liq.

If necessary, various surfactants are also usablle. Examples of the surfactants include compounds of formulae (I) and (II) given in J.P. KOKAI No. Hei 4-195037 and compounds of formulae (I) to (X) given in J.P. KOKAI No. Hei 4-81750.

It is desirable to control the surface tension of the color developer and color developer replenisher at 20 to 60 dyne/cm by the addition of such a compound.

The processing temperature for the color developer is 20° to 50° C., preferably 30° to 45° C. in the present invention. The processing time is 20 sec to 5 min, preferably 30 sec to 2 min.

The description will be made on the desilverization step in the present invention.

The desilverization step comprises a combination of bleaching step, fixing step and bleach/fixing step. Typical examples of them are as follows:

(1) bleaching—fixing,
(2) bleaching—bleach/fixing,
(3) bleaching—bleach/fixing—fixing,
(4) bleaching—washing with water—fixing,
(5) bleach/fixing, and
(6) bleaching—bleach/fixing.

The combination of the steps (5) are particularly preferred in the present invention.

The description will be made on the processing solutions having the bleaching function (including bleaching solution and bleach-fixing solution). The processing solutions having the bleaching function should contain 0.01 to 1 mol, preferably 0.03 to 0.5 mol and particularly 0.05 to 0.5 mol, of a bleaching agent per liter of the solution.

The bleaching agents to be contained in the processing solutions having the bleaching function include Fe (III), Co (III) or Mn (III) chlates of compounds which will be described below, as well as persulfates (such as peroxodisulfates), hydrogen peroxide and bromates.

The compounds capable of forming the chelate bleaching agents include ethylenediaminetetraacetic acid, diethylenetriaminepentaacetic acid, ethylenediamine-N-(β-hydroxyethyl)-N,N',N'-triacetic acid, 1,2-diaminopropanetetraacetic acid, 1,3-diaminopropanetetraacetic acid, nitrilotriacetic acid, nitrilo-N-2-carboxy-N,N-diacetic acid, N-(2-acetamido)iminodiacetic acid, cyclohexanediaminetetraacetic acid, iminodiacetic acid, dihydroxyethylglycine, ethyl ether diaminetetraacetic acid, glycol ether diaminetetraacetate, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid and 1,3-propylenediamine-N,N,N',N'-tetramethylenephosphonic acid as well as sodium salts and ammonium salts of them. Among them, particularly preferred are 1,3-diaminopropanetetraacetic acid, nitrilo-N-2-carboxy-N,N-diacetic acid, N-(2-acetamido)iminodiacetic acid and ethylenediaminetetraacetic acid.

The processing solution having the bleaching function preferably contains a halide such as a chloride, bromide or iodide as a rehalogenating agent for accelerating the oxidation of silver. It is also possible to replace the halide with an organic ligand capable of forming a difficultly soluble silver salt. The silver halide is added in the form of an alkali metal salt or ammonium salt, or guanidine salt or amine salt. Examples of them include potassium bromide, sodium bromide, ammonium bromide, potassium chloride and guanidine hydrochloride. Preferred are potassium bromide and sodium bromide. The amount of the rehalogenating agent in the bleaching solution is not more than 2 mol/l, preferably 0.01 to 2.0 mol/l, and more preferably 0.1 to 1.7 mol/l.

The bleach-fixing solution contains a fixing agent which will be described below and it can contain any of compounds which can be added to the fixing solution as will be described below. If necessary, the bleach-fixing solution can contain the above-described rehalogenating agent. The amount of the rehalogenating agent in the bleach-fixing solution is 0.001 to 2.0 mol/l, preferably 0.001 to 1.0 mol/l.

The bleaching solution or bleach-fixing solution in the present invention can further contain, if necessary, a bleaching accelerator, anticorrosive for inhibiting the corrosion of the processing tank, buffer for keeping pH of the solution, fluorescent brightener and defoaming agent.

The bleaching accelerators usable herein include, for example, compounds having a mercapto group or disulfido group described in U.S. Pat. No. 3,893,858, German Patent No. 1,290,812, U.S. Pat. No. 1,138,842, J.P. KOKAI No. Sho 53-95630 and Research Disclosure No. 17129 (1978); thiazolidine derivatives described in J.P. KOKAI No. Sho 50-140129; thiourea derivatives described in U.S. Pat. No. 3,706,561; polyethylene oxides described in German Patent No. 2,748,430; polyamine compounds described in J.P. KOKOKU No. Sho 45-8836; and imidazole compounds described in J.P. KOKAI No. Sho 49-40493. Among them, the mercapto compounds described in U.S. Pat. No. 1,138,842 are preferred.

The anticorrosive agent is preferably a nitrate such as ammonium nitrate, sodium nitrate or potassium nitrate. The amount of the anticorrosive agent is 0.01 to 2.0 mol/l, preferably 0.05 to 0.5 mol/l.

In the bleaching solution or bleach-fixing solution in the present invention, the total ammonium ion concentration is preferably not above 0.3 g-ion/l. Such a limitation of the total ammonium ion concentration is preferred from the viewpoints of the image preservation and prevention of environmental pollution. It is more preferably not above 0.1 mol/l in the present invention.

The pH of the bleaching solution or bleach-fixing solution in the present invention is 2.0 to 8.0, preferably 3.0 to 7.5. When the bleaching or bleach-fixing is conducted immediately after the color development, pH of the solution is preferably 7.0 or below, more preferably 6.4 or below in order to inhibit bleach fog. The pH of the bleaching solution is particularly preferably 3.0 to 5.0. When the pH is below 2.0, the metal chelate of the present invention is unstable. Thus the preferred pH range is 2.0 to 6.4.

The buffering agent for controlling the pH may be any of those which are not easily oxidized by the bleaching agent and capable of exhibiting the buffering effect in the above-described pH range. The buffering agents include organic acids such as acetic acid, glycolic acid, lactic acid, propionic acid, butyric acid, malic acid, chloroacetic acid, levulinic acid, ureidopropionic acid, oxalic acid, malonic acid, succinic acid, glutaric acid, maleic acid, fumaric acid, citraconic acid, itaconic acid, β-hydroxypropionic acid, tartaric acid, citric acid, oxaloacetic acid, diglyucolic acid, benzoic acid and phthalic acid; and organic bases such as pyridine, dimethylpyrazole, 2-methyl-o-oxazoline and aminoacetonitrile. The buffering agents can be used either singly or in the form of a combination of two or more of them. Organic acids having pKa of 2.0 to 5.5 are preferred, and particularly preferred are acetic acid and glycolic acid, which are used either singly or in combination of them. The buffering agents are used in a total amount of at most 3.0 mol, preferably 0.1 to 2.0 mol, per liter of the bleaching solution.

For controlling pH of the solution having the bleaching function in the above-described range, the above-described acids may be used in combination with an alkali such as ammonia water, KOH, NaOH, imidazole, monoethanolamine or diethanolamine. Among them, KOH is preferred.

In the bleaching or bleach-fixing step, the temperature can be in the range of 30° to 60° C., preferably 35° to 50° C.

The bleaching and/or bleach-fixing time is in the range of 10 sec to 2 min, preferably 10 sec to 1 min, more preferably 15 sec to 45 sec. Under these preferred conditions, the excellent results can be rapidly obtained without increasing the stain.

The bleach-fixing solution or fixing solution contains a well-known fixing agent. The fixing agents are thiosulfates, thiocyanates, thioethers, amines, mercapto compounds, thion compounds, thioureas, iodides, mesoionic compounds, etc. They include, for example, ammonium thiosulfate, sodium thiosulfate, potassium thiosulfate, guanidine thiosulfate, potassium thiocyanate, dihydroxyethyl thioether, 3,6-diathi-1,8-octanediol and imidazole. Among them, the thiosulfuric salts, particularly ammonium thiosulfate, are preferred for the rapid fixing. The fixing can be conducted more rapidly by using a combination of two or more fixing agents. For example, it is preferred to use ammonium thiosulfate in combination with ammonium thiocyanate, imidazole, thiourea or thioether. In such a case, the latter fixing agent is used preferably in an amount of 0.01 to 100 molar % based on ammonium thiosulfate.

The fixing agent is used in an amount of 0.1 to 3.0 mol, preferably 0.5 to 2.0 mol, per liter of the bleach-fixing solution or fixing solution. pH of the fixing solution which varies depending on the kind of the fixing agent is usually 3.0 to 9.0. When a thiosulfate is used, pH of 6.5 to 8.0 is particularly preferred for obtaining a high stability.

A preservative can be incorporated into the bleach-fixing solution or fixing solution in order to improve the storability of the solution. When the bleach-fixing solution or the fixing solution contains a thiosulfate, effective preservatives therefor are sulfites and/or hydrogensulfite adducts of hydroxylamines, hydrazines and aldehydes (such as acetaldehyde/hydrogensulfite adducts, and particularly preferably aromatic aldehyde/hydrogensulfite adducts described in J.P. KOKAI No. Hei 1-298935). Sulfinic acid compounds described in J.P. KOKAI No. Sho 62-143048 are also preferred.

The detailed description will be made on the sulfinic acids and salts of them. They are represented by the formula (S):

$$R(SO_2M)_n$$

wherein R represents an alkyl group, alkenyl group, aralkyl group, cycloalkyl group, aryl group or heterocyclic group, M represents a cation, and n represents 1 or 2.

The detailed description will be given on the formula (S). R in this formula represents a substituted or unsubstituted alkyl group (such as methyl, ethyl, n-propyl, hydroxyethyl, sulfoethyl, carboxyethyl or methoxyethyl group), a substituted or unsubstituted alkenyl group (such as allyl or butenyl group), a substituted or unsubstituted aralkyl group (such as benzyl, phenethyl, 4-carboxyphenylmethyl group or 3-sulfophenylmethyl group), a substituted or unsubstituted cycloalkyl group (such as cyclohexyl group), a substituted or unsubstituted aryl group [such as phenyl, 4-methylphenyl, naphthyl, 3-carboxyhenyl, 4-methoxyphenyl, 3-sulfophenyl, 4-carboxymethoxyphenyl, 3-carboxymethoxyphenyl, 4-carboxyethoxyphenyl, 4-sulfoethoxyphenyl, 4-carboxymethylphenyl or 4-(N-carboxymethyl-N-methyl)-phenyl group), or a substituted or unsubstituted heterocyclic group (such as pyridyl, furyl, thienyl, pyrazolyl or indolyl group). M in this formula represents a cation (such as a hydrogen atom, alkali metal, alkaline earth metal, nitrogen-containing organic base or ammonium group).

The alkali metals include Na, K, Li, etc. The alkaline earth metals include Ca, Ba, etc. The nitrogen-containing organic bases include ordinary amines capable of forming a salt with sulfinic acid. The ammonium groups include the unsubstituted ammonium group, tetramethylammonium group, etc. When R in the formula (S) has a substituent, the substituent is selected from among nitro group, halogen atoms (such as chlorine and bromine atoms), cyano group, alkyl groups (such as methyl, ethyl, propyl, carboxymethyl, carboxyethyl, carboxypropyl, sulfoethyl, sulfopropyl and dimethylaminoethyl groups), aryl groups (such as phenyl, naphthyl, carboxyphenyl and sulfophenyl groups), alkenyl groups (such as allyl, and butenyl groups), aralkyl groups (such as benzyl and phenethyl groups), sulfonyl groups (such as methanesulfonyl and p-toluenesulfonyl groups), acyl groups (such as acetyl and benzoyl groups), carbamoyl groups (such as unsubstituted carbamoyl and dimethylcarbamoyl groups), sulfamoyl groups (such as unsubstituted sulfamoyl, methylsulfamoyl and dimethylsulfamoyl groups), carbonamido groups (such as acetamido and benzamido groups), sulfonamido groups (such as methanesulfonamido and benzenesulfonamido groups), acyloxy groups (such as acetyloxy and benzoyloxy groups), sulfonyloxy groups (such as methanesulfonyloxy group), ureido groups (such as unsubstituted ureido group), thioureido groups (such as unsubstituted thioureido and methylthioureido groups), carboxylic acids and salts thereof, sulfonic acids and salts thereof, hydroxy group, alkoxy groups (such as methoxy, ethoxy, carboxyethoxy, carboxymethoxy, sulfoethoxy and sulfopropyloxy groups), alkylthio groups (such as methylthio, carboxymethylthio and sulfoethylthio groups) and amino groups (such as unsubstituted amino, dimethylamino and N-carboxyethyl-N-methylamino groups).

In the above-mentioned formula (S), R is preferably a substituted or unsubstituted aryl group or a substituted or unsubstitiuted heterocyclic group. In the above-mentioned formula (S), R is more preferably an aryl group substituted with at least one of alkyl groups containing a carboxylic acid or its salt or a sulfonic acid or its salt, alkoxy groups containing a carboxylic acid or its salt or a sulfonic acid or its salt and alkylamio groups containing a carboxylic acid or its salt or a sulfonic acid or its salt.

In the above-mentioned formula (S), n is preferably 1. The above-mentioned alkyl groups, alkoxy groups and alkylamino groups have preferably 10 or less carbon atoms, more preferably 6 or less carbon atoms. At least one, preferably 1 to 3 substituents are contained. R contains preferably not more than 20 carbon atoms in total.

The aryl groups are preferably phenyl and naphthyl groups. Among them, the phenyl group is particularly desirable for preventing the phenomenon that when the replenisher A is used for the running process after storing it for a long period of time, a suspended matter is formed on the surface of the tank solution and the photosensitivity is lowered.

Examples of the compounds represented by the formula (S) are as follows:

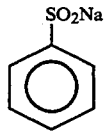

(S-1)

-continued

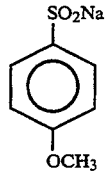

(S-2)

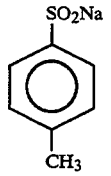

(S-3)

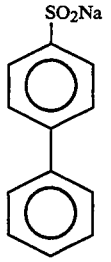

(S-4)

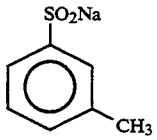

(S-5)

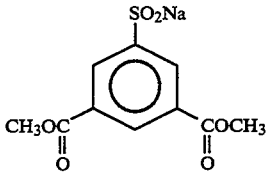

(S-6)

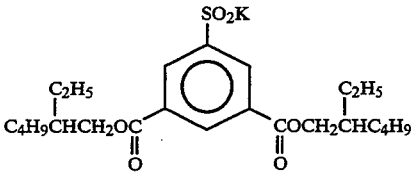

(S-7)

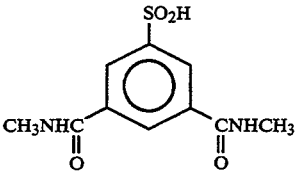

(S-8)

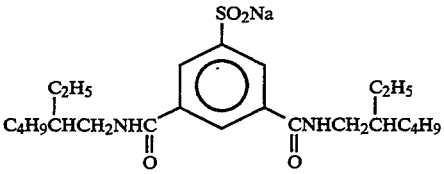

(S-9)

-continued
(S-10)
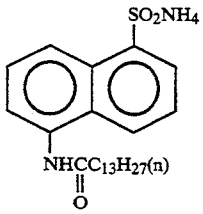
(S-11)
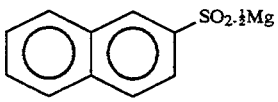
(S-12)
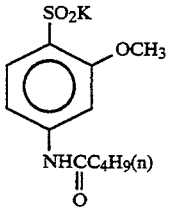
(S-13)
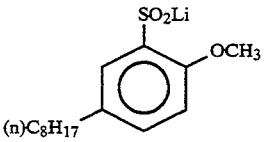
(S-14)
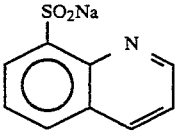
(S-15)
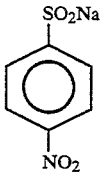
(S-16)
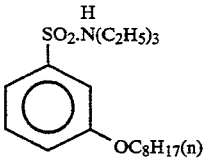
(S-17)
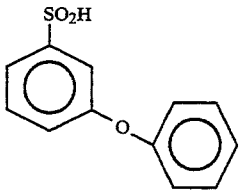
(S-18)
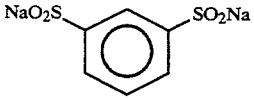
(S-19)
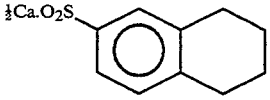
-continued
(S-20)
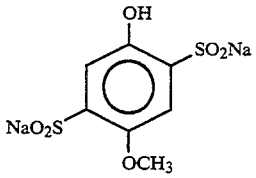
(S-21)
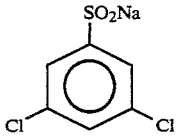
(S-22)
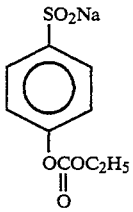
(S-23)
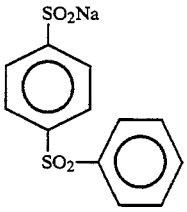
(S-24)
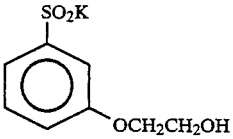
(S-25)
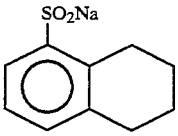
(S-26)
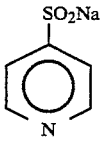
(S-27)
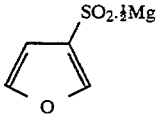
(S-28)
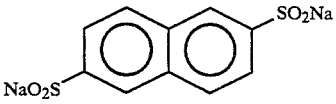
(S-29)
$(n)C_4H_9SO_2Na$
(S-30)
$C_4H_9CH(C_2H_5)SO_2X$ -continued
(S-31)
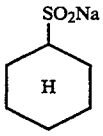
(S-32)
$CH_3OCH_2CH_2OCH_2CH_2SO_2NH_4$
(S-33)
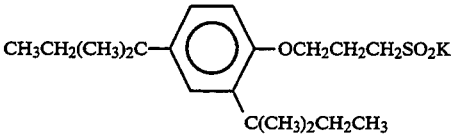
(S-34)
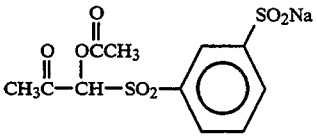
(S-35)
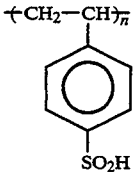
(S-36)
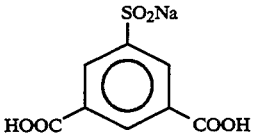
(S-37)
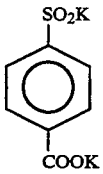
(S-38)
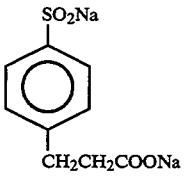
(S-39)
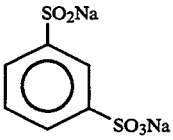
(S-40)
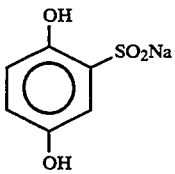
-continued
(S-41)
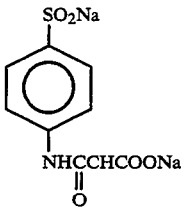
(S-42)
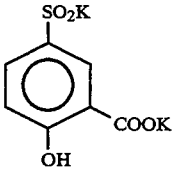
(S-43)
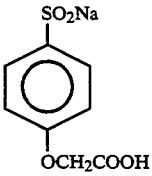
(S-44)
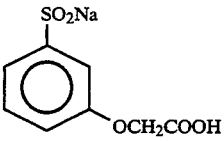
(S-45)
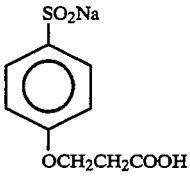
(S-46)
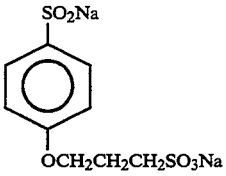
(S-47)
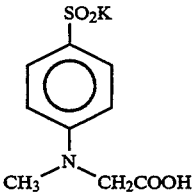
(S-48)
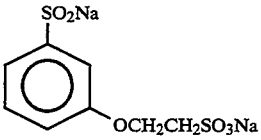
(S-49)
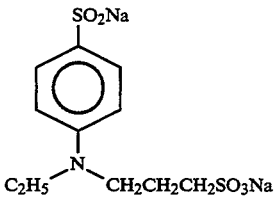

-continued

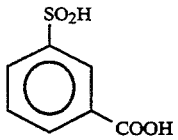

(S-50)

The compounds given above are usable either singly or in the form of a mixture of two or more of them. The sulfinic acid compounds of the present invention can be synthesized with reference to known literatures such as J. A. Chem. Soc., 72, 1215 (1950); 62, 2596 (1940); 60, 544 (1938); 56, 1382 (1934); 57, 2166 (1935); and 81, 5430 (1959); and Chem. Rev. 48, 69 (1951).

The amount of the sulfinic acid used in the present invention is 0.001 to 1.0 mol/l, preferably 0.002 to 0.2 mol/l.

It is preferred to incorporate a buffering agent into the bleach-fixing solution and fixing solution in order to maintain a constant pH. The buffering agents are, for example, phosphates; imidazoles such as imidazole per se, 1-methylimidazole, 2-methylimidazole and 1-ethylimidazole; triethanolamine; N-allylmorpholine and N-benzoylpiperazine.

By incorporating a chelating agent into the fixing solution, the iron ion brought from the bleaching solution can be sequestered to improve the stability of the solution. Preferred chelating agents include, for example, 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid and 1,2-propanediaminetetraacetic acid.

The fixing can be conducted in the temperature range of 30° to 60° C., preferably 35° to 50° C. The time necessitated for the fixing step is 5 sec to 2 min, preferably 10 sec to 1 min 40 sec, and more preferably 10 to 45 sec.

The amount of the bleaching solution to be replenished is 20 to 900 ml, preferably 20 to 550 ml and more preferably 30 to 250 ml per square meter of the photosensitive material.

The amount of the bleach-fixing solution to be replenished is 20 to 1500 ml, preferably 30 to 600 ml and more preferably 30 to 200 ml per square meter of the photosensitive material. The bleach-fixing solution can be replenished as it is, or in the form of a bleaching composition and fixing composition separately, or an overflow from the bleaching bath and that from the fixing bath can be mixed together to form the bleach-fixing replenisher.

The amount of the fixing solution to be replenished is 20 to 1500 ml, preferably 30 to 600 ml and more preferably 30 to 200 ml, per square meter of the photosensitive material.

When the overflow from the step of washing with water or the stabilization step is fed into the preceding bath having the fixing function, the amount of the waste water can be reduced favorably.

After the step wherein the fixing is conducted, the photosensitive material is usually washed with water. A simple process is also possible wherein the photosensitive material is processed with a solution having a fixing function and then stabilized with the stabilizing solution of the present invention substantially without washing with water.

The amount of the replenisher in the steps of washing with water and stabilization is 3 to 50 times, preferably 3 to 30 times and morel preferably 3 to 10 times as much as that carried over from the preceding bath per a unit area of the photosensitive material. The process of the present invention is effective when the amount of the replenisher in at least the last stabilization step is 3 to 50 times as much as that when the stabilization step follows the step of washing with water. The replenishing can be conducted either continuously or intermittently. The solutions used for the step of washing with water and/or stabilization step can be used further in the preceding step. For example, the amount of the replenisher can be saved by multistage counter-current method wherein an overflow of water used for washing is fed into the preceding bleach-fixing bath and a concentrated replenisher is fed into the bleach-fixing bath to reduce the amount of the waste water.

The amount of water used in the washing step is variable depending on the properties and use of the photosensitive material (such as starting materials, e.g. coupler), temperature of water used for washing, number of the washing tanks (number of stages), replenishing manner (countercurrent or down-flow system), etc. The number of the stages in the multi-stage counter-current method is usually preferably 2 to 6, particularly 2 to 4.

When the multi-stage counter-current method is employed, the quantity of water necessitated for the washing can be remarkably reduced. For example, it can be reduced to 0.5 to 1 liter or below per square meter of the photosensitive material. However, a problem is posed that bacteria are propagated by the elongation of the residence time of water in the tank and, therefore, the photosensitive material is stained with the suspended solids thus formed. For solving this problem, a method disclosed in J.P. KOKAI No. Sho 62-288838, for reducing the amount of calcium and magnesium is very effective.

It is also preferred to use water sterilized with a halogen, ultraviolet sterilization lamp or ozone generator.

It is preferred to incorporate an antibacterial agent or antifungal agent into the water to be used for washing and the stabilizing solution so as to prevent the formation of a water scale or formation of a mold on the processed photosensitive material. Examples of the antibacterial agents and antifungal agents include thiazolylbenzoimidazole compounds described in J.P. KOKAI Nos. Sho 57-157244 and 58-105145, isothiazolone compounds described in J.P. KOKAI No. Sho 57-8542, chlorophenol compounds typified by trichlorophenol, bromophenol compounds, organic tin compounds, organic zinc compounds, acid amide compounds, diazine and triazine compounds, thiourea compounds, benzotriazole compounds, alkylguanidine compounds, quaternary ammonium compounds typified by benzalkonium chloride, antibiotics typified by penicillin, and general-purpose antifungal agents described in J. Antibac. Antifung. Agents, Vol. 1, No. 5, pages 207 to 223 (1983), Hiroshi Sakaguchi, "Bokin Bobai no Kagaku (Chemistry for Prevention of Bacteria and Fungi)" published by Sankyo Shuppan in 1986, "Biseibutsu no Mekkin, Sakkin, Bobai Gijutsu (Techniques of Sterilization and Prevention of Fungi)" edited by Eisei Gijutsu-kai and published by Kogyo Gijutsu-kai in 1982 and "Bokin Bobaizai Jiten (Encyclopedia of Bactericides and Fungicides)" edited by Nippon Bokin Bobai Gakkai and published in 1986. They can be used either singly or in combination of two or more of them. Various fungicides described in J.P. KOKAI No. Sho 48-83820 are also usable.

Water used for washing and the stabilizing solution preferably contain a surfactant in order to prevent the formation of water spots in the drying step after the processing of the photosensitive material. The surfactants include polyethylene glycol-type nonionic surfactants, polyhydric alcohol-type nonionic surfactants, alkylbenzenesulfonate-type anionic surfactants, higher alcohol/sulfuric ester salt-type anionic surfactants, alkylnaphthalenesulfonic acid salt-type anionic surfactants, quaternary ammonium salt-type cationic surfactants, amine salt-type cationic surfactants, amino salt-type amphoteric surfactants and betaine-type amphoteric surfactants. Among them, the nonionic surfactants are prefered and alkylphenol/ethylene oxide adducts are particularly preferred. The alkylphenols are particularly preferably octylphenol, nonylphenol, dodecylphenol and dinonylphenol. The molar number of ethylene oxide added is particiularly preferably 8 to 14. Silicon surfactants having a high antifoaming effect are also preferably used.

Water used for washing and the stabilizing solution preferably contain also a chelating agent. Preferred chelating agents include aminopolycarboxylic acids such as ethylenediaminetetraacetic acid and diethylenetriaminepentaacetic acid; organic phosphonic acids such as 1-hydroxyethylidene-1,1-diphosphonic acid, ethylenediaminetetraacetic acid and diethylenetriamine-N,N,N',N'-tetramethylenephosphonic acid; and hydrolyzates of maleic anhydride polymers described in European Patent No. 345,172 A 1.

The stabilizing solution contains also compounds which stabilize the dye image, such as formalin, hexamethylenetetramine and derivatives thereof, hexahydrotriazine and derivatives thereof, dimethylolurea, N-methylol compounds such as N-methylolpyrazole, organic acids and pH buffering agents. Although these compounds are used in an amount of 0.001 to 0.02 mol per liter of the stabilizing solution, free formaldehyde concentration in the stabilizing solution is preferably as low as possible so as to minimize the amount of formaldehyde gas. From this viewpoint, preferred dye image stabilizers are hexamethylenetetramine, N-methylolazoles such as N-methylolpyrazole described in Japanese Patent Application No. Hei 3-318644, and azolylmethylamines such as N,N'-bis(1,2,4-triazol-1-yl)piperazine described in Japanese Patent Application No. Hei 3-142708. The stabilizing solution contains, if necessary, ammonium compounds such as ammonium chloride and ammonium sulfite, metal compounds such as Bi and Al compounds, fluorescent brighteners, hardeners, alkanolamines described in U.S. Pat. No. 4,786,583, and preservatives which can be incorporated into the above-described fixing solutions and bleach-fixing solutions. Among them, preferred are sulfinic acid compounds described in J.P. KOKAI No. Hei 1-231051 (such as benzenesulfinic acid, toluene sulfinic acid and sodium and potassium salts of them). They are used in an amount of preferably $1\times10^{-5}$ to $1\times10^{-3}$ mol, particularly $3\times10^{-5}$ to $5\times10^{-4}$ mol per liter of the stabilizing solution.

The amount of the replenisher in the step of washing with water or stabilization step is 50 to 2,000 ml, preferably 100 to 1,000 ml, per square meter of the photosensitive material.

For reducing the amount of the replenisher without impairing the stability of the dye image, a particularly effective process is that disclosed in J.P. KOKAI No. 3-121448 which comprises a reverse osmosis with a reverse osmosis membrane.

The pH range of the water for washing and the stabilizing solution is 4 to 10, preferably 6 to 9.

The water for washing and the stabilizing solution are used at a temperature of preferably 30° to 45° C.

The processing time is usually 10 sec to 2 min, particularly 10 to 60 min.

For the prevention of the environmental pollution, it is preferred to further reduce the amount of the replenisher by a combination of various regeneration methods. The regeneration is conducted while the processing solution is circulated in an automatic developing machine or, alternatively, the processing solution is once removed from the processing tank, then suitably regenerated and returned again as the replenisher into the processing tank.

The developer can be particularly renegerated for the reuse.

The regeneration of the developer indicates that the activity of the used developer is elevated by means of an anion exchange resin, by electrodialysis or by adding a chemical called "regenerating agent" for reusing the developer. The regeneration rate (relative amount of the overflow in the replenisher) is preferably at least 50%, particularly at lest 70%.

As for the utilization of the regenerated developer, an overflow of the developer is regenerated and then used as the replenisher. The regeneration is preferably conducted with an anion exchange resin. Particularly preferred composition of the anion exchange resin and method for the regeneration of the resin are described in "Diaion Manual (I)" (Edition 14, 1986) published by Mitsubishi Chemical Industries, Ltd. Among the anion exchange resins, those having a composition described in J.P. KOKAI Nos. Hei 2-952 and Hei 1-281152 are preferred.

From the viewpoint of the simplicity, the most desirable is a process described in J.P. KOKAI No. Hei 3-174154, wherein the overflow is treated with only a regenerating agent without conducting the treatment with the anion exchange resin or electrodialysis.

Since the metal chelate bleaching agent in the bleaching solution and/or bleach-fixing solution is reduced by the bleaching process, such a solution is preferably continuously regenerated after the process. In particular, air is blown into the bleaching solution and/or bleach-fixing solution by means of an air pump to oxidize the reduced metal chelate again (aeration). The regeneration is possible also by addition of an oxidizing agent such as hydrogen peroxide, a persulfate or a bromate.

The fixing solution and bleach-fixing solution are regenerated by electrolytic reduction of accumulated silver ion. It is also preferred for keeping the fixing function to remove the accumulated halogen ion with an anion exchange resin.

From the viewpoint of the simplicity, the most desirable is a process described in EP-479262 A 1, wherein the overflow is treated with only a regenerating agent without conducting the aeration or without removing silver ion with the anion exchange resin.

In the present invention, silver can be recovered from the processing solution having the fixing function by a known process, and the regenerated solution from which silver has been thus recovered is also usable. The effective method for recovering silver include electrolysis method (French Patent No. 2,299,667), precipitation method (J.P. KOKAI No. Sho 52-73037 and German Patent No. 2,331,220), ion exchange method (J.P. KOKAI No. 51-17114 and Geman Patent No. 2,548,237) and metal replacement method (British Patent No. 1,353,805). Such a silver recovering method is preferably conducted by an in-line method from the tank so as to further improve the rapidness.

The method of the present invention is conducted by means of an automatic developing machine. The detailed description will be made on the automatic developing machine suitable for the present invention.

In case a solution which is deteriorated when it is brought into contact with air such as the color developer, color developer replenisher, bleach-fixing soution or bleach-fixing replenisher is used, the surface of the solution (open area) to be brought into contact with air is desirably as small as possible. For example, the open rate [calculated by dividing the open area ($cm^2$) by the capacity ($cm^3$) of the solution tank] is preferably not above 0.02 ($cm^{-1}$) and not less than 0.0001 ($cm^{-1}$), more preferably not above 0.01 ($cm^{-1}$) and most preferably not above 0.01 ($cm^{-1}$) and not less than 0.001 ($cm^{-1}$).

To rapidly conducting the process of the present invention, the cross-over time (i.e. time necessitated for moving the photosensitive material in air from a processing solution into another processing solution) is desirably as short as possible. It is preferably not longer than 10 sec, still preferably not longer than 7 sec and particularly not longer than 5 sec. To conduct the cross-over in such a short time, a processing machine for motion picture film is preferably used, and that of leader carrying system is particularly preferred. Such a system is employed in an automatic processing machine FP-560B (a product of Fuji Photo Film Co., Ltd.). The linear velocity which is as high as possible is usually 30 cm/min to 30 m/min, preferably 50 cm/min to 10 m/min.

As for the leader and carrying means for the photosensitive material, a belt carrying system described in J.P. KOKAI Nos. Sho 60-191257 and Sho 60-191258 is preferred, In particular, a carrying mechanism described in Japanese Patent Application Nos. Hei 1-265794, 1-266915 and 1-266916 is preferably employed.

To reduce the cross over time and to prevent the contamination with the processing solution, the structure of the cross over rack is preferably such that has a contamination-prevention plate as described in Japanese Patent Application No. Hei 1-265795.

In the present invention, the stirring power for the respective processing solutions is as high as possible in order to exhibit more excellent effect of the present invention.

The strong stirring methods include a method described in J.P. KOKAI Nos. Sho 62-183460 and 62-183461 wherein the processing solution is jetted against an emulsion surface of the photosensitive material as employed in Color Negative Film Processor FP-560 B (a product of Fuji Photo Film Co., Ltd.); a method described in J.P. KOKAI No. Sho 62-183461 wherein the stirring effect is improved with a rotation means; a method wherein the photosensitive material (film) is moved while a wiper blade placed in the solution is brought into contact with the emulsion surface to make the emulsion surface turbulent, thereby improving the stirring effect; and a method wherein the entire circulation quantity of the processing solution is increased. Among them, the method of jetting the processing solution is most desirable. It is preferred to employ this method in all the process tanks.

In the step of processing with the processing solution having the fixing function, the effect of the present invention is remarkably improved by jetting the processing solution within 15 sec, preferably within 10 sec, and still preferably within 5 sec, after the photosensitive material has been brought into contact with the processing solution.

In a preferred embodiment of the method of jetting each processing solution, the solution is jetted through a nozzle facing the emulsion surface by means of a pump as described in an Example given from the right lower column on page 3 to the right lower column on page 4 of J.P. KOKAI No. Sho 62-183460. As the pump. Magnet Pump MD-10, MD-15, MD-20, etc. (products of Iwaki Co.) are usable. The opening diameter of the nozzle is 0.5 to 2 mm, preferably 0.8 to 1.5 mm. The nozzle is preferably positioned as perpendicularly as possible to the chamber wall and the film surface and has preferably a circular opening. However, the angle can be also 60° to 120° instead of being g perpendicular, and the opening may be rectangular or slit-shaped. The number of the nozzles is 1 to 50, preferably 10 to 30 per liter of the tank capacity. In order to prevent uneven development and residual color caused by uneven jetting of the solution against the film, the positions of the respective nozzles are preferably slided so that they are not in line in the film-moving direction to make the uniform application of the jet possible. In a preferred arrangement of the nozzles, serieses each having about 4 to 8 openings are arranged perpendicularly to the film-moving direction, and they are slided at proper distances. When the distance between the nozzle and the film is too short, the above-described unevenness is caused and, on the contrary, when it is too long, the stirring effect is insufficient. The distance is, therefore, preferably 1 to 12 mm and still preferably 3 to 9 mm.

The optimum range of the speed of the solution jetted through the nozzle is preferably 0.5 to 5 m/sec, particularly preferably 1 to 3 m/sec.

The whole processing solution may be circulated only through the nozzles or in combination of the nozzles with another circulation system. The total quantity of the circulating solution is 0.2 to 5 liters, preferably 0.5 to 4 liters, per liter of the tank capacity per min. In the desilverization steps such as bleaching, bleach-fixing and fixing steps, the quantity of the circulating solution is preferably relatively high and is in the range of 1.5 to 4 liters.

It is desirable that the automatic developing machine used for the process of the present invention has a device for aerating the bleaching solution. The aeration inhibits lowering of the bleaching velocity due to the formation of iron (II) complex or the formation of cyan leuco dye or poor color restoration during the continuous process.

In the aeration, at least 0.01 l of the solution is fed per liter of the processing tank capacity with a multi-opening nozzle having an opening diameter of 300 μm or below as described in J.P. KOKAI Nos. Hei 2-176746 and 2-176747.

In the course of the running process wherein the photosensitive material is continuously or intermittently processed while the replenisher is fed thereinto, the foaming of the bleaching solution is caused by the surfactant dissolved out of the processed photosensitive material. Thus, in the course of the aeration, foams are formed in a very large amount and often overflow the processing tank. To prevent this phenomenon, a defoaming means is preferably provided. In particular, methods described in Japanese Patent Application Nos. Hei 2-104731, 2-165367 and 2-165368 are effective.

It is preferred to feed water in an amount corresponding to that of evaporated water into the processing solutions in the present invention. The supplement of water is particularly preferred into the color developer, bleaching solution and bleach-fixing solution.

Although the method of the supplement of water is not particularly limited, preferred methods are, for example, a method disclosed in J.P. KOKAI Nos. Hei 1-254959 and 1-254960 wherein a monitoring water tank is provided in addition to the bleaching tank, the amount of evaporated water in the monitoring water tank is determined, the amount of evaporated water in the bleaching tank is calculated from that value and water in a suitable amount determined by the calculation is fed into the bleaching tank; and a method disclosed in Japanese Patent Application Nos. Hei 2-46743, 2-47777, 2-47778, 2-47779 and 2-117972 wherein a liquid level sensor or overflow sensor is used for the supplement. The most preferred method for the supplement is to add an estimated amount of water to be evaporated. The estimation is made by calculation with coefficients predetermined from the information of the operation time of the automatic developing machine, stopping time and temperature control time as described in Japanese Patent Application No. Hei 2-103894.

Various ideas are also necessary for reducing the amount of the vapor formed by the evaporation, such as reduction of the opening area and control of the air flow with an exhaust fan. For example, a preferred open rate for the color developer is as described above. It is preferred to reduce also the open area for other processing solutions.

The exhaust fan is provided in order to prevent dropwise condensation in the course of the temperature control. The preferred amount of the gas is 0.1 to 1 $m^3$, particularly 0.2 to 0.4 $m^3$, per minute.

The drying conditions of the photosensitive material also exerts an influence on the evaporation of the processing solution. A ceramic hot air heater is preferably used and the amount of air is preferably 4 to 20 $m^3$, particularly 6 to 10 $m^3$, per minute.

A thermostat for preventing the ceramic hot air heater from overheat is preferably operated by heat transfer. It is preferably positioned on the lee or on the windward through a radiating fin or heat transfer part. The drying temperature is preferably controlled depending on the water content of the photosensitive material to be processed. It is most desirably 45° to 55° C. for a film having 35 mm width and 55° to 65° C. for a Blowny film.

The replenisher is fed by means of a replenishing pump, which is preferably a bellows pump. To improve the replenishing accurary, it is effective to use a thin tube for introducing the solution into the replenishing nozzle in order to prevent the back flow caused after the pump is stopped. The inner diameter of the tube is preferably 1 to 8 mm, particularly 2 to 5 mm.

The automatic developing machine has parts made of variuos materials. The description will be made on the preferred materials.

The preferred materials for the processing tank and temperature-controlling tank are modified PPO (modified polyphenylene oxide) and modified PPE (modified polyphenylene ether). The modified PPO include, for example, "Nolyl" (a product of Nippon G.E. Plastics) and the modified PPE include, for example, "Zailon" (a product of Asahi Chemical Industry Co., Ltd.) and "Upiace" (a product of Mitsubishi Gas Chemical Co., Inc.). These materials are suitable for parts to be brought into contact with the processing solution such as processing racks and cross over.

Suitable materials for the rollers in the processing part include resins such as PVC (polyvinyl chloride), PP (polypropylene), PE (polyethylene) and TPX (polymethylpentene). These materials are also usable for other parts to be contacted with the processing solutions. The PE resin is also suitable for the replenishing tank to be produced by blow molding.

Suitable materials for the processing part, gear, sprocket and bearing include PA (polyamide), PBT (polybutylene terephthalate), UHMPE (ultra-high molecular polyethylene), PPS (polyphenylene sulfide) and LCP (liquid crystalline polymer, whole aromatic polyester resin).

The PS resins are polyamide resins such as 66 nylon, 12 nylon and 6 nylon. Those containing glass fibers and carbon fibers are also usable and they are resistant to swelling with the processing solution.

The materials having a high molecular weight such as MC nylon and compression-molded products are usable without reinforcement with fibers. The UHMPE resins are usable without reinforcement, and they include "Rubmer" and "Hyzex Million" (products of Mitsui Petrochemical Industries, Ltd.), "New Light" (Sakushin Kogyo Co., Ltd.), and "Sunfine" (Asahi Chemical Industry Co., Ltd.). The molecular weight of them is preferably at least one million and still preferably one million to five million.

The PBS resins are preferably reinforced with glass fibers or carbon fibers. The LCP resins include "Victrex" (ICI Japan), "Econol" (Sumitomo Chemical Co., Ltd.), "Zaider" (Nippon Oil Co., Ltd.) and "Vectra" (Polyplastics Co., Ltd.).

Particularly preferred material for the carrying belt are ultra-high strength polyethylene fibers and polyvinylidene fluoride resin.

Suitable soft materials for squeeze roller or the like are foaming vinyl chloride resin, foaming silicone resin and foaming urethane resin. The foaming urethane resin include "Lubicel" (Toyo Polymer Co., Ltd.).

Rubbery materials for joints of pipes, joints for agitation jet pipes and sealing materials are preferably EPDM rubber, silicone rubber and Biton rubber.

The drying time is preferably 30 sec to 2 min, particularly 40 sec to 80 sec.

The above description relates to the continuous process of the replenishing system. It is also possible in the present invention that the process is conducted with a given amount of the processing solution without any replenishment and then the processing solution is wholly or partially replaced with a fresh one to conduct the process batchwise.

The automatic developing machines preferably used in the present invention include the following ones:

Printer processors PP400, PP401B, PP540B, PP1040B, PP1270, PP1250V, PP1820V, PP2600B, PP700W; and film processors FP230B, FP350, FP550B, FP560B and FP20 (products of Fuji Photo Film Co., Ltd.);

RPV2-204, 2-206, 2-209, 2-212, 2-404, 2-406, 2-409, 2-412, 2-416, 2-430, CSR3-2070, 3-24100, 3-31100, 3-44100, 3-54100, QSS-1102V2, 1700V2, 1501, 1401, 1602, 1701V, 1702V and QSS-MICRO (products of Noritsu Koki Co.); and CL-PP1501QA, PP1721QA, PP1771VQA, PP1772VQA, PP801A/B, CL-NP30QA11, CL-KP50QA, KP32QA and NPS-103 (products of Konica Corporation).

The details of the above-described processors are described in manuals accompanying the processors. For example, the details of the printer processer PP1250V are described in an instruction manual (for managers), Edition 1 (012DC296A/Feb. 7, 1992); instruction manual (for operators), Edition 1 (012DC291A/Jan. 16, 1992); Service manual, Edition 1 (012DD291A/Jun. 20, 1992); and Parts List, Edition 2 (012DE291B/February, 1992).

The processing agents usable in the present invention can be fed in the form of a concentrate of either single solution or mixture constituted by two or more parts. It may be fed in the form of a powder or a processing solution. It is also possible to feed a combination of the concentrate, powder and solution.

The material of the replenishing cartridge used in the present invention is not particularly limited and it may be a paper plastic, metal or the like. Particularly preferred is a plastic material having a coefficient of oxygen permeation of 50 $ml/m^2 \cdot atm \cdot day$ or below. The coefficient of oxygen permeation can be determined by a method described on pages 143 to 145 of N. J. Calyan, "$O_2$ Permeation of Plastic Container, Modern Packing", December, 1968.

Preferred plastic materials include, for example, polyvinylidene chloride (PVDC), nylon (NY), polyethylene (PE), polypropylene (PP), polyester (PES), ethylene/vinyl acetate copolymer (EVA), ethylene/vinyl alcohol copolymer (EVAL), polyacrylonitrile (PAN), polyvinyl alcohol (PVA) and polyethylene terephthalate (PET).

It is desirable to use PVDC, NY, PE, EVA, EVAL and PET for the purpose of reducing the oxygen permeation.

These materials can be molded singly or films of each of them can be laminated to form a composite film. The container can be bottle-shaped, cubic, pillow-shaped or the like. In the present invention, the container is particularly preferably a flexible cubic one or the like, since it can be easily handled and the volume thereof can be reduced after the use.

Particularly desirable structures of the composite films are those listed below, which by no means limit the structures of them:

PE/EVAL/PE,
PE/aluminum foil/PE,
NY/PE/NY,
NY/PE/EVAL,
PE/NY/PE/WVAL/PE,
PE/NY/PE/PE/PE/NY/PE,
PE/$SiO_2$ film/PE,
PE/PVDC/PE,
PE/NY/aluminum foil/PE,
PE/PP/aluminum foil/PE,
NY/PE/PVDC/NY,
NY/EVAL/PE/EVAL/NY,
NY/PE/EVAL/NY,
NY/PE/PVDC/NY/EVAL/PE,
PP/EVAL/PE,
PP/EVAL/PP,
NY/EVAL/PE,
NY/aluminum foil/PE,
paper/aluminum foil/PE,
paper/PE/aluminum foil/PE,
PE/PVDC/NY/PE,
NY/PE/aluminum foil/PE,
PET/EVAL/PE,
PET/aluminum foil/PE, and
PET/aluminum foil/PET/PE.

The thickness of the composite film is about 5 to 1500 μm, preferably about 10 to 1000 μm. The capacity of the finished vessel is about 100 ml to 20 l, preferably about 500 ml to 10 l.

The vessel (cartridge) may be placed in an outer box made of a corrugated board or plastic or, alternatively, it may be combined with the outer box by monolithic molding.

Various processing solutions can be fed into the cartridges of the present invention. The processing solutions are, for example, a color developer, black-and-white developer, bleaching solution, compensating solution, reversing solution, fixing solution, bleach-fixing solution and stabilizing solution. The cartridge having a particularly low coefficient of oxygen permeation is suitable for the color developer, black-and-white developer, fixing solution and bleach-fixing solution.

Ordinary vessels for the processing solutions are also usable. They include those made of a single-layer material such as high-density polyethylene (HDPE), polyvinyl chloride resin (PVC) or polyethylene terephthalate (PET); and a rigid multi-layer material such as nylon/polyethylene (NY/PE).

Also a soft vessel for the liquids, which can be pressed to reduce the volume, thereby to reduce the necessary space after using the contents, is usable.

Figure 2:
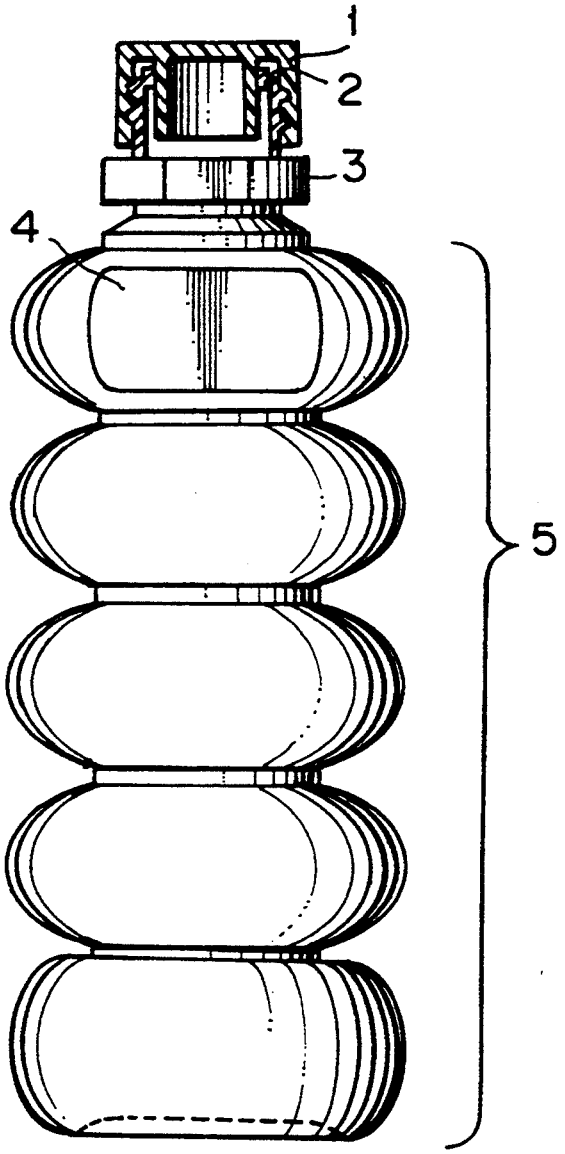
FIG. 2 is a front view of the flexible, roughly round vessel having the bellows part, which is to be used for the processing solution.

It is desirable in the present invention to use the soft vessel. Examples of them include a soft vessel (FIGS. 1 and 2) having a hard mouthpiece protruding upward from the body, which is engaged with a cap. The body of the vessel and the mouthpiece are integrally molded, and at least a part of the lengthwise direction of the body comprises a bellows.

The description will be made on the soft vessel having the bellows part.

The vessel has the bellows part, and the horizontal section thereof may be roughly square (FIG. 1), roughly hexagonal, roughly octagonal, round (FIG. 2), oval or the like.

From the viewpoint of saving the space to be occupied by the vessel containing the solution, the roughly square or roughly hexagonal vessel is preferred. The number of the projections in the bellows part is preferably 2 to 20, still preferably 3 to 10 and particularly 4 to 8.

Although the difference in size between the concave and convex parts is not particularly limited, the periphery of the concave part is at most 85%, preferably 40 to 75% and still preferably 50 to 75%, based on that of the convex part.

The height of the whole vessel after the complete compression is preferably at most 50%, still preferably at most 40% and particularly 10 to 30%, based on that before shrinkage by pressure. This ratio is desirably at least 10% from the viewpoints of the design and the production.

By suitably selecting the material and raw materials, desired gas-barriering properties can be imparted to the vessel. For example, when a high oxygen-barriering properties are required of the vessel for the developer, the vessel can have a multiple layer structure mainly comprising low-density polyethylene such as a three-layer structure comprising low-density polyethylene/-polyvinyl alcohol-ethylene copolymer/low-density polyethylene (LDPE/EVOH/LDPE) or double-layer structure comprising low-density polyethylene/nylon (LDPE/NY) to control the gas-barriering properties at 25 ml/m$^2$·day·atm (65% at 20° C.) or below, preferably 0.5 to 10 ml/m$^2$·day·atm (65% at 20° C.).

When the oxygen-barriering properties are not necessarily required as in case of, for example, the bleaching solution, the vessel can be made of the low-density polyethylene (LDPE) singly or ethylene/vinyl acetate copolymer resin (EVA). The term "low-density polyethylene" herein indicates that having a density of not higher than 0.940 g/ml, preferably 0.90 to 0.94 g/ml, still preferably 0.905 to 0.925 g/ml. In such a case, the gas-barriering capacity can be at least 50 ml/m$^2$·day·atm (65% at 20° C.), for example, 100 to 5000 ml/m$^2$. day-·atm (65% at 20° C.).

The mouthpiece, flange and neighboring parts are designed to have a thickness of preferably 1 to 4 mm, still preferably 1 to 3 mm, and particularly 1.2 to 2.5 mm. The thickness of the body of the vessel is preferably 0.1 to 1.5 mm, still preferably 0.2 to 1.0 mm and particularly 0.3 to 0.7 mm. The difference in the thickness between them is preferably about 0.2 mm, still preferably about 0.5 mm.

The ratio of the surface area (cm$^2$) of the vessel to the capacity (cm$^3$) thereof which is increased by the bellows structure is preferably 0.3 to 1.5 cm$^{-1}$, still preferably 0.4 to 1.2 cm$^{-1}$ and particularly 0.5 to 1.0 cm$^{-1}$.

In feeding the solution into the vessel, the head space (the vacant space above the solution level in the vessel) is desirably as small as possible from the viewpoint of the stability of the solution. However, when the head space is only small, the solution is apt to overflow at the time of the charging or using. The filling rate of the solution in the vessel is thus preferably 65 to 95%, still preferably 70 to 90%.

The material of the cap or inside plug of the vessel is desirably the same as that of the body of the vessel in order to facilitate the selection in the regeneration cycle after the use. Suitable gas-barriering properties can be realized by varying the material and raw materials for also the cap and inside plug as in the above-described case of the body of the vessel.

Although the capacity of the vessel is not particularly limited, it is preferably 50 ml to 5 l for easy handling.

The vessel can be recycled by the following methods:

1. The user shrinks the bellows part of the used vessel by compression and keeps the vessel provided with the inside plug and the cap.
2. After the user has stored up a predetermined amount of the vessels, they are recovered from the user.
3. The used vessel with the cap is cut into pieces of a predetermined size with a shredder.
4. The pieces thus formed are thrown into a water tank, washed with water for a predetermined time and then dried to obtain a material to be molded again to obtain resin products.
5. The regenerated material is mixed with a vergin material, the resultant mixture is molded into the vessels, into which the processing solution is fed to obtain the commercial product.

The following Examples will illustrate the soft vessels A to D having the bellows part for the processing solution:

| | Shape | |
|---|---|---|
| | roughly square (FIG. 1) | roughly round (FIG. 2) |
| | Vessel | |
| | A | B |
| Periphery of convex of bellows | 24 cm | 24 cm |
| Periphery of concave of bellows | 16 cm | 16 cm |
| Peripheny of concave/ periphery of convex | 67% | 67% |
| Height of vessel before shrinkage of bellows | 18 cm | 18 cm |
| Height of vessel after shrinkage of bellows | 4 cm | 4 cm |
| Reduction of height by shrinkage of bellows | 22% | 22% |
| Capacity | 580 ml | 580 ml |
| Amount of content | 500 ml | 500 ml |
| Filling rate | 86% | 86% |
| Material for body of vessel | LDPE (density: 0.91 g/ml) | LDPE (density: 0.91 g/ml)/ EVOH/LDPE (density: 0.91 g/ml) |
| Material for cap and inside plug | LDPE (density: 0.91 g/ml) | LDPE (density: 0.91 g/ml)/ EVOH/LDPE (density: 0.91 g/ml) |
| Oxygen permeability [ml/m$^2$. day . atm (65% at 20° C.)] | 100 | 1.0 |
| Thickness of body of vessel | 0.5 mm | 0.5 mm |
| Surface area of vessel | 520 cm$^2$ | 505 cm$^2$ |
| | Vessel | |
| | C | D |
| Periphery of convex of bellows | 35 cm | 35 cm |
| Periphery of concave of bellows | 24 cm | 24 cm |
| Periphery of concave/ periphery of convex | 67% | 67% |
| Height of vessel before shrinkage of bellows | 35 cm | 35 cm |
| Height of vessel after shrinkage of bellows | 8 cm | 8 cm |
| Reduction of height by shrinkage of bellows | 23% | 23% |
| Capacity | 2900 ml | 2900 ml |
| Amount of content | 2500 ml | 2500 ml |
| Filling rate | 86% | 86% |
| Material for body of vessel | LDPE (density: 0.91 g/ml) | LDPE (density: 0.91 g/ml)/ EVOH/LDPE (density: 0.91 g/ml) |
| Material for cap and inside plug | LDPE (density: 0.91 g/ml) | LDPE (density: 0.91 g/ml)/ EVOH/LDPE (density: 0.91 g/ml) |
| Oxygen permeability [ml/m$^2$ . day . atm (65% at 20° C.)] | 80 | 0.9 |
| Thickness of body of vessel | 0.7 mm | 0.6 mm |
| Surface area of vessel | 2020 cm$^2$ | 1940 cm$^2$ |

The present invention is applicable to any photosensitive material. The preferred silver halide emulsions and other ingredients (such as additives), photo-constituting layers (layer arrangement), methods for processing the photosensitive material and additives usable in the process are described in the patent specifications listed below and particularly European Patent 0,355,660 A2 (Japanese Patent Application No. Hei 1-107011):

TABLE 8

| Photographic constituent, etc. | J.P. KOKAI No. Sho 62-215272 |
|---|---|
| Silver halide emulsion | From line 6, right upper column, p. 10 to line 5, left lower column, p. 12; and from line 4 from below, right lower column, p. 12 to line 17, left upper column, p. 13 |
| Solvent for silver halide | Lines 6 to 14, left lower column, p. 12; and from line 3 from below, left upper column, p. 13 to the last line, left lower column, p. 18 |
| Chemical sensitizer | Line 3 from below, left lower column, p. 12; line 5 from below, right lower column, p. 12; and from line 1, right lower column, p. 18, to line 9 from below, right upper column, p. 22 |
| Spectral sensitizer (spectral sensitizing method) | From line 8 from below, right upper column, p. 22 to the last line, p. 38 |
| Emulsion stabilizer | From line 1, left upper column, p. 39 to the last line, right upper column, p. 72 |
| Development accelerator | From line 1, left lower column, p. 72 to line 3, right upper column, p. 91 |
| Color coupler (cyan, magenta or yellow coupler) | From line 4, right upper column, p. 91 to line 6, left upper column, p. 121 |
| Color development improver | From line 7, left lower column, p.121 to line 1, right upper column, pl25 |

TABLE 9

| Photographic constituent, etc. | J.P. KOKAI No. Sho 62-215272 |
|---|---|
| Ultraviolet absorber | From line 2, right upper column, p. 125 to the last line, left lower column, p. 127 column, p. 127 |
| Decoloration inhibitor (image stabilizer) | From line 1, right lower column, p. 127 to line 8, left lower column, p. 137 |
| High boiling and/or low boiling organic solvent | From line 9, left lower column, p. 137 to the last line, right upper column, p. 144 |
| Dispersion method for photographic additive | From line 1, left lower column to line 7, right upper column, p. 146 |
| Antistaining agent | From line 9, right lower column, p. 188 to line 10, right lower column, p. 193 |
| Surfactant | From line 1, left lower column, p. 201 to the last line, right upper column, p. 210 |
| Fluorine-containing compound (as anti-static agent, coating assistant, lubricant, adhesion inhibitor, etc.) | Line 1, left lower column, p. 210; and line 5, left lower column, p. 222 |

TABLE 10

| Photographic constituent, etc. | J.P. KOKAI No. Sho 62-215272 |
|---|---|
| Binder (hydrophilic colloid) | From line 6, left lower column, p. 222 to the last line, left upper column, p. 225 |
| Thickening agent | From line 1, right upper column, p. 225 to line 2, right upper column, p. 227 |
| Antistatic agent | From line 3, right upper column, p. 227 to line 1, left upper column, p. 230 |
| Hardener | From line 8, right upper column, p. 146 to line 4, left lower column, p. 155 |
| Developing agent precursor | From line 5, left lower column, p. 155 to line 2, right lower column, p. 155 |
| Development inhibitor | Lines 3 to 9, right lower column, p. 155 |

TABLE 10-continued

| | |
|---|---|
| releasing compound | |
| Support | Line 19, right lower colulmn, p. 155; and line 14, left upper column, p. 156 |
| Constitution of photosensitive layers | From line 15, left upper column, p. 156 to line 14, right lower column, p. 156 |
| Dye | From line 15, right lower column, p. 156 to the last line, right lower column, p. 184 |
| Color mixing inhibitor | From line 1, left upper column, p. 185 to line 3, right lower column, p. 188 |
| Gradation controller | Lines 4 to 8, right lower column, p. 188 |
| Polymer latex | From line 2, left upper column, p. 230 to the last line, p. 239 |
| Matting agent | From line 1, left upper colum, p. 240 to the last line, right upper column, p. 240 |
| Photographic process (steps and additives) | From line 7, right upper column, p. 3 to line 5, right upper column, p. 10 |

Notes)

The cited portions of J.P. KOKAI No. Sho 62-215272 includes also those amended by the Written Amendment dated March 16, 1987 as stated at the end of this patent publication.

Among the above-described couplers, preferred yellow couplers are so-called short-wave tyoe yellow couplers described in J.P. KOKAI Nos. Sho 63-231451. Sho 63-123047, Sho 63-241547, Hei 1-173499, 1-213648 and 1-250944.

TABLE 11

| Photographic constituent, etc. | J.P. KOKAI No. Hei 2-33144 | EP 0,355,660A2 |
|---|---|---|
| Silver halide emulsion | From line 16, right upper column, p. 28 to line 11, right lower column, p. 29; and lines 2 to 5, p. 30 | From line 53, p. 45 to line 3, p. 47; and lines 20 to 22, p. 47 |
| Chemical sensitizer | From line 12, right lower column, to the last line, p. 29 | Lines 4 to 9, p. 47 |
| Spectral sensitizer (spectral sensitizing method) | Lines 1 to 13, left upper column, p. 30 | Lines 10 to 15, p. 47 |
| Emulsion stabilizer | From line 14, left upper column to line 1, right upper column, p. 30 | lines 16 to 19, p. 47 |
| Color coupler (cyan, magenta or yellow coupler) | From line 14, right upper column, 3 to the last line, 1sft upper column, p. 18; and from line 6, right upper column, p. 30 to line 11, right lower column, p. 35 | Lines 15 to 27, p. 4; from line 30, p. 5 to the last line, p. 28; lines 29 to 31, p. 45; and from line 23, p. 47 to line 50, p. 63 |
| Ultraviolet absorber | From line 14, right lower column, p. 37 to line 11, left upper colum, p. 38 | Lines 22 to 31, p. 65 |
| Decoloration inhibitor(image stabilizer) | From line 12, right upper column, p. 36 to line 19, left upper column, p. 37 | From line 30, p. 4 to line 25, p. 45; lines 33 to 40, p. 45; and lines 2 to 21, p. 65 |
| High boiling and/or low boiling organic solvent | From line 14, right lower column, p. 35 to line 4 from below. left upper column, p. 36 | Lines 1 to 51, p. 64 |
| Dispersion method for photographic additive | From line 10, right lower column, p. 27 to the last line, left upper column, p. 28; and from line 12, right lower column, p. 35 to line 7, right upper column, p. 36 | From line 51, p. 63 to line 56, p. 64 |
| Antistaining agent | The last line, left upper colum, p. 37 and line 13, right lower column, p. 37 | From line 32, p. 65 to line 17, p. 66 |

TABLE 12

| | | |
|---|---|---|
| Photographic constituent, etc. | J.P. KOKAI No. Hei 2-33144 | EP 0,355,660A2 |
| Surfactant | Form line 1, right upper column, p. 18 to the last line, right lower column, p 24; and from line 10 from below, left lower column, p. 27 to line 9, right lower column, p. 27 | — |
| Fluorine-containing compound (as anti-static agent, coating assistant, lubricant, adhesion inhibitor, ect.) | Line 1, left upper column, p. 25 to line 9, right upper column, p. 27 | — |
| Binder (hydrohilic colloid) | Lines 8 to 18, right upper column, p. 38 | Lines 23 to 28, p. 66 |
| Support | From line 18, right upper column, p. 38 to line 3, left upper dolumn, p. 39 | From line 29, p. 66 to line 13, p. 67 |
| Constitution of photosensitive layers | Lines 1 to 15, right upper column, p. 28 | Lines 41 to 52, p. 45 |
| Dye | From line 12, left upper column to line 7, right upper column, p. 38 | Lines 18 to 22, p. 66 |
| Color mixing inhibitor | Lines 8 to 11, right upper column, p. 36 | From line 57, p. 64 to line 1, p. 65 |
| Photographic process (steps and aditives | From line 4, left upper column, p 39 to the last line, left upper column, p. 42 | From line 14, p. 67 to line 28, p. 69 |

As magenta couplers, those of pyrazolotriazole type are particularly desirable. Preferred examples of the magenta couplers of pyrazolotriazole type are as follows:

M-1

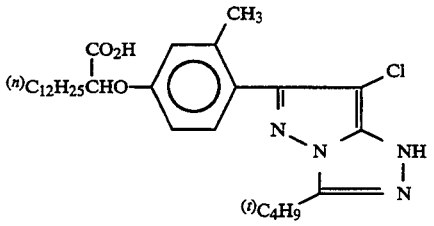

M-2

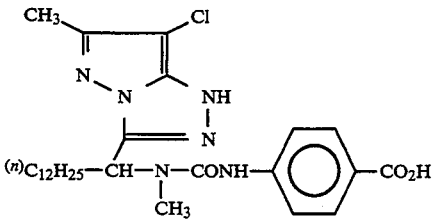

M-3

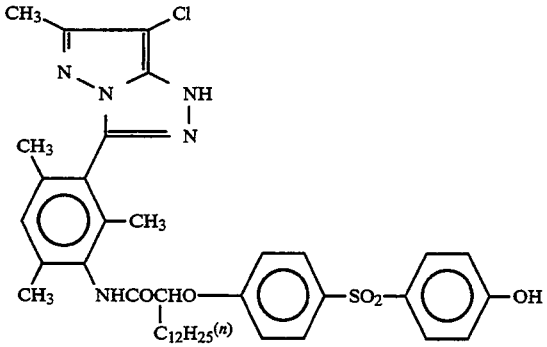

M-4

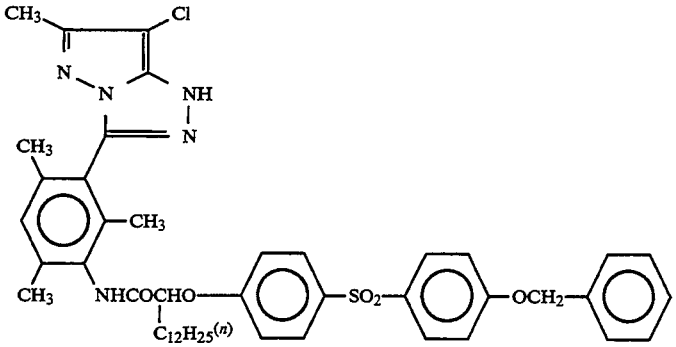

M-5

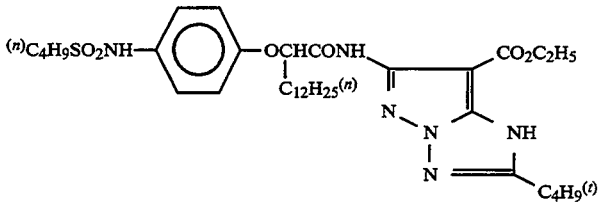

-continued
M-6
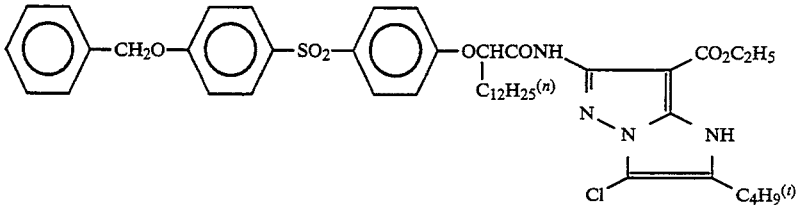
M-7
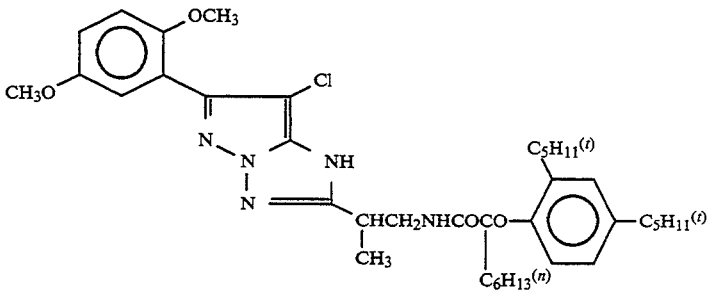
M-8
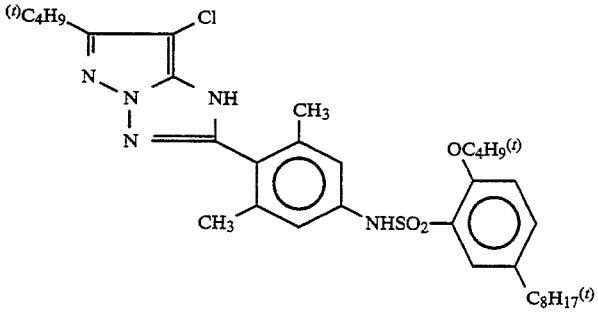
TABLE 13
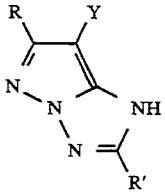
| Compound | R | R' | Y |
|---|---|---|---|
| M-9 | $CH_3$— | 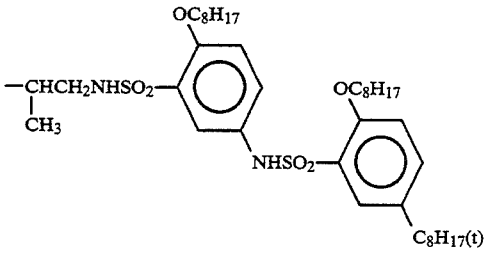 | Cl |
| M-10 | " | 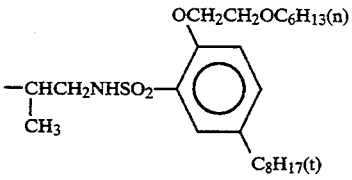 | " |

TABLE 13-continued
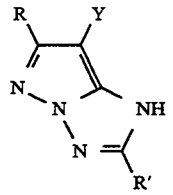
| Compound | R | R′ | Y |
|---|---|---|---|
| M-11 | $(CH_3)_3C-$ | 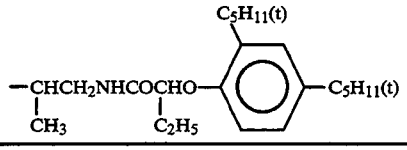 | 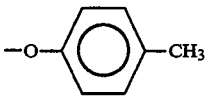 |
TABLE 14
| Compound | R | R′ | Y |
|---|---|---|---|
| M-12 | 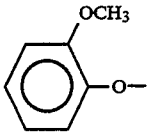 | 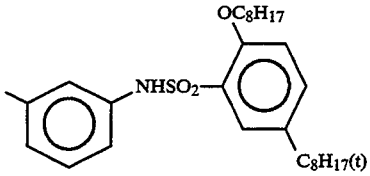 | 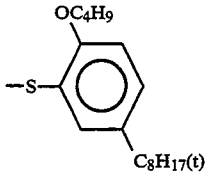 |
| M-13 | $CH_3-$ | 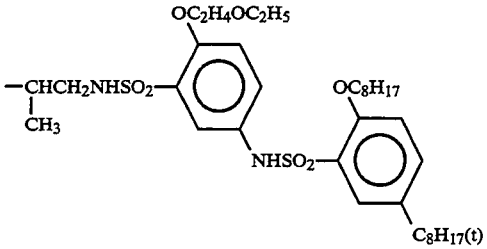 | Cl |
| M-14 | " | 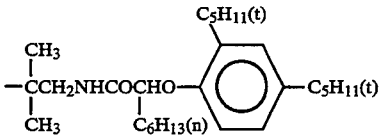 | " |
| M-15 | " | 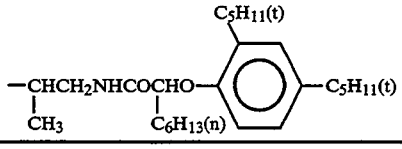 | " |
TABLE 15
| Compound | R | R′ | Y |
|---|---|---|---|
| M-16 | $CH_3-$ | 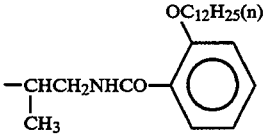 | Cl |
| M-17 | " | 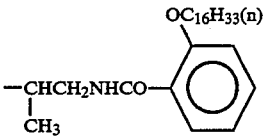 | " |

TABLE 15-continued
| Compound | R | R' | Y |
|---|---|---|---|
| M-18 | 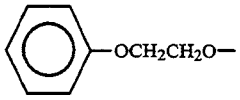 | 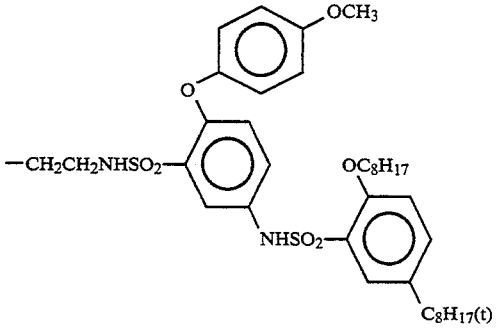 | 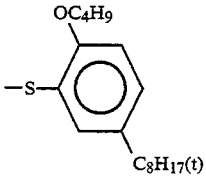 |
| M-19 | $CH_3CH_2O$— | " | " |
TABLE 16
| Compound | R | R' | Y |
|---|---|---|---|
| M-20 | 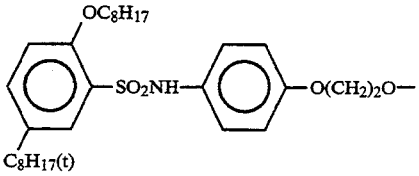 | 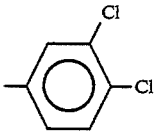 | 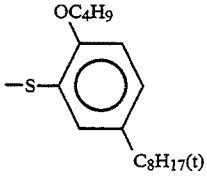 |
| M-21 | 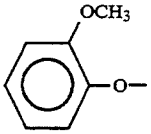 | 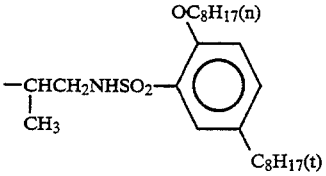 | Cl |
TABLE 17
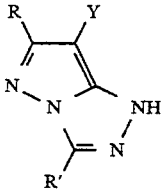
| Compound | R | R' | Y |
|---|---|---|---|
| M-22 | $CH_3$— | 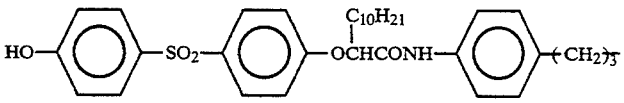 | Cl |
| M-23 | " | 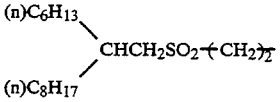 | " |
| M-24 | 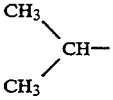 | 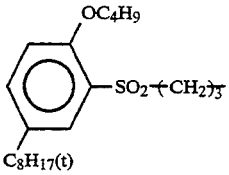 | " |

TABLE 17-continued
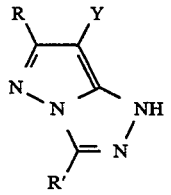
| Compound | R | R' | Y |
|---|---|---|---|
| M-25 | $-(CH-CH_2)_{50}-(CH_2-C)_{50}-$ ($CH_3$; $COOCH_2CH_2OCH_3$; $CONH-$) | $CH_3-CH-$ ($CH_2NHSO_2CH_3$) | " |
TABLE 18
| Compound | R | R' | Y |
|---|---|---|---|
| M-26 | 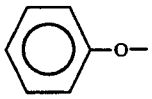 | 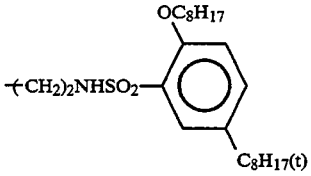 | Cl |
| M-27 | $CH_3-$ | 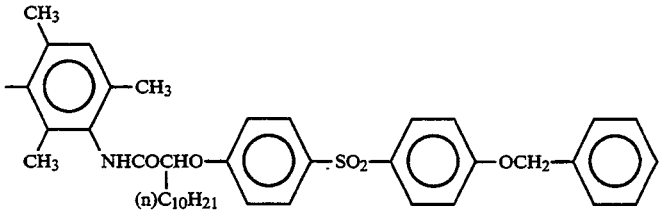 | " |
| M-28 | $(CH_3)_3C-$ | 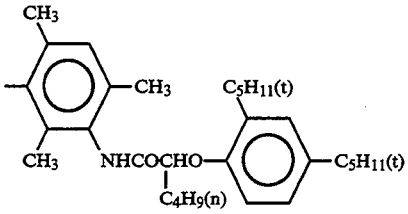 | " |
TABLE 19
| Compound | R | R' | Y |
|---|---|---|---|
| M-29 | 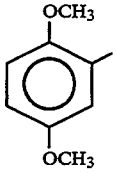 | 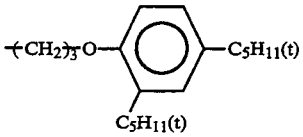 | Cl |
TABLE 19-continued
| Compound | R | R' | Y |
|---|---|---|---|
| M-30 | $CH_3-$ | $-CH(C_2H_5)-N(n)C_{18}H_{37}COCH_2CH_2COOH$ | " |
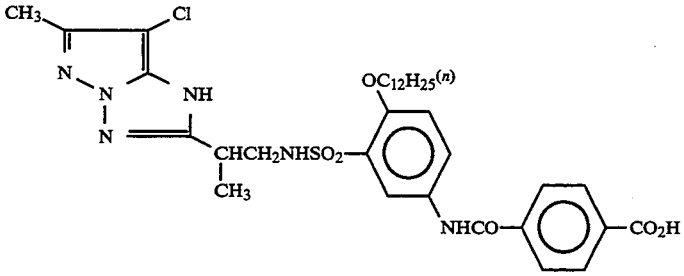
M-31

-continued
M-32
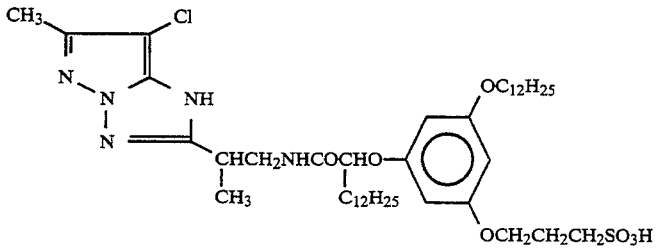
M-33
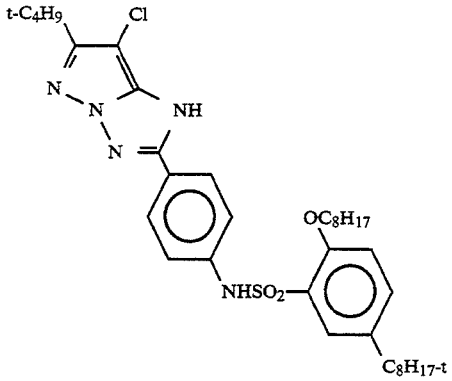
M-34
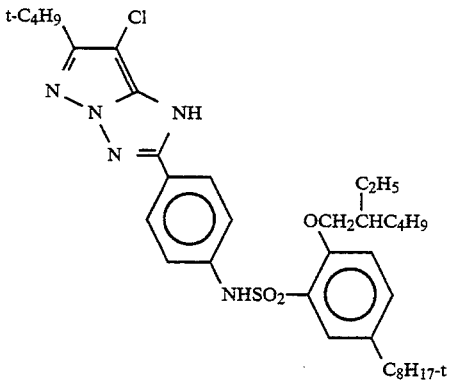
M-35
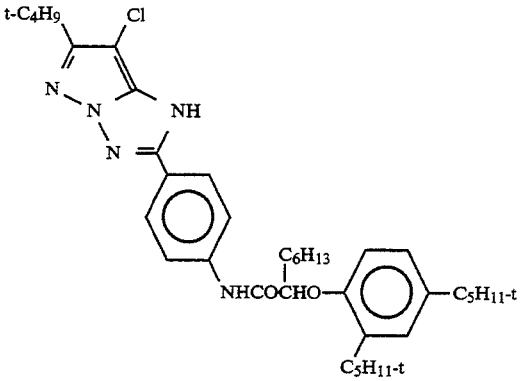
M-36
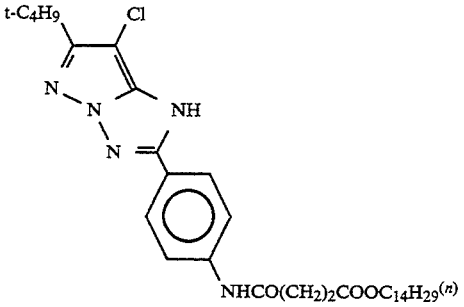
M-37
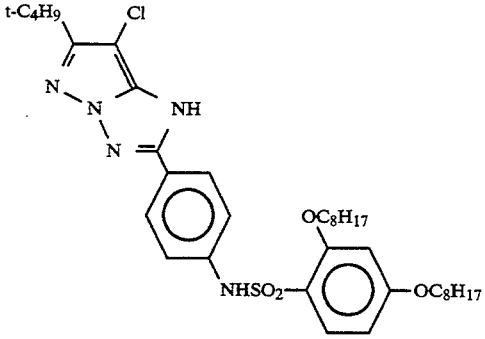
M-38
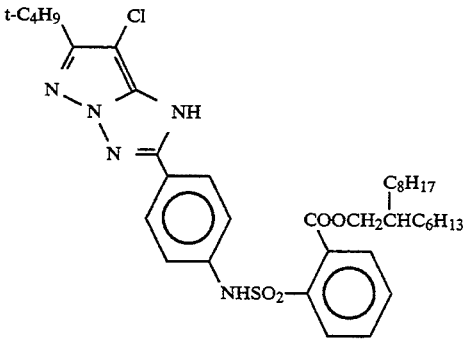

-continued
M-39
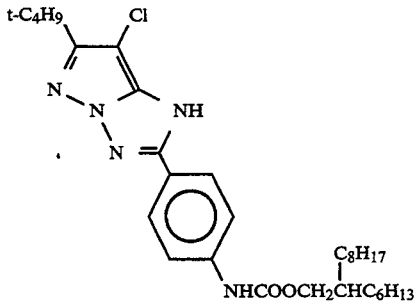
M-40
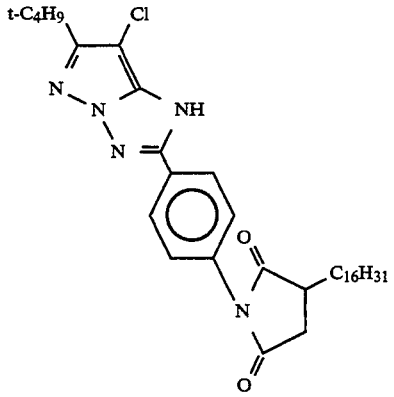
M-41
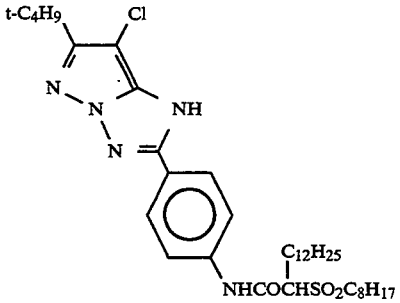
M-42
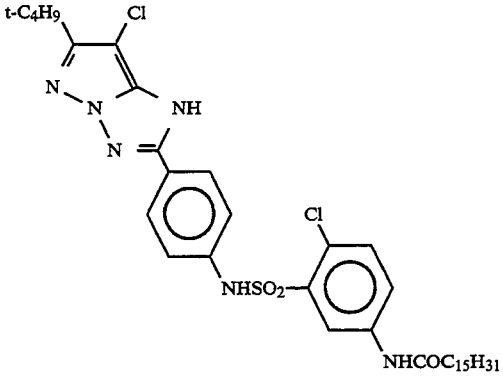
M-43
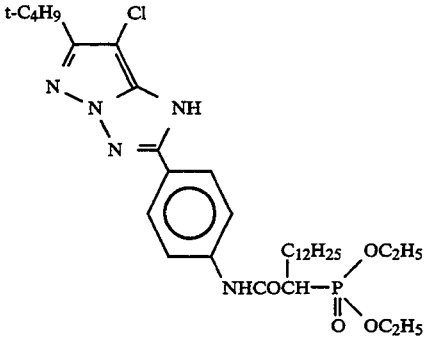
M-44
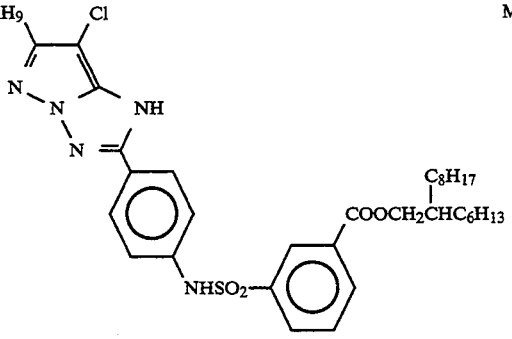
M-45
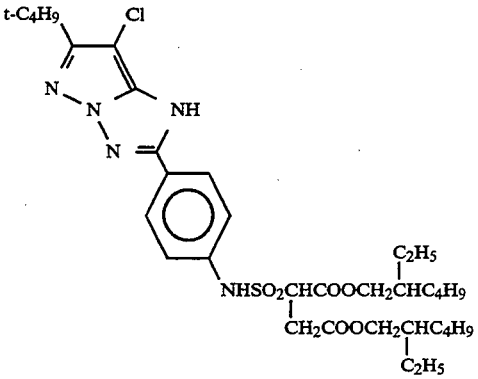
M-46
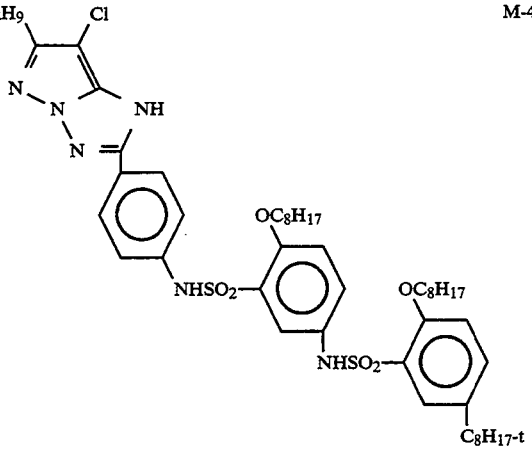

-continued
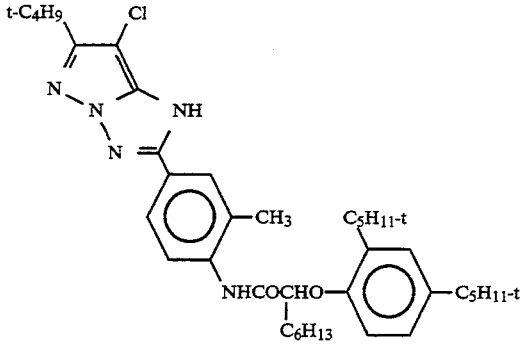
M-47
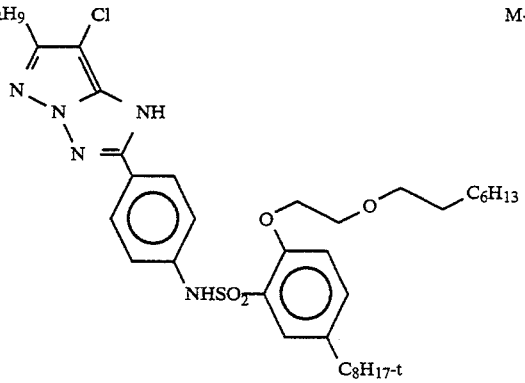
M-48
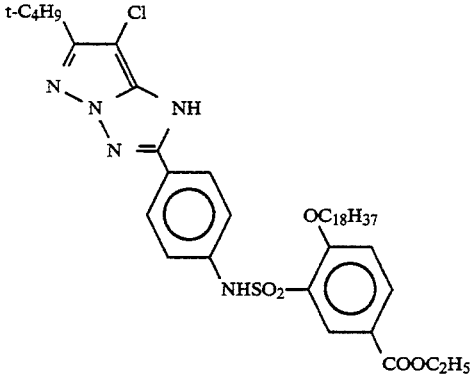
M-49
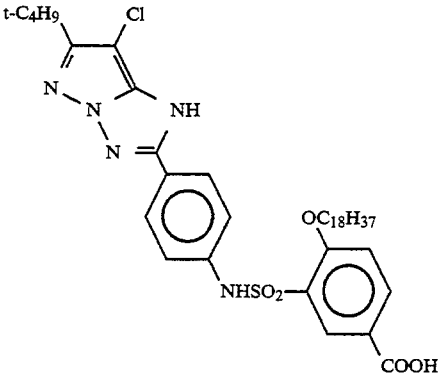
M-50
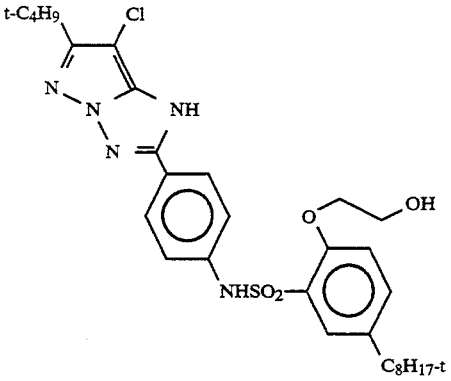
M-51
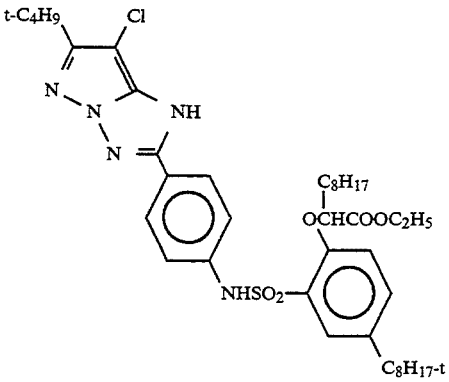
M-52
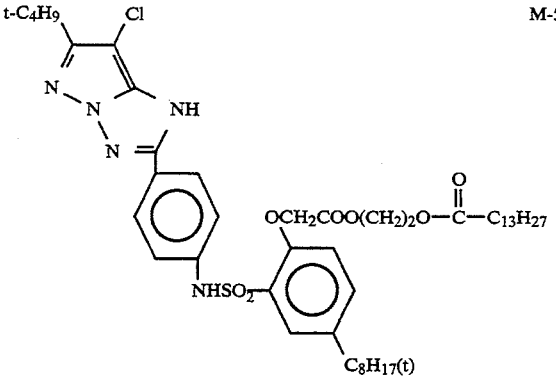
M-53
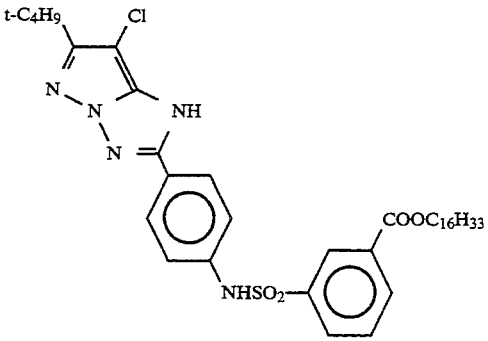
M-54

-continued
M-55
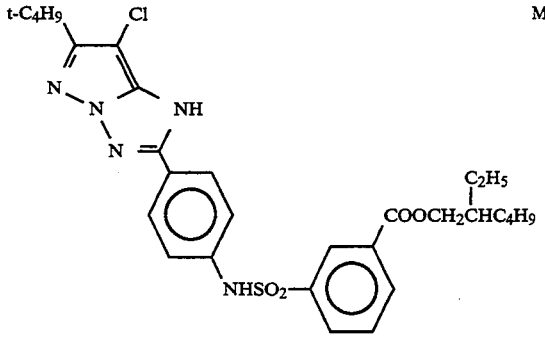
M-56
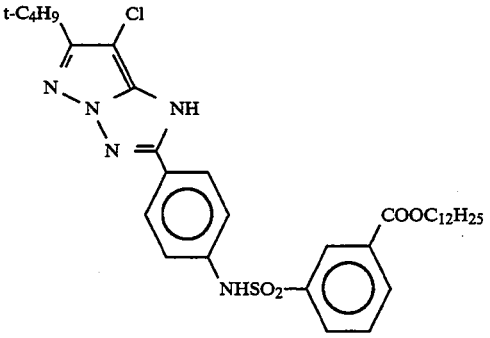
M-57
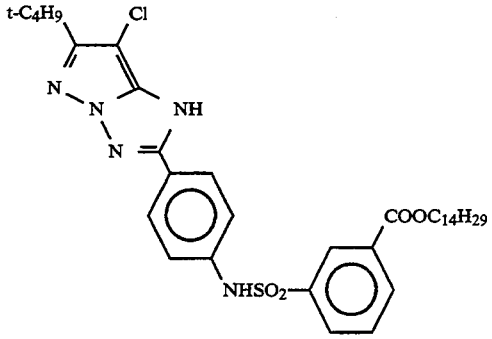
M-58
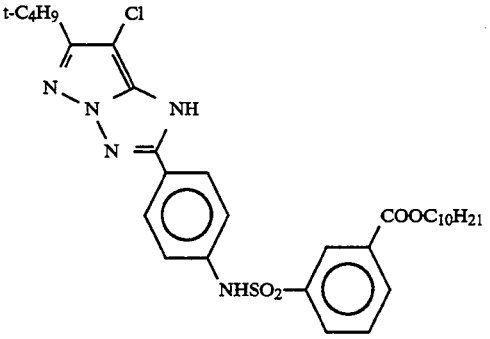
M-59
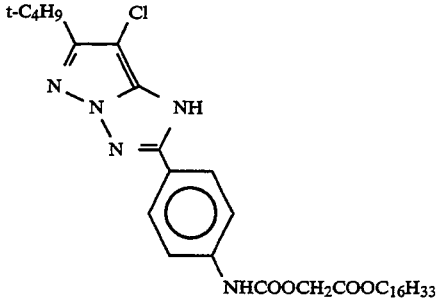
M-60
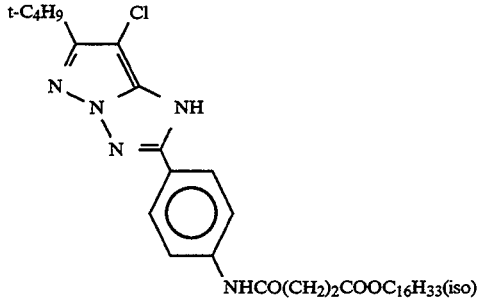
M-61
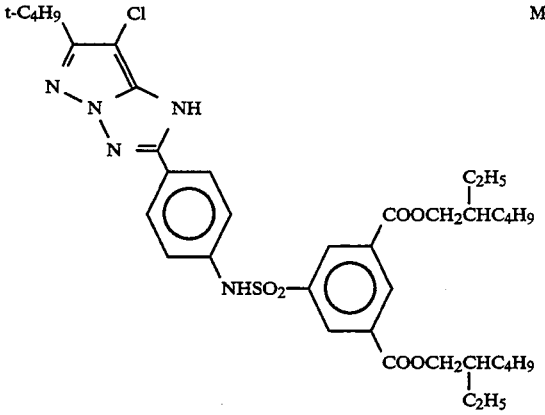
M-62
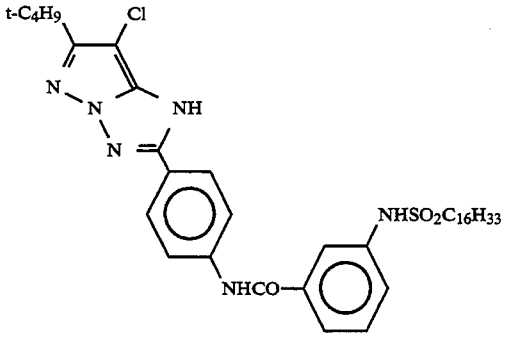

-continued

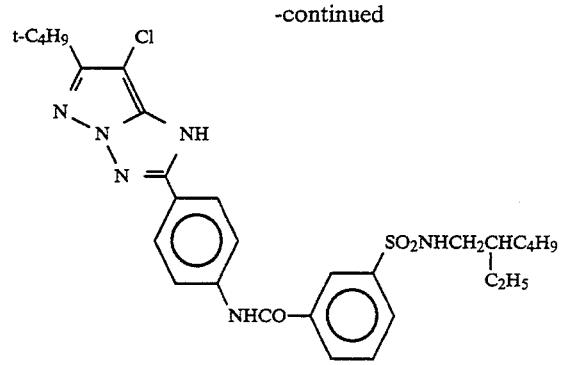

M-63

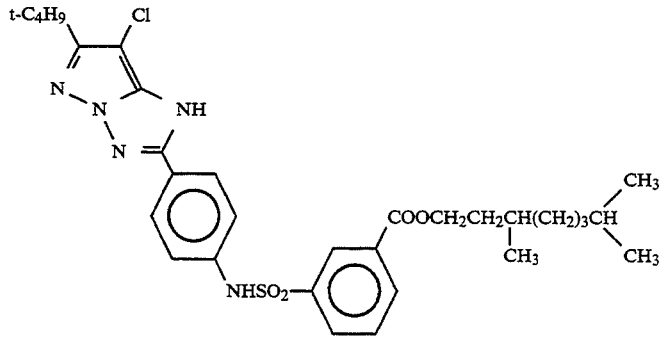

M-64

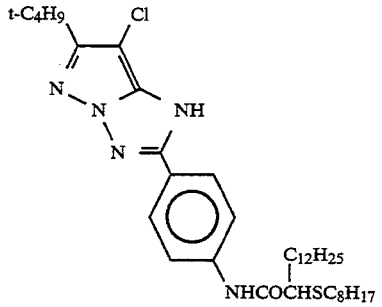

M-65

The cyan couplers preferably used in the present invention include diphenylimidazole cyan couplers described in J.P. KOKAI No. Hei 2-33144; 3-hydroxypyridine cyan couplers described in European Patent No. 0,333,185 A2 [particularly preferred are that produced by converting four-equivalent coupler (42) given as an example therein into a two-equivalent coupler by introducing a chlorine-linked coupling-off group thereinto and couplers (6) and (9] and cyclic active methylene cyan couplers described in J.P. KOKAI No. Sho 64-32260 [particularly preferred are couplers 3, 8 and 34 given therein as examples].

The silver halides usable in the present invention include, for example, siver chloride, silver bromide, silver chlorobromide, silver chlorobromoiodide and silver bromoiodide. For the rapid process, it is desirable to use a substantially silver iodide-free silver chlorobromide or silver chloride emulsion having a silver chloride content of at least 90 molar %, preferably at least 95% and particularly at least 98%. A particularly preferred photosensitive material used in the method of the present invention is, for example, a color photosensitive material having a high silver chloride content for printing (such as a color paper).

To improve the sharpness of the image, it is preferred to incorporate a dye (particularly oxonol dye) which can be decolored by a treatment as described on pages 27 to 76 of the specification of E.P. No. 0,337,490 A2 into a hydrophilic colloid layer of the photosensitive material of the present invention, the dye being used in such an amount that the optical reflection density of the photosensitive material at 680 nm will be 0.70 or above. It is also preferred to incorporate 12 wt % or more (preferably 14 wt % or more) of titanium oxide surface-treated with a dihydric, trihydric or tetrahydric alcohol (such as trimethylolethane) into a water-resistant resin layer of the support.

The photosensitive material used in the present invention preferably contains a dye image-stabilizing compound as described in European Patent No. 0,277,589 A2 in addition to the coupler. Particularly preferred is a pyrazoloazole coupler.

Namely, to prevent undesirable effects such as the staining with a dye formed by the reaction of the coupler with the color developing agent or its oxidation product remaining in the film during the storage after the process, it is preferred to use a compound (F) capable of chemically bonding with the aromatic amine developing agent remaining after the completion of the color development to form a chemically inert, substantially colorless compound and/or a compound (G) capable of chemically bonding with the oxidation product of the aromatic amine developing agent remaining after the completion of the color development to form a chemically inert, substantially colorless compound.

The photosensitive material used in the present invention preferably contains an antifungal agent described in J.P. KOKAI No. Sho 63-271247 in order to prevent fungi and bacteria which deteriorate the image from the propagation in the hydrophilic colloid layer.

To improve the adhesion of the processed color photosensitive material, the degree of swelling of the photographic layer of the silver halide color photographic material is preferably 1.1 to 3.0 in the present invention.

The degree of swelling herein indicates a value determined by immersing the color photosensitive material in distilled water at 33° C. for 2 min and dividing the thickness of the swollen photographic layer by that of the dry photographic layer. It is more preferably 1.3 to 2.7. The thickness of the dry photographic layer is preferably 5 to 25 μm, more preferably 7 to 20 μm.

The photographic layer comprises at least one photosensitive silver halide emulsion layer laminated with hydrophilic colloid layers through which water permeates. The photographic layer excludes a back layer provided on the opposite side to the photosensitive layer through a support. The photographic layer comprises usually two or more layers relating to the photographic image formation such as an intermediate layer, filter layer, halation-inhibiting layer, protecting layer, etc. in addition to the silver halide emulsion layer.

The method for controlling the degree of swelling in the range of the present invention is not particularly limited. The degree of swelling can be controlled by varying the kind and amount of the gelatin and the kind and amount of the hardener to be contained in the photographic membrane as well as drying conditions and time after the application of the photographic layer by coating method. Although gelatin is preferred for the photographic layer, other hydrophilic colloids are also usable. The materials for the photographic layer include, for example, gelatin derivatives; graft polymers of gelatin and other high-molecular compounds; proteins such as albumin and casein; cellulose derivatives such as hydroxyethyl cellulose, carboxymethyl cellulose and cellulose sulfate; sodium alginate; saccharide derivatives such as starch derivatives; and synthetic hydrophilic polymers such as homopolymers and copolymers including polyvinyl alcohol, partial acetal of polyvinyl alcohol, poly-N-vinylpyrrolidone, polyacrylic acid, polymethacrylic acid, polyacrylamide, polyvinylimidazole and polyvinylpyrazole.

The gelatins usable herein include gelatin treated with lime, gelatin treated with an acid, gelatin hydrolyzate and decomposition products of gelatin with an enzym. The gelatin derivatives are those obtained by reacting gelatin with a compound such as an acid halide, acid anhydride, isocyanate, bromoacetic acid, alkanesultone, vinylsulfonamide, maleinimide, polyalkylene oxide or epoxy compound.

The graft polymers of gelatin are those obtained by grafting, onto gelatin, a homopolymer or copolymer of vinyl monomer such as acrylic acid, methacrylic acid or a derivative thereof including an ester or amide thereof; or acrylonitrile or styrene. Particularly preferred is a graft polymer of gelatin with a polymer having some compatibility with the gelatin such as a polymer of acrylic acid, methacrylic acid, acrylamide, methacrylamide or hydroxyacryl methacrylate. Examples of them are given in, for example, U.S. Pat. Nos. 2,763,625, 2,831,767 and 2,956,884. Typical synthetic hydrophilic polymers are described in, for example, West German Patent Application (OLS) No. 2,312,708, U.S. Pat. Nos. 3,620,751 and 3,879,205 and J.P. KOKOKU No. Sho 43-7561.

The hardeners include, for example, chromates (such as chromium alum and chromium acetate), aldehydes (such as formaldehyde, glyoxal and glutaraldehyde), N-methylol compounds (such as dimethylolurea and methyloldimethylhydantoin), dioxane derivatives (such as 2,3-dihydroxydioxane), active vinyl compounds {such as 1,3,5-triacryloylhexahydro-s-triazine, bis(-vinylsulfonyl) methyl ether and N,N'-methylenebis-[β-(vinylsulfonyl)propionamide]}, active halogen compounds (such as 2,4-dichloro-6-hydroxy-s-triazine), mucohalogenic acids (such as mucochloric acid and mucophenoxychloric acid), isoxazoles, dialdehyde starches and 2-chloro-6-hydroxytriazinylted gelatin. They are usable either singly or in combination of them.

Particularly preferred hardeners are aldehydes, active vinyl compounds and active halogen compounds.

The film-swelling rate of the photosensitive material of the present invention is defined as $T_{\frac{1}{2}}$. $T_{\frac{1}{2}}$ indicates the time necessitated for swelling the photosensitive material to a half of the thickness of the saturated swollen film which corresponds to 90% of the maximum thickness of the swollen film attained in processing in the color developer (38° C., 3 min 15 sec). $T_{\frac{1}{2}}$ is preferably 20 sec or below, more preferably 10 sec or below.

The support used for the photosensitive material in the present invention may be a white polyester support for display or a support having a white pigment-containing layer formed on the silver halide emulsion layer-side of the support. To further improve the sharpness, it is preferred to form an antihalation layer on the silver halide emulsion layer-side of the support or backside of the support. The transmission density of the support is preferably in the range of 0.35 to 0.8 so that the display can be seen irrespective of the light (reflected light or transmitted light).

The photosensitive material in the present invention can be exposed with visible radiation or infrared radiation. Either low-intensity exposure or high-intensity exposure in a short time is possible. In the latter case, laser scanning exposure method in which the exposure time per picture element is shorter than $10^{-4}$ sec is preferred.

In the exposure, it is desirable to use a band stop filter described in U.S. Pat. No. 4,880,726 so as to inhibit the light mixing and to remarkably improve the color reproducibility.

EXAMPLE 1

A paper support the both surface of which had been laminated with polyethylene was processed by corona discharge. A subbing gelatin layer containing sodium dodecylbenzenesulfonate was formed thereon and then various photographic layers were formed thereon to form a multi-layer color photographic paper (101) having a layer structure which will be described below. The coating solutions were prepared as described below.

Preparation of the first layer-forming solution:

153.0 g of yellow coupler (ExY), 15.0 g of a dye image stabilizer (Cpd-1), 7.5 g of another dye image stabilizer (Cpd-2) and 16.0 of still another dye image stabilizer (Cpd-3) were dissolved in a mixture of 25 g of a solvent (Solv-1), 25 g of another solvent (Solv-2) and 180 ml of ethyl acetate. The resultant solution was emulsion-dispersed in 1000 g of 10% aqueous gelatin solution containing 60 ml of 10% sodium dodecylbenzenesulfonate and 10 g of citric acid to obtain an emulsion dispersion A. Separately, a silver chlorobromide emulsion A [mixture of a large-size emulsion A having an averge cubic grain size of 0.88 μm and a small-size emulsion A having an averge cubic grain size of 0.70 μm in a molar ratio of 3:7 (in terms of silver); the coefficient of variation of the grain size distribution being 0.08 and 0.10, respectively; and 0.3 molar % of silver bromide being localized in a part of the grain surface mainly comprising silver chloride in both emulsions] was prepared. The large size emulsion A contained $2.0\times10^{-4}$ mol, per mol of silver, of each of blue-sensitive sensitizing dyes A and B, and the small size emulsion A contained $2.5\times10^{-4}$ mol, per mol of silver, of each of them. The emulsion was chemically aged by addition of a sulfur sensitizer and a gold sensitizer. The above-described emulsion dispersion A was mixed with the silver chlorobromide emulsion A to obtain a coating solution for forming the first layer which solution has a composition which will be described below. The amount of the applied emulsion was given in terms of silver.

The coating solutions for forming the second to the seventh layers were prepared in the same manner as that for forming the first layer. Sodium salt of 1-hydroxy-3,5-dichloro-S-triazine was used as the gelatin-hardening agent in each layer.

Further, Cpd-14 and Cpd-15 were incorporated into the respective layers in such an amount that the total amount of them would be 25.0 mg/m² and 50.0 mg/m², respectively.

The following spectral sensitizing dyes were used for forming the silver chlorobromide emulsion in each photosensitive emulsion layer:

Blue-sensitive emulsion layer:

Sensitizing dye A

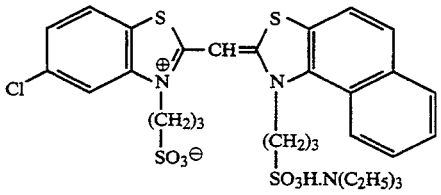

and Sensitizing dye B

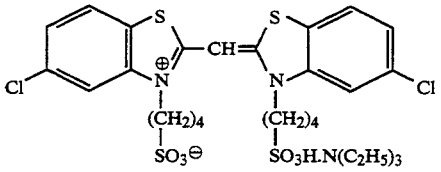

($2.0\times10^{-4}$ mol, per mol of the silver halide, for the large-size emulsion and $2.5\times10^{-4}$ mol for the small-size emulsion)

Green-sensitive emulsion layer:

Sensitizing dye C

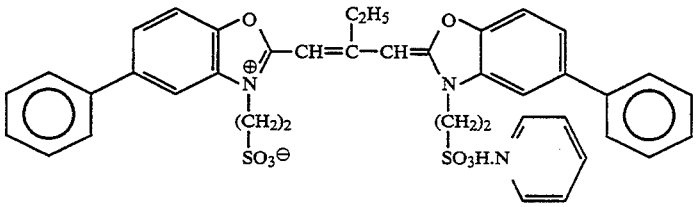

($4.0\times10^{-4}$ mol, per mol of the silver halide, for the large-size emulsion and $5.6\times10^{4}$ mol for the small-size emulsion) and Sensitizing dye D

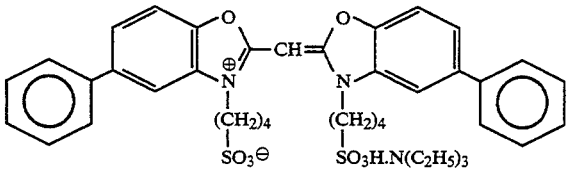

($7.0\times10^{-5}$ mol, per mol of the silver halide, for the large-size emulsion and $1.0\times10^{-4}$ mol for the small-size emulsion)

Red-sensitive emulsion layer:

Sensitizing dye E

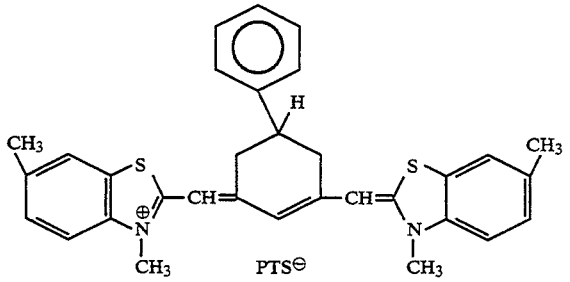

($0.9\times10^{-4}$ mol, per mol of the silver halide, for the large-size emulsion and $1.1\times10^{-4}$ mol for the small-size emulsion)

Further, $2.6\times10^{-3}$ mol, per mol of the silver halide, of the following compound was added:

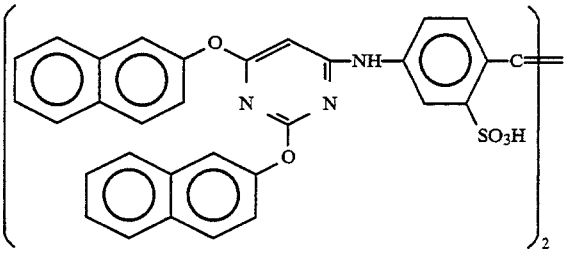

$8.5\times10^{-5}$ mol, $7.7\times10^{-4}$ mol and $2.5\times10^{-4}$ mol, per mol of the silver halide, of 1-(5-methylureidophenyl)-5-mercaptotetrazole were incorporated into the blue-sensitive emulsion layer, green-sensitive emulsion layer and red-sensitive emulsion layer, respectively.

$1\times10^{-4}$ mol and $2\times10^{-4}$ mol, per mol of the silver halide, of 4-hydroxy-6-methyl-1,3,3a,7-tetrazaindene were incorporated into the blue-sensitive emulsion layer and green-sensitive emulsion layer, respectively.

For preventing the irradiation, the following dyes were incorporated into the emulsion layers (the amounts in the parentheses are those used for forming the coatings):

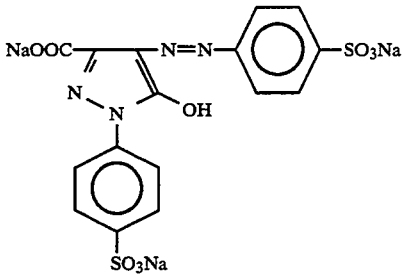

(10 mg/m²)

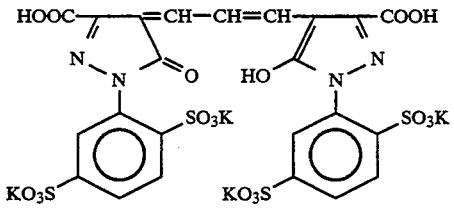

(10 mg/m²)

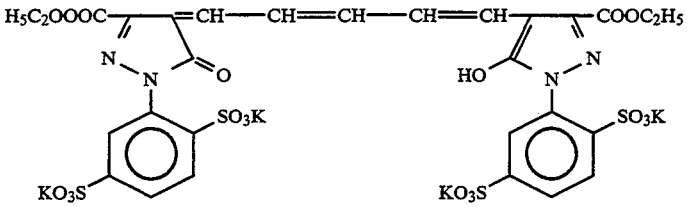

(40 mg/m²)

and

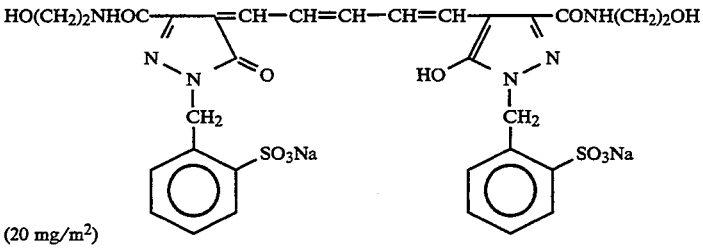

(20 mg/m²)

(Layer structure)

The compositions of the respective layers will begin below. The numerals indicate the amounts used for forming the coatings (g/m²). The amount of the silver halide emulsion is given in terms of silver.

| Support: Polyethylene-laminated paper | |
|---|---|
| [The polyethylene on the first layer-side contains a white pigment (15% by weight of $TiO_2$) and a blue dye (ultramarine)] | |
| The first layer (blue-sensitive emulsion-layer): | |
| The above-described silver chlorobromide emulsion A | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| The second layer (color mixing-inhibiting layer) | |
| Gelatin | 1.00 |
| Color mixing-inhibitor (Cpd-4) | 0.06 |
| Solvent (Solv-2) | 0.25 |
| Solvent (Solv-3) | 0.25 |

-continued

| Support: Polyethylene-laminated paper | |
|---|---|
| Solvent (Solv-7) | 0.03 |
| The third layer (green-sensitive emulsion layer) | |
| Silver chlorobromide emulsion [mixture of large size emulsion B (average cubic grain size: 0.55 μm) and small size emulsion B (average grain size: 0.39 μm) in molar ratio of 1:3 (in terms of Ag); coefficients of variation of the grain size distribution were 0.10 and 0.08, respectively; 0.8 molar % of AgBr was locally contained in a part of the surface of the grains mainly comprising silver chloride] | 0.13 |
| Gelatin | 1.45 |
| Magenta coupler (ExM) | 0.16 |
| Dye image stabilizer (Cpd-2) | 0.03 |
| Dye image stabilizer (Cpd-5) | 0.15 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| The fourth layer (color mixing-inhibiting layer) | |
| Gelatin | 0.70 |
| Color mixing-inhibitor (Cpd-4) | 0.04 |
| Solvent (Solv-2) | 0.18 |
| Solvent (Solv-3) | 0.18 |
| Solvent (Solv-7) | 0.02 |
| The fifth layer (red-sensitive emulsion layer) | |
| Silver chlorobromide emulsion [mixture of large size emulsion C (average cubic grain size: 0.50 μm) and small size emulsion C (average grain size: 0.41 μm) in molar ratio of 1:4 (in terms of Ag); coefficients of variation of the grain size distribution were 0.09 and 0.11, respectively; 0.8 molar % of AgBr was locally contained in a part of the surface of the grains mainly comprising silver chloride] | 0.20 |

-continued

| Support: Polyethylene-laminated paper | |
|---|---|
| Gelatin | 0.85 |
| Cyan coupler (ExC) | 0.33 |
| Ultraviolet absorber (UV-2) | 0.18 |
| Dye image stabilizer (Cpd-1) | 0.33 |
| Dye image stabilizer (Cpd-6) | 0.01 |
| Dye image stabilizer (Cpd-8) | 0.01 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-1) | 0.01 |
| Solvent (Solv-6) | 0.22 |
| The sixth layer (ultraviolet absorbing layer) | |
| Gelatin | 0.55 |
| Ultraviolet absorber (UV-1) | 0.38 |
| Dye image stabilizer (Cpd-5) | 0.02 |
| Dye image stabilizer (Cpd-12) | 0.15 |
| The seventh layer (protecting layer) | |
| Gelatin | 1.13 |
| Acryl-modified polyvinyl alcohol copolymer (degree of modification: 17%) | 0.05 |
| Liquid paraffin | 0.02 |
| Surfactant (Cpd-13) | 0.01 |
| (ExY) yellow coupler | |

A mixture of the following compounds in a molar ratio of 1:1:

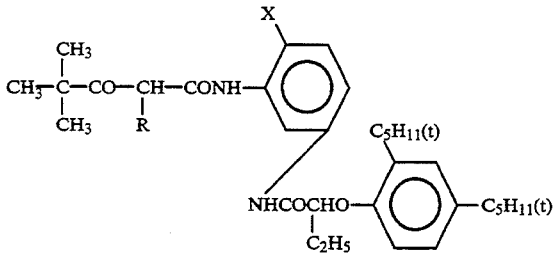

R = 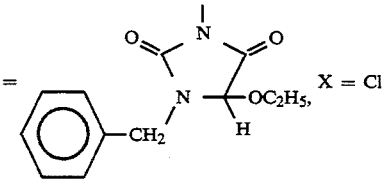 X = Cl and

R = 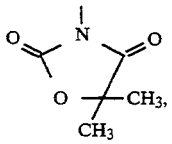 X = $OCH_3$ (ExM)magenta coupler

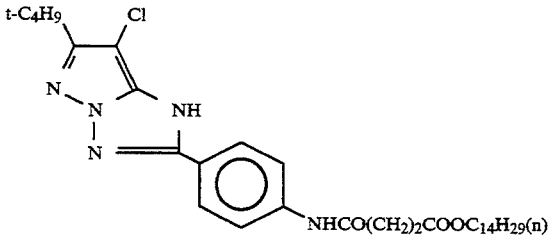

(ExC)cyan coupler

A mixture of the following compounds in a molar ratio of 3:7:

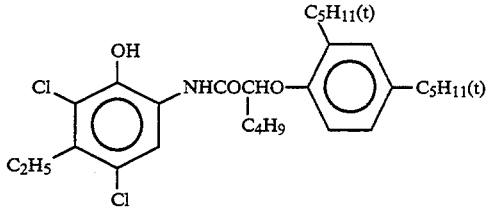

and

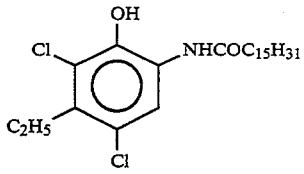

(Cpd-1)dye image stabilizer

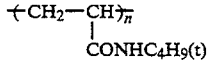

average molecular wt. 60,000

(Cpd-2)dye image stabilizer

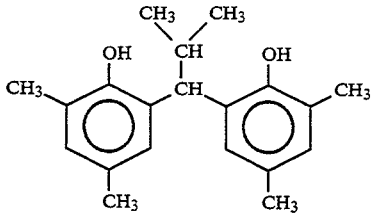

(Cpd-3)dye image stabilizer

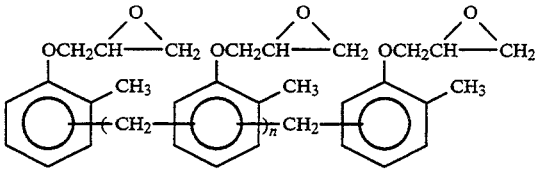

n = 7~8(average)

(Cpd-4) color-mixing inhibitor

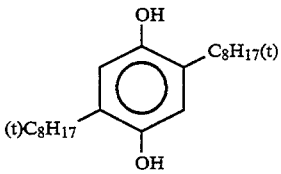

(Cpd-5)dye image stabilizer

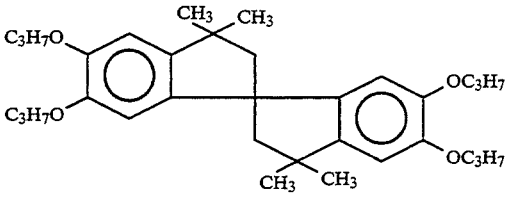

(Cpd-6)

-continued
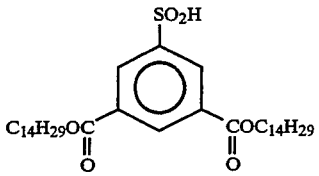
(Cpd-7)
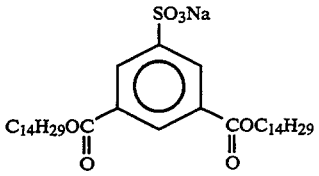
(Cpd-8)dye image stabilizer
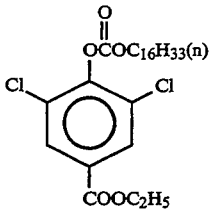
(Cpd-9)dye image stabilizer
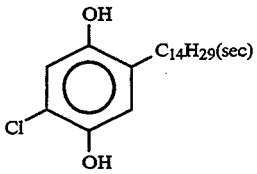
(Cpd-10)dye image stabilizer
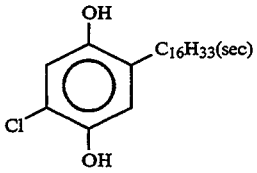
(Cpd-11)
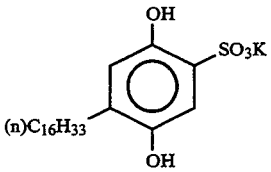
(Cpd-12)
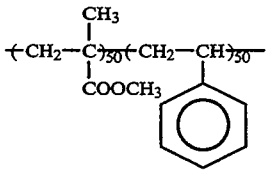
average molecular wt. 60,000
(Cpd-13)
-continued
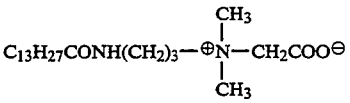
(Cpd-14)antiseptic
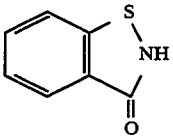
(Cpd-15)antiseptic
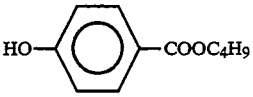
(UV-1)Ultraviolet absorber
A mixture of the following compounds
in a weight ratio of 1:5:10:5:
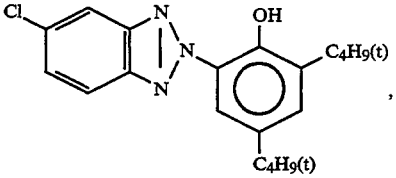
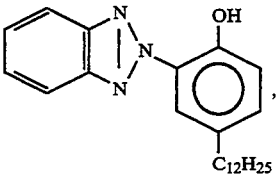
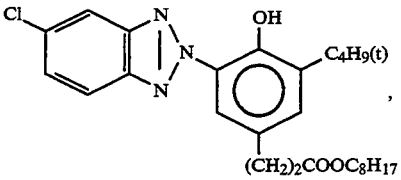
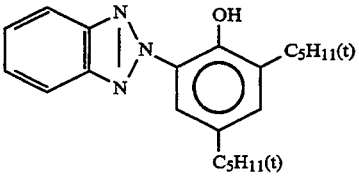
(UV-2)Ultraviolet absorber
A mixture of the following compounds
in a weight ratio of 1:2:2:
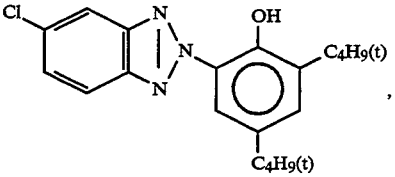

-continued

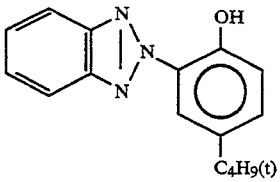

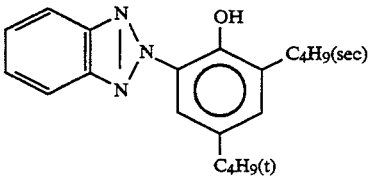

(Solv-1)solvent

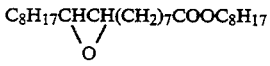

(Solv-2)solvent

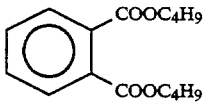

(Solv-3)solvent

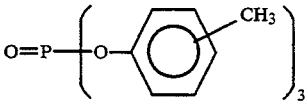

(Solv-4)solvent

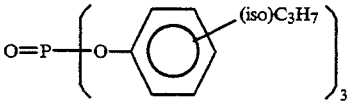

(Solv-5)solvent

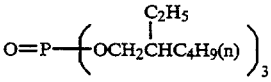

(Solv-6)solvent

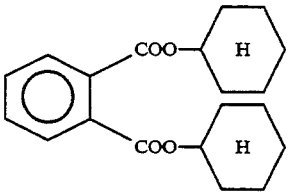

-continued (Solv-7)solvent

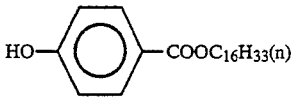

After the image-forming exposure of the above-described photosensitive material, the running test was conducted with a paper-processing machine (open rate of the color-development tank: 0.005 $cm^{-1}$, carry-over of the color developer with the photosensitive material: 30 $ml/m^2$, carrying rate: 1000 mm/min) until the amount of the replenisher had reached two times as much as the capacity of the color development tank. In this connection, open area of the color developing tank was 0.007 ($cm^{-1}$). The processing steps were as described below. The conditions of the running test were such that the time required for feeding the replenisher in an amount of two times as much as the capacity of the tank was one week or five weeks.

| Step | Temp. | Time | Amount of replenisher* | Capacity of tank |
|---|---|---|---|---|
| Color development | 40.0° C. | 45 sec | see Table 21 | 5 l |
| Bleach-fixing | 35° C. | 45 sec | 30 ml | 5 l |
| Rinse (1) | 35° C. | 20 sec | — | 2 l |
| Rinse (2) | 35° C. | 20 sec | — | 2 l |
| Rinse (3)** | 35° C. | 20 sec | — | 2 l |
| Rinse (4)** | 35° C. | 30 sec | 90 ml | 3 l |
| Drying | 80° C. | 60 sec | | |

* Amount of the replenisher per square meter of the photosensitive material

** RC-30 (a product of Fuji Photo Film Co., Ltd.) was mounted on the rinse (3), from which the rinsing liquid was taken out and sent into a reverse osmosis module [RC-30] by means of a pump. The permeated water from the tank was fed into the rinse (4), and concentrated solution was returned into the rinse (3). The pump pressure was regulated so that the amount of the permeated water introduced into the reverse osmosis module was kept at 200 to 300 ml/min. The temperature control and circulation was conducted for 10 h a day. [The rinsing was carried out by four-tank countercurrent method from tank (4) to (1)]

The compositions of the processing solutons were as described below:

[Color developer] see Table 20.

| [Bleach-fixing solution] | Tank Solution | Replenisher |
|---|---|---|
| Water | 800 ml | 600 ml |
| Ammonium thiosulfate (750 g/l) | 120 ml | 240 ml |
| Ammonium sulfite | 30 g | 65 g |
| Ferric ammonium ethylenediaminetetra-acetate | 0.11 mol | 0.24 mol |
| Ethylenediaminetetraacetic acid | 0.01 mol | 0.024 mol |
| Compound S-50 | 0.1 mol | 0.2 mol |
| Maleic acid | 0.1 mol | 0.2 mol |
| pH (25° C./with nitric acid and ammonia water) | 6.5 | 5.8 |

[Rinsing water] (The water in tank was the same as the replenisher) Tap water

TABLE 20

| | Tank Solution | Replenisher 1 | Replenisher 2 | Replenisher 3 | Replenisher 4 | Replenisher 5 | Replenisher 6 |
|---|---|---|---|---|---|---|---|
| Water | 800 ml | 800 ml | 800 ml | 800 ml | 800 ml | 800 ml | 800 ml |
| Sodium triisoproply-naphthalene(β)sulfonate | 0.1 g | 0.1 g | 0.1 g | 0.1 g | 0.1 g | 0.1 g | 0.1 g |
| Triethanolamine | 14.5 g | 14.5 g | 14.5 g | 14.5 g | 14.5 g | 14.5 g | 14.5 g |
| Potassium hydroxide | 3.0 g | 20.0 g | 18.0 g | 15.0 g | 10.0 g | 6.0 g | 3.0 g |
| Ethylenediaminetetraacetic acid | 4.5 g | 4.5 g | 4.5 g | 4.5 g | 4.5 g | 4.5 g | 4.5 g |
| Sodium 4,5-dihydroxy- | 0.5 g | 0.5 g | 0.5 g | 0.5 g | 0.5 g | 0.5 g | 0.5 g |

TABLE 20-continued

| | Tank Solution | Replenisher 1 | Replenisher 2 | Replenisher 3 | Replenisher 4 | Replenisher 5 | Replenisher 6 |
|---|---|---|---|---|---|---|---|
| benzene-1,3-disulfonate | | | | | | | |
| Potassium chloride | 15.8 g | — | — | — | — | — | — |
| Potassium bromide | 0.045 g | — | — | — | — | — | — |
| Fluorecent brightener (SR-13) | 2.0 g | 6.0 g | 5.0 g | 4.0 g | 3.5 g | 3.0 g | 2.5 g |
| Sodium sulfite | 0.1 g | 0.2 g | 0.2 g | 0.2 g | 0.2 g | 0.2 g | 0.2 g |
| Disodium N,N-bis (sulfonatoethyl) hydroxylamine | 8.5 g | 12.0 g | 12.0 g | 12.0 g | 12.0 g | 12.0 g | 12.0 g |
| N-Ethyl-N-(β-methanesulfonamido-ethyl)-3-methyl-4-aminoaniline 3/2 sulfate monohydrate | 5.0 g | 20.0 g | 17.0 g | 10.5 g | 8.5 g | 7.0 g | 6.5 g |
| Potassium carbonate | 26.3 g | 26.3 g | 26.3 g | 26.3 g | 26.3 g | 26.3 g | 26.3 g |
| Water Ad. | 1000 ml | 1000 ml | 1000 ml | 1000 ml | 1000 ml | 1000 ml | 1000 ml |
| pH(25° C./with potassium hydroxide and sulfuric acid | 10.15 | 13.0 | 12.6 | 11.5 | 10.7 | 10.4 | 10.3 |

The running test was conducted by varying the amount of the color developer until the replenisher had been fed in an amount of twice as much as the capacity of the tank under such conditions that the fluid layer was provided or not provided in the color developer replenisher tank.

After the completion of the running test, the sample coated as described above was continuously subjected to the wedge exposure (exposure: 250 CMS in exposure time of 0.1 sec) with a sensitometer (FWH, a product of Fuji Photo Film Co., Ltd.) (color temperature of the light source: 3200° K.) and processed. The changes in the density (Δ log D=0.8) of magenta and yellow minimum density in the period of one week or five weeks until the replenisher had become twice as much as the tank capacity in the running test were determined with a Macbeth densitometer to obtain the results given in Table 21.

After the completion of the running test, the state of the color developer replenisher in its tank and precipitation therein were obserbed to obtain the results given in Table 21.

TABLE 21

| Experiment No. | Amount of replenisher | Replenisher (see Table 20) | Floating lid of replenisher tank | Remarks | Magenta Δlog D = 0.8 | Yellow ΔDmin | Precipitare in Replenisher[1] Running period 1W | 5W | State of Replenisher[2] Running period 1W | 5W |
|---|---|---|---|---|---|---|---|---|---|---|
| 1 | 30 | Replenisher-1 | 30 floating balls[3] | Comp. ex. | −0.17 | +0.042 | X | X X | X | X X |
| 2 | 40 | Replenisher-2 | 30 floating balls[3] | Comp. ex. | −0.15 | +0.036 | X | X X | X | X X |
| 3 | 60 | Replenisher-3 | 30 floating balls[3] | Comp. ex. | −0.12 | +0.030 | X | X X | X | X X |
| 4 | 100 | Replenisher-4 | 30 floating balls[3] | Comp. ex. | −0.09 | +0.028 | X | X | X | X |
| 5 | 160 | Replenisher-5 | 30 floating balls[3] | Comp. ex. | −0.01 | +0.009 | ∘ | Δ | Δ | Δ |
| 6 | 200 | Replenisher-6 | 30 floating balls[3] | Comp. ex. | −0.01 | +0.008 | ∘ | ∘ | ∘ | Δ |
| 7 | 30 | Replenisher-1 | liquid paraffin (5 mm thick) | present invention | −0.01 | +0.008 | ∘ | ∘ | ∘ | ∘ |
| 8 | 40 | Replenisher-2 | liquid paraffin (5 mm thick) | present invention | ±0 | +0.008 | ∘ | ∘ | ∘ | ∘ |
| 9 | 60 | Replenisher-3 | liquid paraffin (5 mm thick) | present invention | −0.02 | +0.007 | ∘ | ∘ | ∘ | ∘ |
| 10 | 100 | Replenisher-4 | liquid paraffin (5 mm thick) | present invention | −0.03 | +0.006 | ∘ | ∘ | ∘ | ∘ |
| 11 | 160 | Replenisher-5 | liquid paraffin (5 mm thick) | Comp. ex. Comp. ex. | −0.04 | +0.008 | ∘ | ∘ | ∘ | ∘ |
| 12 | 200 | Replenisher-6 | liquid paraffin (5 mm thick) | present invention | −0.04 | +0.007 | ∘ | ∘ | ∘ | ∘ |
| 13 | 40 | Replenisher-2 | dodecane (5 mm thick) | present invention | −0.03 | +0.008 | ∘ | ∘ | ∘ | Δ |
| 14 | 40 | Replenisher-2 | tetradecane (5 mm thick) | present invention | −0.02 | +0.009 | ∘ | ∘ | ∘ | Δ |
| 15 | 40 | Replenisher-2 | pentadecane (5 mm thick) | present invention | −0.03 | +0.010 | ∘ | ∘ | ∘ | Δ |

(1)Precipitation
∘:none
Δ:very small amount
X: considerable
X X: large amount
(2)State of replenisher
∘: scarcely colored
Δ: slightly colored
X: dark brown
X X: dark brown + tary suspended matter
(3)Floating balls See J.P.KOKAI No. Sho. 61-258245

It will be apparent from Table 21 that when the replenisher of the present invention was fed in an amount of 20 to 100 ml/m$^2$ and the replenisher was covered with the fluid of the present invention, no precipitation was caused in the replenisher tank, the replenisher was prevented from coloring, changes in the magenta sensitivity and yellow minimum density due to the amount of the photosensitive material which had been processed therein were remarkably reduced, and thus the results were excellent.

In Experiment Nos. 5 and 6 wherein the amount of the replenisher was larger than 100 ml/m$^2$, excellent results were obtained without covering with the fluid layer of the present invention. It will be understood from this fact that the critical amount of the replenisher of the present invention is 100 ml/m$^2$ and that the effect of the covering with the fluid layer of the invention is obtained only when the amount is below the critical one.

The above-described results proved that the excellent results can be obtained by the present invention even when the amount of the replenisher is reduced to below 100 ml/m$^2$, though serious problems were practically posed with such a small amount of the replenisher in the prior art.

Comparative Example 1

The running test was conducted in the same manner as in Experiment No. 2 in Example 1 except that a color developer tank in the automatic developing machine was modified as described in J.P. KOKAI No. Hei 1-310351 and liquid paraffin was incorporated into the color development tank in such that liquid paraffin having a thickness of 5 mm covered on the surface of color developer in the color development tank.

The changes in the sensitivity ($\Delta$ log D=0.8) of magenta and yellow minimum density ($\Delta D_{min}$), and the state of the replenisher and precipitation therein were obserbed to obtain the following results: As in Experiment No. 2 in Example 1, the changes in the sensitivity and minimum density were severe, and the precipitation and coloring of the replenisher were also severe. In addition, the photosensitive material having streaky stains due to the uneven process were unusable.

It will be understood, therefore, that the amount of the replenisher cannot be reduced to that in the range of the present invention in the process of J.P. KOKAI No. Hei 1-310351.

EXAMPLE 2

The running test was conducted in the same manner as that of Example 1 except that Fuji Color Paper Super FAV (Lot 942-406, glossy surface) (a product of Fuji Photo Film Co., Ltd.) and Fuji Mini-Labo Paper Printer Processor PP 1250V (a product of Fuji Photo Film Co., Ltd.) were used. The processing steps and the compositions of the processing solutions were as follows:

| Step | Temp. | Time | Amount of replenisher* | Capacity of tank |
|---|---|---|---|---|
| Color development | 40.0° C. | 45 sec | 40 ml | 16 l |
| Bleach-fixing | 35° C. | 45 sec | 30 ml | 16 l |
| Rinse (1) | 35° C. | 20 sec | — | 10 l |
| Rinse (2) | 35° C. | 20 sec | — | 10 l |
| Rinse (3) | 35° C. | 20 sec | — | 10 l |
| Rinse (4) | 35° C. | 30 sec | 150 ml | 11 l |

* Amount of the replenisher per square meter of the photosensitive material

[The rinsing was carried out by four-tank countercurrent method from tank (4) to (1)]

[Color developer]

| | Tank Solution | Replenisher |
|---|---|---|
| Water | 800 ml | 800 ml |
| Sodium triisopropylnaphthalene($\beta$) sulfonate | 0.1 g | 0.1 g |
| Triethanolamine | 14.5 g | 14.5 g |
| Potassium hydroxide | 3.0 gl | 18.0 g |
| Ethylenediaminetetraacetic acid | 4.5 g | 4.5 g |
| Sodium 4,5-dihydroxybenzene-1,3-disulfonate | 0.5 g | 0.5 g |
| Potassium chloride | 15.8 g | — |
| Potassium bromide | 0.045 g | — |
| Fluorescent brightener (SR-13) | 2.0 g | 5.0 g |
| Sodium sulfite | 0.1 g | 0.2 g |
| Preservative (see Table 22) | 0.03 mol | 0.04 mol |
| N-ethyl-N-($\beta$-methanesulfonamido-ethyl)-3-methyl-4-aminoaniline 3/2 sulfate monohydrate | 5.0 g | 17.0 g |
| Potassium carbonate | 26.3 g | 26.3 g |
| water ad | 1000 ml | 1000 ml |
| pH (25° C./ with potassium hydroxide and sulfuric acid) | 10.15 | 12.60 |

[Bleach-fixing solution]

| | Tank Solution | Replenisher |
|---|---|---|
| Water | 800 ml | 800 ml |
| Sodium thiosulfate (750 g/l) | 100 ml | 200 ml |
| Ammonium sulfite | 20 g | 30 g |
| Potassium hydroxide | 3.0 gl | 18.0 g |
| Ammonium ethylenediaminetetraacetate | 0.08 mol | 0.18 mol |
| Ethylenediaminetetraacetic acid | 0.008 mol | 0.018 mol |
| Compound (S-43) | 0.15 mol | 0.30 mol |
| Acetic acid | 0.1 mol | 0.2 mol |
| pH (25° C./ with nitric acid and ammonia water) | 5.5 | 4.5 |

[Rinse]

(The solution in the tank was the same as the replenisher)

| | |
|---|---|
| Sodium chlorinated isocyanurate | 0.02 g |
| Deionized water (electric conductivity: 5 $\mu$s/cm or below) | 1000 ml |
| pH | 6.5 |

After the image-forming exposure of the above-described photosensitive material, the running test was conducted with the above-described paper automatic developing machine until the replenisher had been fed in an amount of twice as much as the capacity of the color development tank. The period of the process was 2 weeks or 6 weeks.

After the completion of the running test, the sample coated as described above was exposed and processed in the same manner as that of Example 1. The changes ($\Delta\gamma$)in the gradation$\gamma$ ($D_1$-0.5 wherein $D_1$ is a density at the point which is 0.5 of log E in higher exposure from density of 0.5) of magenta and yellow minimum density ($\Delta D_{min}$) between that after the two week running and that after 6 week running were determined with a Macbeth densitometer to obtain the results given in Table 22.

After the completion of the running test, the state of the color developer in its tank and precipitation therein were obserbed to obtain the results given in Table 22.

TABLE 22

| Experiment No. | Preservative | Floting lid of replenisher tank | Remarks | Magenta gradation change | Yellow ΔDmin | Precipitate in replenisher[1] running period 2W | 6W | State of replenisher[2] Running period 2W | 6W |
|---|---|---|---|---|---|---|---|---|---|
| 1 | Hydroxylamine | Floating balls[3] | Comp. Ex. | +0.24 | +0.033 | X | X X | X | X X |
| 2 | Sodium Sulfite | Floating balls[3] | Comp. Ex. | +0.31 | +0.010 | X | X X | Δ | X X |
| 3 | Hydroxylamine | Liquid Pafrrafin | Present invention | +0.10 | +0.008 | ∘ | Δ | ∘ | ∘ |
| 4 | Sodium Sulfite | Liquid Pafrrafin | Present invention | +0.11 | +0.007 | ∘ | Δ | ∘ | ∘ |
| 5 | I - 1 | Liquid Pafrrafin | Present invention | +0.05 | +0.008 | ∘ | ∘ | ∘ | ∘ |
| 6 | I - 5 | Liquid Pafrrafin | Present invention | −0.02 | +0.008 | ∘ | ∘ | ∘ | ∘ |
| 7 | I - 7 | Liquid Pafrrafin | Present invention | +0.0 | +0.007 | ∘ | ∘ | ∘ | ∘ |

(1)Precipitation
∘: None
Δ: Very small amount
X: Considerable
X X: Large amount
(2)State of replenicher
∘: Scarcely colored
Δ: Slightly colored
X: Dark brown
X X: Dark brown + tarry suspend matter
(3)Floating balls see J.P.KOKAI NO. SH061-258245

It will be understood from the results given in Table 22 that when the fluid of the present invention is added to the content of the replenisher tank for the color developer to cover the developer, the replenisher can be prevented from the precipitation and coloring and, in addition, the change of the characteristic features by the change of the amount of the photosensitive material treated therein can be remarkably improved and the excellent results can be obtained.

Particularly when the compound of the formula (I) was used as the preservative in the present invention, the change of the magenta radiation depending on the amount of the photosensitive material processed with the developer is only slight and further improved results were obtained.

EXAMPLE 3

The storability test was conducted with Mini Labo Paper Printer Processor PP1250V (a product of Fuji Photo Film Co., Ltd.) and a color developer replenisher having the following composition:

| [Color developer replenisher] | |
|---|---|
| Water | 80 ml |
| Sodium triisopropylnaphthalene(β)sulfonate | 0.1 g |
| Triethanolamine | 14.5 g |
| Potassium hydroxide | 18.5 g |
| Ethylenediaminetetraacetic acid | 4.5 g |
| Sodium 4,5-dihydroxybenzene-1,3-disulfonate | 0.5 g |
| Fluorescent brightener (SR-13) | 5.0 g |
| Sodium sulfite | 0.2 g |
| Disodium N,N-bis(sulfonatoethyl)hydroxylamine | 13.5 g |
| N-ethyl-N-(β-methanesulfonamidoethyl)-3-methyl-4-aminoaniline 3/2 sulfate monohydrate | 19.0 g |
| Potassium carbonate | 30.0 g |
| Water ad | 1000 ml |
| pH (25° C./ with potassium hydroxide and sulfuric acid | see Table 23 |

5 l of the replenisher having the above-described composition was fed into the replenisher tank, and then liquid paraffin was added thereto in such an amount that the thickness of the liquid paraffin layer would be 1 cm. They were left to stand at ambent temperature for one month. During this period, the contents of the tank were stirred 100 times with a stirring rod fitted to the tank every day. Thereafter, the formation of a precipitate in the replenisher and state of the liquid paraffin were observed. The liquid paraffin was taken and the developing agent [N-ethyl-N-(β-methanesulfonamidoethyl)-3-methyl-4-aminoaniline extracted with the liquid praffin was determined by liquid chromatographic analysis. The extraction rate [(concentration of the developing agent in the liquid paraffin)/(concentration of the developing agent in the replenisher)×100(%)] was determined. The results are given in Table 23.

TABLE 23

| Experiment No. | pH of replenisher | Precipitate in replenisher (1) | State of liquid parrafin(2) | Extraction rate of developing agent (%) |
|---|---|---|---|---|
| 1 | 11.25 | Δ | X | 0.9 |
| 2 | 11.50 | Δ | Δ | 0.5 |
| 3 | 11.75 | Δ | Δ | 0.3 |
| 4 | 12.00 | ∘ | ∘ | 0.01 |
| 5 | 12.25 | ∘ | ∘ | 0 |
| 6 | 12.50 | ∘ | ∘ | 0 |
| 7 | 12.70 | ∘ | ∘ | 0 |
| 8 | 13.00 | ∘ | ∘ | 0 |

(1)Precipitation
∘: none
Δ: very small amount
X: considerable
X X: large amount
(2)State of replenisher
∘: colorless, transparent
Δ: slightly milky
X: milky It will be understood from the results given in Table 23 that pH of the replenisher is particularly preferably 12.0 or above from the viewpoints of the formation of the precipitate in the replenisher, conversion of the liquid paraffin into opaque one and extraction of the developing agent with the liquid paraffin in the present invention.

EXAMPLE 4

The color developer replenisher 2 and the bleach-fixing replenisher in Example 1 were poured into the flexible vessel D having the bellows part as described above and left to stand at 30° C. for one month. Then the running test was conducted in the same manner as in Experiment Nos. 2 and 8 in Example 1 to obtain the results similar to those obtained in Example 1.

EXAMPLE 5

Concentrated kit solutions having the following compositions were prepared. The amounts of the ingredients were given per liter of the replenisher.

| [Color Developer] | |
|---|---|
| Part A: | |
| Water | 200 ml |
| Sodium triisopropylnaphthalene(β)sulfonate | 0.1 g |
| Triethanolamine | 14.5 g |
| Fluorescent brightener (SR-13) | 6.0 g |
| Disodium N,N-bis(sulfonatoethyl)hydroxylamine | 12.0 g |
| Water ad | 250 ml |
| Part B: | |
| Distilled water | 30 ml |
| N-ethyl-N-(β-methanesulfonamidoethyl)-3-methyl-4-aminoaniline 3/2 sulfate monohydrate | 17.0 g. |
| Sodium sulfite | 0.2 g |
| Sodium 4,5-dihydroxybenzene-1,3-disulfonate | 0.5 g |
| Distilled water ad | 50 ml |
| Part C: | |
| Water | 30 ml |
| Potassium hydroxide | 18 g |
| Ethylenediaminetetraacetic acid | 4.5 g |
| Potassium carbonate | 26.3 g |
| Water ad | 50 ml |

| [Bleach-fixing replenisher] | |
|---|---|
| Part A: | |
| Water | 400 ml |
| Ferric ammonium ethylenediaminetetraacetate | 0.25 mol |
| Compound (S-50) | 0.2 mol |
| Water ad | 500 ml |
| Part B: | |
| Water | 150 ml |
| Ammonium thiosulfate (75 g/l) | 240 ml |
| Ammonium sulfite | 65 g |
| Maleic acid | 0.2 mol |
| Water ad | 500 ml |

The above-described concentrated kits were fed into the flexible vessels having the bellows part as described above to obtain processing solutions in 10-liter and 5-liter size vessels. The concentrated kits were left to stand at 40° C. for two weeks and then the following replenishers were prepared:

| Color developer replenisher (10 l): | | |
|---|---|---|
| Water | 6300 ml | |
| Part A | 2500 ml | vessel C |
| Part B | 500 ml | vessel B |
| Part C | 500 ml | vessel A |
| **Bleach-fixing replenisher (5 l):** | | |
| Part A | 2500 ml | vessel C |
| Part B | 2500 ml | vessel C |

The running test was conducted in the same manner as in Experiment Nos. 2 and 8 in Example 1 except that the replenisher obtained as described above was used. The results thus obtained were similar to those obtained in Example 1.

EXAMPLE 6

The same procedure as that of Example 5 was conducted except that parts A and B were replenished separately from each other in an amount of 15 ml per square meter of the photosensitive material. The results thus obtained were similar to those obtained in Example 5.

The formation of the precipitate in the color developer replenisher caused when the amount of the replenisher is considerably reduced can be inhibited and change of the photographic characteristics by change of the amount of the processed photosensitive material can be also remarkably inhibited by the present invention. The amount of the color developer replenisher can be thus remarkably reduced to the range of 20 to 100 ml per square meter of the photosensitive material, and that of the waste water can be also remarkably reduced.

What is claimed is:

1. A method for continuously processing a silver halide color photographic photosensitive material by treating this material with a color developer containing at least one aromatic primary amine color developing agent, which comprises the steps of covering the surface of a color developer replenisher in a color developer replenisher tank with a layer of a floating fluid and replenishing 20 to 100 ml of the color developer replenisher per $m^2$ of the photosensitive material to a color developing tank.

2. The method of claim 1, wherein the color developer replenisher has a specific gravity of 1.030 to 1.100 and the floating fluid has a specific gravity of not higher than 1.030.

3. The method of claim 2, wherein the floating fluid has a specific gravity of not higher than 1.000.

4. The method of claim 3, wherein the floating fluid is incompatible or immiscible with the replenisher and has a water content of not higher than 10% by weight and a boiling point of not lower than 100° C.

5. The method of claim 4, wherein the floating fluid is liquid paraffin or a liquid saturated hydrocarbon.

6. The method of claim 1, wherein the floating fluid is in the form of a layer having a thickness of 0.1 to 20 mm.

7. The method of claim 1, wherein the color developing tank has open area of 0.02 to 0.001 $cm^{-1}$.

8. The method of claim 1, wherein the color developer replenisher is substantially free from a sulfite and hydroxylamine and contains a compound of the following formula (I):

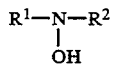

wherein $R^1$ and $R^2$ each represent a hydrogen atom, unsubstituted or substituted alkyl group, unsubstituted or substituted alkenyl group, unsubstituted or substituted aryl group or heteroaromatic group, with the proviso that both $R^1$ and $R^2$ cannot be hydrogen atom at the same time and they may be combined together to form a saturated or unsaturated 5 or 6 membered heterocyclic ring together with the nitrogen atom.

9. The method of claim 8, wherein the color developer replenisher contains not more than 4 mmol of a sulfite and hydroxylamine, respectively, and contains the compound of the formula (I) in an amount of 0.005 to 0.5 mol/l.

10. The method of claim 8, wherein $R^1$ and $R^2$ in the formula (I) represent independently an alkyl or alkenyl group having 1 to 10 carbon atoms which may be substituted by a carboxyl group or sulfonyl group.

11. The method of claim 1 wherein the pH of the color developer replenisher is 12.0 or higher.

12. The method of claim 1 wherein the color developer replenisher contains an aromatic polyhydroxy compound having the following formula (II) in an amount of 0.00005 to 0.1 mol/l:

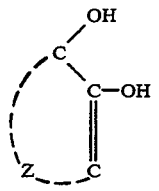

wherein Z together with —C—C═C— represents a group necessitated for completing the aromatic nucleus of benzene or naphthalene.

13. The method of claim 1 wherein the color developer contains $5\times10^{-2}$ to $2\times10^{-1}$ mol/l of chloride ion and $1\times10^{-4}$ to $4\times10^{-4}$ mol/l of bromide ion.

14. The method of claim 1 wherein the color developer replenisher contains a 4,4'-diamino-2,2'-disulfostilbene fluorescent brightener in an amount of $1\times10^{-3}$ to $1\times10^{-2}$ mol/l.

15. A method for continuously processing a silver halide color photographic photosensitive material by treating this material with a color developer containing at least one aromatic primary amine color developing agent and having a specific gravity of 1.030 to 1.100, which comprises the steps of covering the surface of a color developer replenisher in a color developer replenisher tank with a layer of a floating fluid in a thickness of 0.1 to 20 mm, the floating fluid having a specific gravity of not higher than 1.000 and being selected from the group consisting of liquid paraffin and liquid saturated hydrocarbons, and replenishing 20 to 100 ml of the color developer replenisher per $m^2$ of the photosensitive material to a color developing tank, the color developer replenisher containing not more than 4 mmol of a sulfite and hydroxylamine, respectively, and containing a compound of the formula (I) in an amount of 0.005 to 0.5 mol/l:

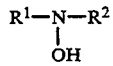

wherein $R^1$ and $R^2$ each represent a hydrogen atom, unsubstituted or substituted alkyl group, unsubstituted or substituted alkenyl group, unsubstituted or substituted aryl group or heteroaromatic group, with the proviso that both $R^1$ and $R^2$ cannot be hydrogen atom at the same time and they may be combined together to form a saturated or unsaturated 5 or 6 membered heterocyclic ring together with the nitrogen atom.

16. The method of claim 15, wherein $R^1$ and $R^2$ in the formula (I) represent independently an alkyl or alkenyl group having 1 to 10 carbon atoms which may be substituted by a carboxyl group or sulfonyl group.

17. The method of claim 15 wherein the pH of the color developer replenisher is 12.0 or higher.

18. The method of claim 15, wherein the color developing tank has open area of 0.02 to 0.001 $cm^{-1}$.

19. The method of claim 15 wherein the color developer replenisher contains an aromatic polyhydroxy compound having the following formula (II) in an amount of 0.00005 to 0.1 mol/l:

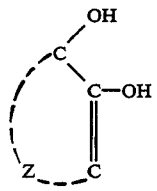

wherein Z together with —C—C═C— represents a group necessitated for completing the aromatic nucleus of benzene or naphthalene.

20. The method of claim 15 wherein the color developer contains $5\times10^{-2}$ to $2\times10^{-1}$ mol/l of chloride ion and $1\times10^{-4}$ to $4\times10^{-4}$ mol/l of bromide ion.

21. The method of claim 15 wherein the color developer replenisher contains a 4,4'-diamino-2,2'-disulfostilbene fluorescent brightener in an amount of $1\times10^{-3}$ to $1\times10^{-2}$ mol/l.

* * * * *